US009386872B2

(12) United States Patent
McDermott

(10) Patent No.: US 9,386,872 B2
(45) **Date of Patent: *Jul. 12, 2016**

(54) TRAY HANDLING SYSTEMS

(71) Applicant: Gregory McDermott, Saratoga Springs, NY (US)

(72) Inventor: Gregory McDermott, Saratoga Springs, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/834,843

(22) Filed: Aug. 25, 2015

(65) Prior Publication Data

US 2015/0359367 A1 Dec. 17, 2015

Related U.S. Application Data

(63) Continuation-in-part of application No. 14/390,255, filed as application No. PCT/US2013/032378 on Mar. 15, 2013, now Pat. No. 9,125,506.

(60) Provisional application No. 61/704,454, filed on Sep. 22, 2012, provisional application No. 61/623,731, filed on Apr. 13, 2012.

(51) Int. Cl.
*A47G 23/06* (2006.01)

(52) U.S. Cl.
CPC ..... *A47G 23/0625* (2013.01)

(58) Field of Classification Search
CPC ..... E04F 21/06; A47G 23/06; A47G 1/17; A47G 23/0625; B23Q 1/621; A47B 13/023; A47B 13/021; A47B 23/002; F16M 11/16; F16M 13/00; B65D 1/34; B65D 25/32; A47J 45/071; A47J 45/061; A45F 5/00; A45F 5/02; F16B 47/00
USPC ..... 294/172; 248/206.5; 108/43; D8/45
See application file for complete search history.

(56) References Cited

U.S. PATENT DOCUMENTS

| | | | |
|---|---|---|---|
| 3,292,640 | A | 12/1966 | Royal |
| 3,941,286 | A | 3/1976 | Perkinson |
| 4,314,219 | A | 2/1982 | Haraguchi |
| 4,329,673 | A | 5/1982 | Uchikune et al. |
| 5,067,761 | A | 11/1991 | Blowers |
| 5,076,438 | A | 12/1991 | Aronson |
| 5,186,507 | A | 2/1993 | Neidfeld |
| 5,221,006 | A | 6/1993 | Plumlee et al. |
| 6,145,906 | A | 11/2000 | Wright et al. |
| 6,637,792 | B1 | 10/2003 | McCoy et al. |
| 7,012,495 | B2 | 3/2006 | Underwood et al. |
| 7,243,786 | B2 | 7/2007 | Sollazzo |
| 7,377,474 | B2 | 5/2008 | Curtis |
| 7,975,623 | B1 | 7/2011 | Gassick et al. |
| 8,113,380 | B2 | 2/2012 | Goren |
| 8,746,156 | B2 | 6/2014 | Camarillo |
| 9,125,506 | B2 | 9/2015 | McDermott |
| 2005/0056192 | A1 | 3/2005 | Marchand |
| 2006/0032780 | A1 | 2/2006 | Heyn |
| 2008/0007078 | A1 | 1/2008 | McEwin et al. |
| 2010/0308059 | A1 | 12/2010 | Berg |
| 2011/0031158 | A1 | 2/2011 | King |
| 2012/0097574 | A1 | 4/2012 | Parsons |

FOREIGN PATENT DOCUMENTS

| | | | |
|---|---|---|---|
| EP | 1438915 | A1 | 7/2004 |
| WO | 2010151151 | A1 | 12/2010 |

OTHER PUBLICATIONS

International Search Report for PCT/US2013/032378 dated Jun. 28, 2013.

*Primary Examiner* — Stephen Vu
(74) *Attorney, Agent, or Firm* — Carter, DeLuca, Farrell & Schmidt, LLP

(57) ABSTRACT

A serving tray system includes a serving tray and a handle. A magnetic member and a release member are supported by the handle. The magnetic member is configured to selectively secure the handle to the serving tray. The release member is configured to selectively engage the serving tray to space the magnetic member from the serving tray for separating the handle from the serving tray.

19 Claims, 60 Drawing Sheets

PRIOR ART

TRAY HANDLING SYSTEMS

CROSS REFERENCE TO RELATED APPLICATIONS

This is a continuation-in-part application of U.S. patent application Ser. No. 14/390,255, filed Oct. 2, 2014, which is a U.S. National Stage Application of International Application No. PCT/US2013/032378, filed Mar. 15, 2013, and is now U.S. Pat. No. 9,125,506, which claims the benefit of U.S. Provisional Patent Application Ser. No. 61/704,454, filed Sep. 22, 2012, and U.S. Provisional Patent Application Ser. No. 61/623,731, filed Apr. 13, 2012, the entire contents of each of which are incorporated by reference herein.

TECHNICAL FIELD

The present disclosure relates generally to the food service and catering industries. More particularly, the present disclosure relates to devices and techniques for handling serving trays.

BACKGROUND

Typical serving trays alone offer no specifically designed handling features forcing users to rest the weight of the tray on a horizontally oriented hand or arm. Larger trays are often carried by placing one end of the tray on the user's shoulder with an open palm and bent wrist. These unnatural positions result in fatigue, injury, and the potential for accidents. Often, users rely on one arm or hand to balance the tray in order to maintain use of the other hand resulting in an unstable condition.

To unload a serving tray, the user must often set the tray down on a nearby surface or temporary stand due to an inability to continue to support the weight of the serving tray. With a more secure tray and gripping posture, users could avoid the need for a stand and unload items while still holding the tray to improve efficiency and space within serving areas.

Notably, there are multiple devices relevant to tray handling; however, many of these devices are cumbersome and/or impractical to use and/or manufacture. In particular, many tray handling devices lack the ability to readily enable the stacking of trays or placement of the trays on a flat surface. Other tray handling devices may be difficult to use; for instance, requiring the user to repeatedly manipulate the serving tray to access a single location on the serving tray in order to repeatedly secure and/or unsecure a handle from the serving tray. Thus, there exists a need for a device and/or a system for handling serving trays that improves control of the tray without sacrificing efficiency and functionality.

SUMMARY

According to one aspect of the present disclosure, a serving tray system includes a serving tray and a handle. The handle includes a holding end portion configured to be carried by a user and a coupling end portion that selectively releasably secures to the serving tray. The handle supports at least one magnetic member that provides a magnetic force. The handle includes at least one movable member that is selectively movable relative to the holding end portion between a first state and a second state. A movement of the at least one movable member to the first state enables the magnetic force of the at least one magnetic member to secure the coupling end portion of the handle to the serving tray. When the coupling end portion is secured to the serving tray, the coupling end portion is configured to carry the serving tray. A movement of the at least one movable member to the second state prevents the coupling end portion of the handle from securing to the serving tray.

In certain embodiments, the at least one movable member includes an insert adapted to contain the magnetic force when the at least one movable member is in the second state. The at least one movable member can be spring biased to one of the first and second states. In some embodiments, the at least one movable member is rotatably movable relative to the holding end portion. In certain embodiments, the at least one moveable member rotates between the first and second states, the at least one magnetic member being exposed in the first state and covered in the second state.

In some embodiments, the magnetic member is axially movable relative to the holding end portion.

In certain embodiments, a movement of the magnetic member changes the magnetic force provided by the magnetic member.

In some embodiments, the holding end portion includes at least one leg member extending therefrom, the at least one leg member configured to support the handle together with the serving tray on a surface when the coupling portion of the handle is secured to the serving tray. In some embodiments, the coupling end portion is axially and rotatably movable relative to the holding end portion.

In certain embodiments, a protective cover is supported over the magnetic member of the handle and adapted to protect the magnetic member.

In some embodiments, an actuator is actuatable to move one or both of: 1) the at least one magnetic member; and 2) the at least one movable member.

In certain embodiments, the serving tray is formed of a magnetically attractive material, the at least one magnetic member being magnetically attracted to the serving tray.

In some embodiments, the serving tray includes a receiver plate, the receiver plate being formed of the magnetically attractive material so that the at least one magnetic member is magnetically attracted to the receiver plate of the serving tray. The serving tray can include a bearing plate and a fastener. The fastener secures the bearing plate and the receiver plate to the serving tray. The serving tray can include at least one insert.

According to one aspect of the present disclosure, a portable handle for securement to an independent serving tray includes a body formed of non-magnetic material and configured to support a serving tray. The body includes a holding end portion configured to be carried by a user and a coupling end portion configured to selectively releasably secure to the serving tray. A magnet is enclosed within the body by the non-magnetic material of the body and configured to provide a magnetic force in the coupling end portion of the body to attach the coupling end portion of the body to the serving tray.

In some embodiments, the coupling end portion is movable between a first state and a second state, the coupling end portion being securable to the serving tray in the first state and prevented from securing to the serving tray in the second state. In certain embodiments, a movement of the coupling end portion to the first state exposes the at least one magnet. In some embodiments, the magnet is axially movable relative to the holding end portion.

According to another aspect of the present disclosure, a serving tray carrying device includes a handle having a holding end portion configured to be carried by a user and a coupling end portion that selectively releasably secures to a serving tray. The handle supports at least one magnetic member that provides a magnetic force. The handle includes at least one movable member that is selectively axially movable relative to the holding end portion between a first state and a second state. A movement of the at least one movable member to the first state enables the magnetic force of the at least one magnetic member to secure the coupling end portion of the handle to the serving tray. A movement of the at least one movable member to the second state prevents the coupling end portion of the handle from securing to the serving tray.

According to yet another aspect of the present disclosure, a serving tray system is provided. The serving tray system includes a serving tray, a handle, a magnetic member and a release member. The magnetic member is supported by the handle and may be configured to selectively secure the handle to the serving tray. The release member is supported on the handle and may be configured to selectively engage the serving tray to space the magnetic member from the serving tray for separating the handle from the serving tray.

In some embodiments, the handle may include a support member configured to support the magnetic member. The support member may be formed of steel.

In certain embodiments, the release member may be pivotally attached to the handle and movable between an actuated state and an unactuated state.

In some embodiments, the release member may be biased toward the unactuated state by a spring. The release member may include a trigger segment and a leverage segment. The leverage segment may be configured to engage the serving tray upon actuation of the trigger segment.

In certain embodiments, at least a portion of the serving tray may include ferromagnetic material.

In some embodiments, the serving tray may include an alignment feature configured to align the magnetic member of the handle with a predetermined location of the serving tray.

According to yet another aspect of the present disclosure, a handle for carrying a serving tray includes a body, a magnetic member and a release member. The magnetic member may be supported by the body and may be configured to selectively secure the body to the serving tray. The release member may be supported by the body and may be configured to selectively engage the serving tray to space the magnetic member from the serving tray for separating the body from the serving tray.

In some embodiments, the body includes a support member configured to support the magnetic member. The support member may be formed of steel.

In certain embodiments, the release member is pivotally attached to the body and movable between an actuated state and an unactuated state. In some embodiments, the release member is biased toward the unactuated state by a spring. The release member may include a trigger segment and a leverage segment. The leverage segment may be configured to engage the serving tray upon actuation of the trigger segment.

According to still another aspect of the present disclosure, a portable handle for securement to an independent serving tray is provided. The portable handle includes a body formed of non-magnetic material and a magnet supported within the body. The body may be configured to support the independent serving tray and may include a holding end portion and a coupling end portion. The magnet may be configured to provide a magnetic force in the coupling end portion of the body to attach the coupling end portion of the body to the independent serving tray.

In some embodiments, the magnet is movable between a first state and a second state. The coupling end portion may be securable to the independent serving tray in the first state and prevented from securing to the independent serving tray in the second state.

In certain embodiments, a movement of the coupling end portion to the first state enables magnetic coupling. The magnet may be axially movable relative to the holding end portion.

In some embodiments, a release member may be configured to separate the body from the independent serving tray. The release member may be pivotally coupled to the body.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description of the embodiment(s) given below, serve to explain the principles of the disclosure, wherein.

DETAILED DESCRIPTION

Figure 1:
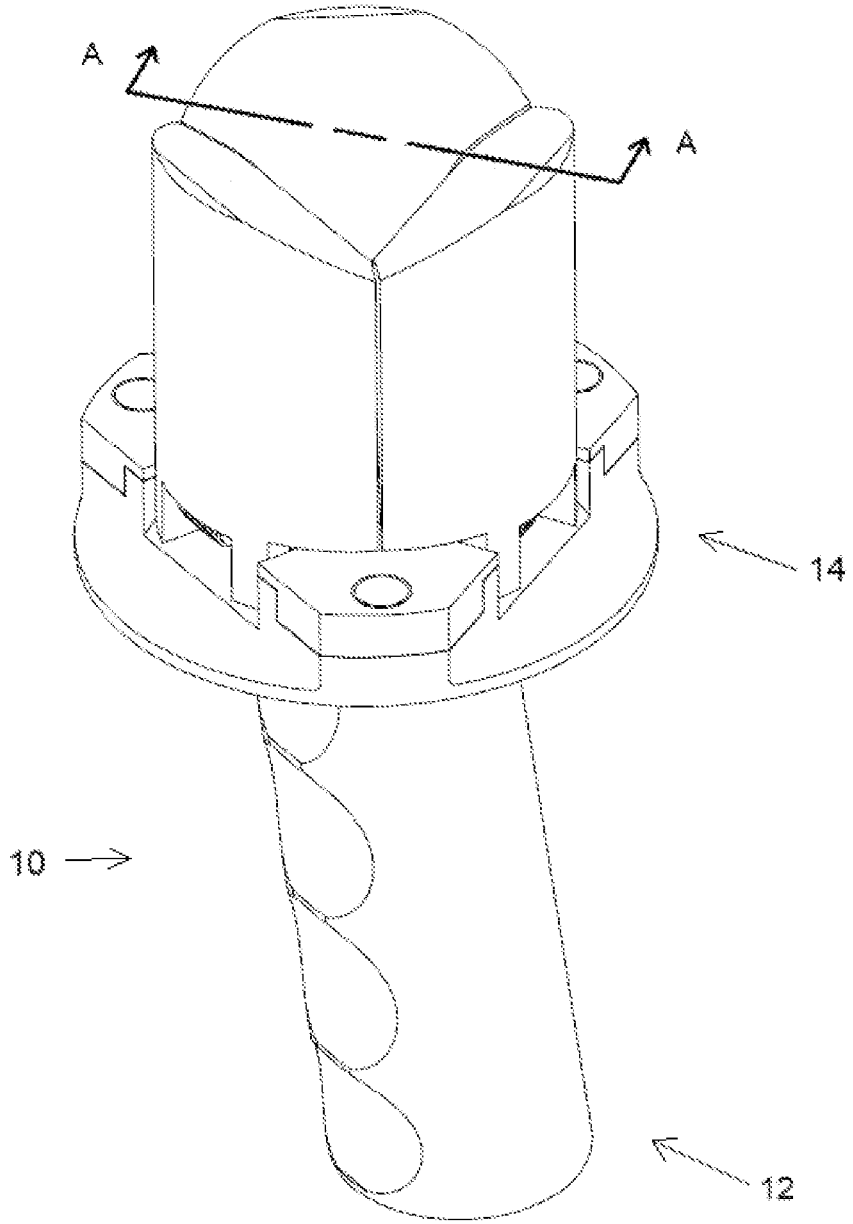
FIG. 1 is a perspective view of an embodiment of a serving tray handle shown in a first state.

Various embodiments of the presently disclosed tray handling system, and methods of using the same, will now be described in detail with reference to the drawings wherein like references numerals identify similar or identical elements. In the drawings, and in the following description, the term "proximal" should be understood as referring to the end of the access assembly, or component thereof, that is closer to the user during proper use, while the term "distal" should be understood as referring to the end that is farther from the user, as is traditional and conventional in the art.

In the following description, well-known functions or constructions are not described in detail to avoid obscuring the present disclosure in unnecessary detail. Further, to the extent consistent, any of the aspects or embodiments described herein may be used in conjunction with any or all of the other aspects or embodiments described herein.

Figure 2:
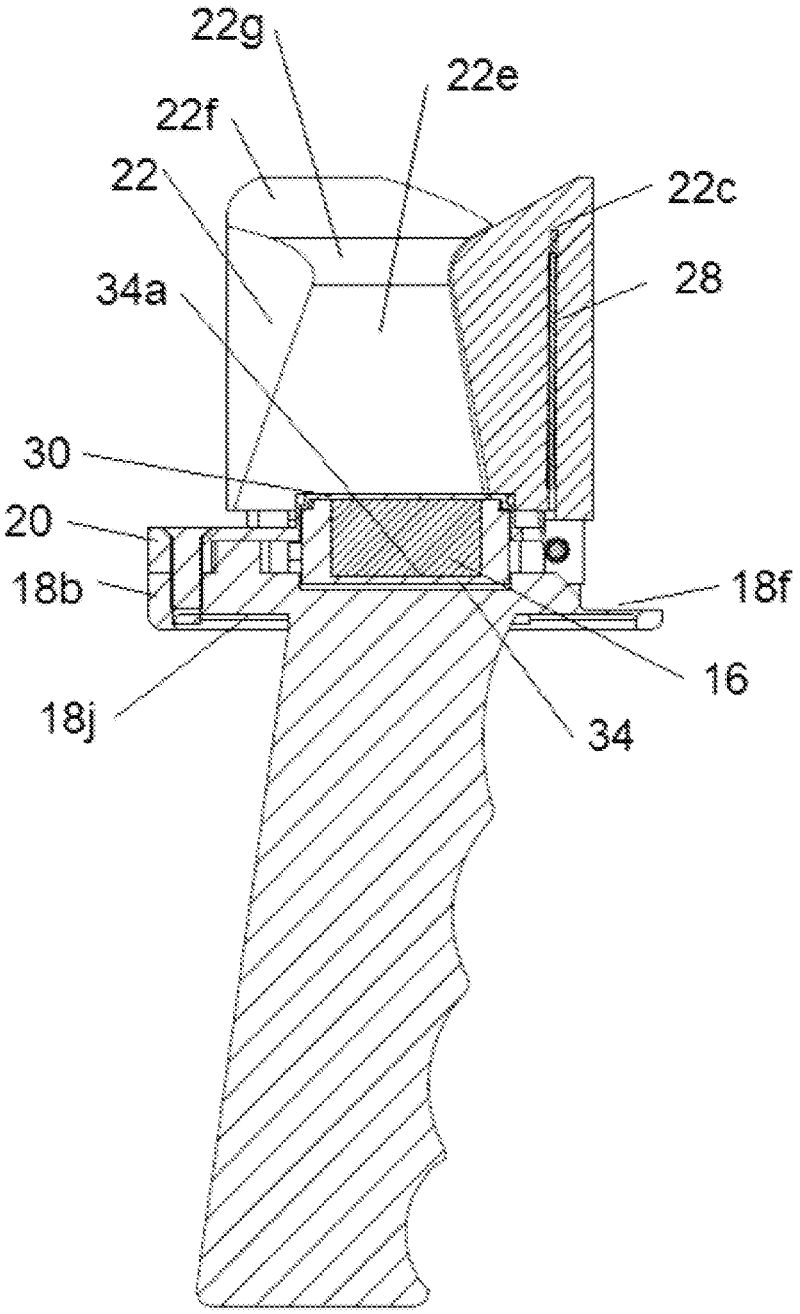
FIG. 2 is a side cross-sectional view of the serving tray handle taken along line A-A.

With reference to FIGS. 1 and 2, one embodiment of a serving tray handle 10 includes a holding end portion 12, a coupling end portion 14, and one or more magnets 16.

Figure 3:
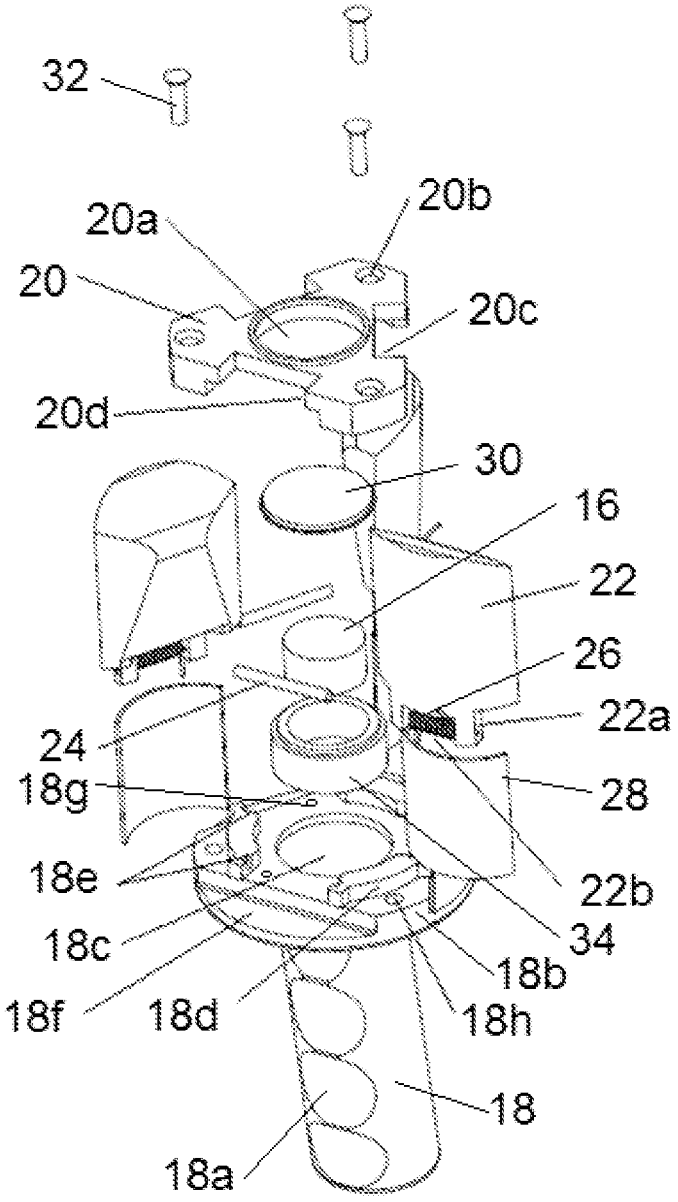
FIG. 3 is a top perspective view, with parts separated, of the serving tray handle shown in FIG. 1.

Referring also to FIG. 3, the holding end portion 12 includes a handle body 18 with a plurality of gripping features 18*a* at a proximal end portion and a support platform 18*b* at a distal end portion. The support platform 18*b* includes a plurality of projections 18*d*. Each projection 18*d* defines a pair of grooves 18*e*. Each groove 18*e* of the pair of grooves 18*e* is disposed on an opposite end of the projection 18*d*. The support platform 18*b* defines a central opening 18*c*, a plurality of fastener openings 18*h*, a plurality of notches 18*f* recessed from a top surface of the support platform 18*b*, and a plurality of penetrations 18*g*. The fastener openings 18*h* and the notches 18*f* are positioned at spaced locations around the support platform 18*b*. A bottom surface of the support platform 18*j* defines a depression configured to accommodate at least a portion of a users hand during use. The holding end portion 12, or sections thereof, can include any suitable elastic material selected to improve comfort around the handle body 18 and support surface 18*j*.

The coupling end portion 14 includes a restraint plate 20 and a plurality of support arms 22 pivotably mounted to the handle body 18 by pins 24 having one or more torsion springs 26 mounted thereon. One leg of the torsion spring 26 is inserted into one of the penetrations 18*g* while the other leg resists the rotational motion of the support arm 22.

Figure 4:
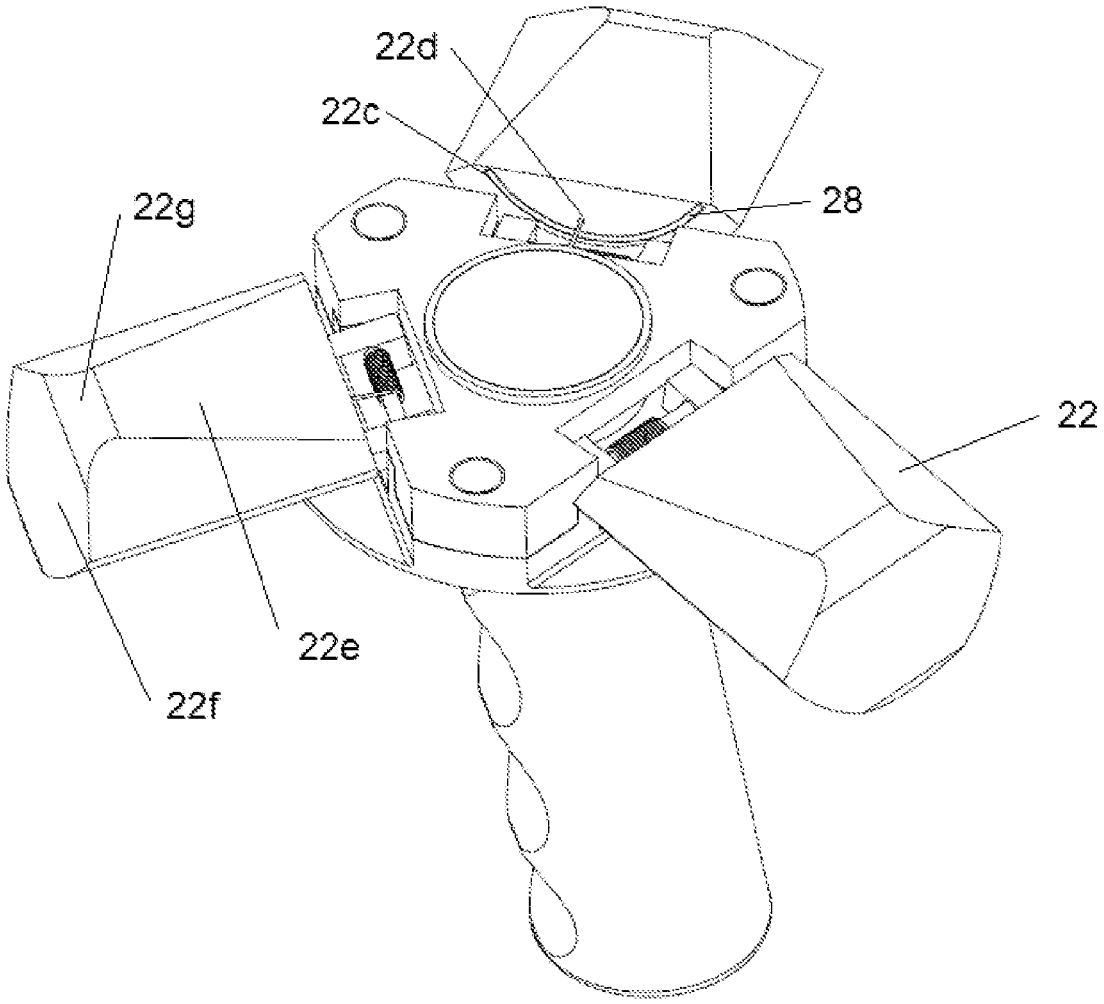
FIG. 4 is a perspective view of the serving tray handle of FIG. 1 shown in a second state.

Each support arm 22 includes a plurality of teeth 22*a* that extends proximally from the support arm 22. The plurality of teeth 22*a* define a passage 22*b* therethrough configured to receive a pin 24 to secure the respective support arm 22 to the support platform 18*b*. Each end of the pin 24 is configured to be seated within one of the pair of grooves 18*e* of adjacent projections 18*d* of the support platform 18*b* such that the opposite ends of each pin 24 are secured to adjacent projections 18*d*. As seen in FIGS. 2 and 4, each support arm 22 defines an internal cavity 22*c* that is configured to receive a ferromagnetic insert 28. A hole 22*d* is defined in a proximal face of the support arm 22 that is configured to receive a leg of one of the torsion springs 26. Each support arm 22 defines an inner surface 22*e*, an outer surface 22*f*, and an intermediate surface 22*g* positioned between the inner surface 22*e* and the outer surface 22*f* on a distal end portion of the respective support arm 22.

The restraint plate 20 defines a central opening 20*a*, a plurality of fastener openings 20*b*, and a plurality of spaced apart cutouts 20*c*. Each cutout 20*c* is configured to receive the plurality of teeth 22*a* of one of the support arms 22. Each cutout 20*c* includes a plurality of shoulders 20*d* configured to extend over adjacent grooves 18*e* of adjacent projections 18*d* to retain a pin 24 within the grooves 18*e* for securing a respective one of the support arms 22 to the support platform 18*b*. A cover 30 is placed over the magnet 16 and restrained by the restraint plate 20. The restraint plate 20 is secured to the support platform 18*b* of the holding end portion 12 by one or more fasteners 32 inserted through the fastener openings 20*b* of the restraint plate 20 and into the fastener openings 18*h* defined in the support platform 18*b*. In some embodiments, a bottom or proximal surface of the restraint plate 20 can be secured to a top or distal surface of the support platform 18*b* using known fastening techniques such as welding, adhesives, or the like.

As depicted in FIG. 2, the restraint plate 20 and the support platform 18*b* together define a cavity that supports a ferromagnetic housing 34. The cavity is formed by the central opening 18*c* of support platform 18*b* and the central opening 20*a* of the restraint plate 20. The magnet 16 is received in a bore 34*a* defined in the ferromagnetic housing 34. When the protective cover 30 is secured to the ferromagnetic housing 34 by the restraint plate 20, the protective cover 30 covers the magnet 16 and retains the magnet within the bore 34*a* of the ferromagnetic housing 34. The protective cover 30 is formed of a non-magnetic material and is configured to protect the magnet 16.

Figure 5A:
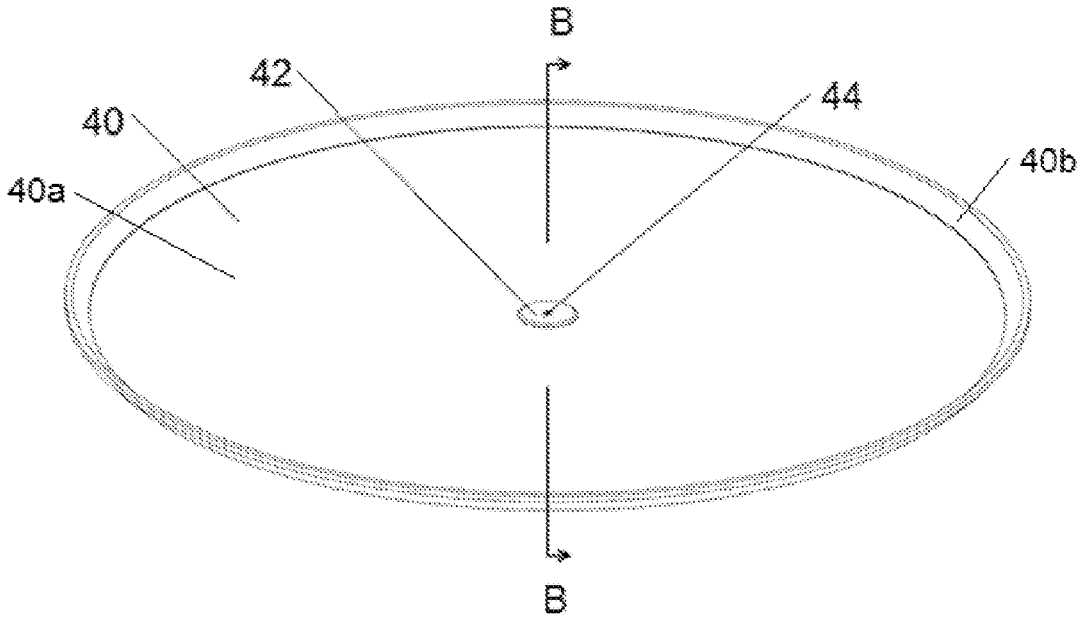
FIG. 5A is a perspective view of an embodiment of a serving tray.
Figure 5B:
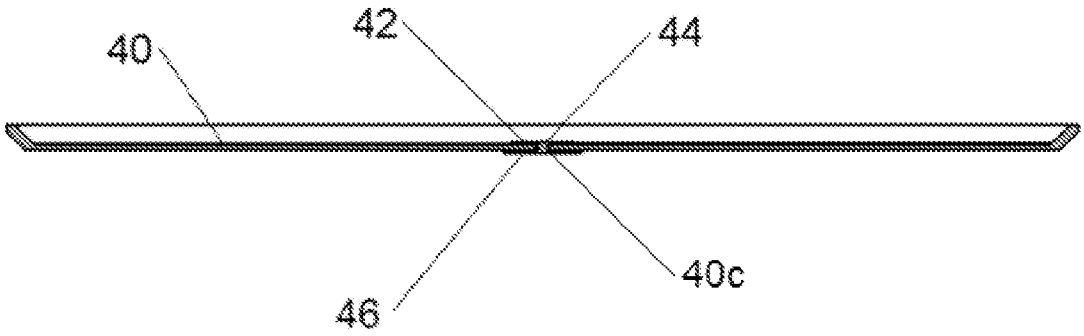
FIG. 5B is a side cross-sectional view of the serving tray of FIG. 5A taken along line B-B.

Referring to FIG. 5A, a tray 40 has a body 40*a* and a distal lip 40*b* that extends from the body 40*a*. Referring to FIG. 5B, a fastener 44 secures a ferromagnetic receiver plate 46 to a bottom surface of the body 40*a* and a bearing plate 42 to a top surface of the body 40*a*. To secure the receiver plate 46 and the bearing plate 42 to the body 40*a*, the fastener 44 is advanced through a fastener opening 40*c* defined in the body 40*a*.

Figure 6:
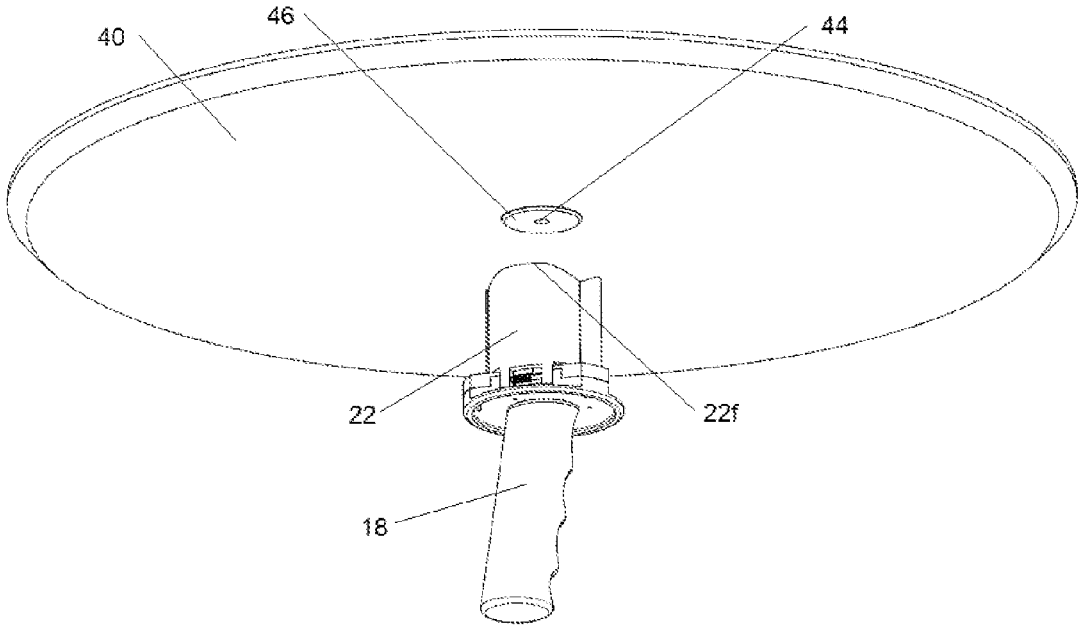
FIG. 6 is a bottom perspective view, with parts separated, of an embodiment of a serving tray system including the serving tray handle shown in FIG. 1 and the serving tray shown in FIG. 5A.
Figure 7A:
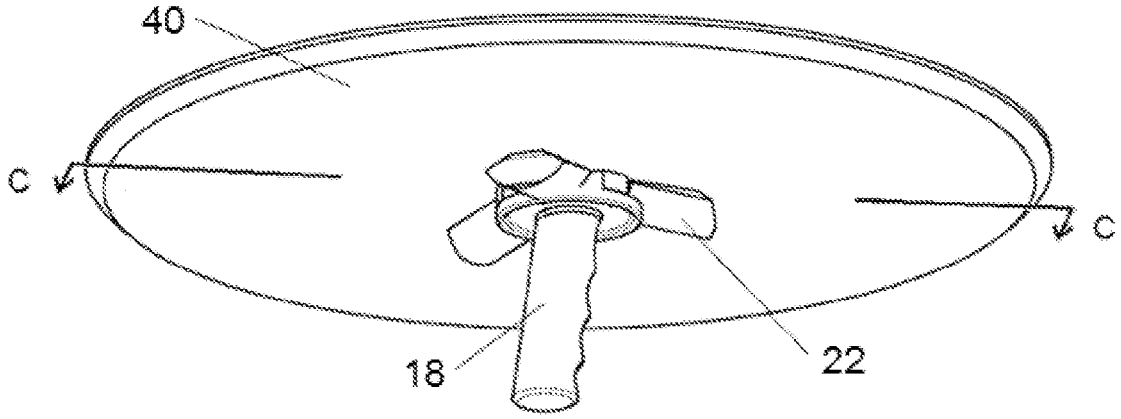
FIG. 7A is a bottom perspective view of the serving tray system of FIG. 6 with the serving tray handle shown secured to the serving tray.

In use, as illustrated in FIGS. 6 and 7A, the holding end portion 12 of the serving tray handle 10 is grasped and orientated so that coupling end portion 14 can selectively and releasably engage the serving tray 40. In particular, the distal surfaces 22*f* of the support arms 22 of the coupling end portion 14 can be pressed against the bottom surface of the serving tray 40 to move the support arms 22, against a biasing force provided by the torsion springs 26, from a first state (e.g., a vertical orientation) to a second state (e.g., a horizontal orientation). As appreciated, in the first state, the support arms 22 cover the magnet 16 and provide the handle 10 with a slimmer profile as compared to the profile of the handle 10 when the support arms 22 are positioned in the second state.

Figure 7B:
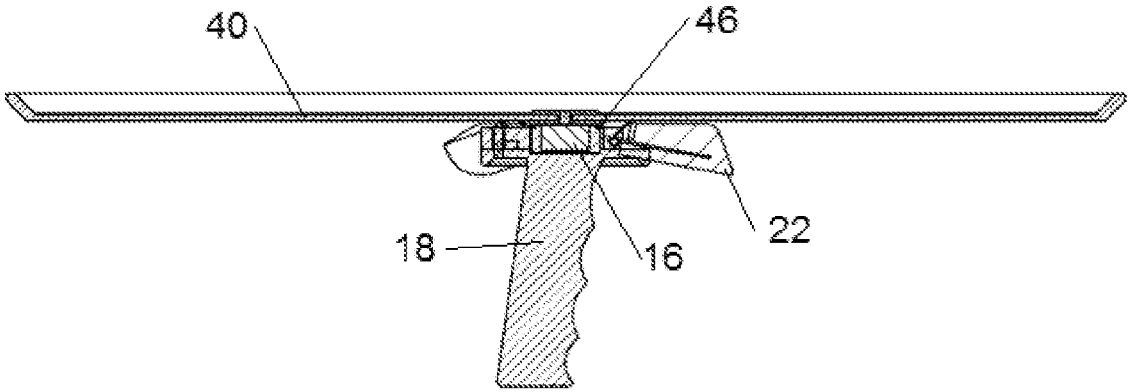
FIG. 7B is a side cross-sectional view of the serving tray system of FIG. 7A taken along line C-C.

Referring also to FIG. 7B, the forces acting on the distal surfaces 22*f* of the supports arms 22 when pressed against the tray 40 impart rotational motion to the support arms 22 against the bias of the torsion springs 26 about a pivot axis defined by the pivot pins 24. As the support arms 22 rotate away from a longitudinal axis that extends between the coupling and holding end portions 12, 14 of the handle 10, the handle 10 is brought closer to the ferromagnetic receiver plate 46 that is fastened to the serving tray 40. Upon reducing a separation distance between the magnet 16 and the receiver plate 46 to a predetermined distance in which a magnetic connection between the magnet 16 and the receiver plate 46 is greater than the resistive force of the torsion springs 26, the handle 10 becomes magnetically coupled to the serving tray 40. Notably, the securement of the handle 10 to the tray 40 can be accomplished with one hand without visual access to the underside of the tray and without precise movements. In particular, by positioning the magnetic member 16 in the general area around the receiver plate 46, the magnetic forces will draw the handle 10 into approximation with the receiver plate 46 until the two members are in contact. When the handle 10 and the tray 40 are magnetically coupled, the support arms 22 of the coupling end portion 14 extend radially outwardly from the holding end portion 12 to provide load support to the tray 40 and any items that the tray 40 may be used to carry.

As seen in FIG. 7B, to remove the handle 10 from the serving tray 40, the user slides the handle 10 laterally away from the receiver plate 46 of the serving tray 40. Notably, the magnetic force is weaker in the transverse direction, allowing the user to separate the handle 10 from the receiver plate 46 with a shear force provided by a lateral movement of the handle 10 relative to the tray 40. Once the magnet 16 is removed from the presence of the ferromagnetic receiver plate 46, the user can separate the handle 10 from the tray 40. Upon removal of the handle 10 from the tray 40, the biasing force provided by the torsion springs 26 rotate the support arms 22 toward the first state (e.g., vertical orientation) thereby enclosing the magnet 16 and the magnetic field without user interaction. In addition to providing automatic actuation via the return bias to the first state upon removal, the torsion springs 26 provide a variable plane to accommodate variations in tray 40 thickness, flatness, and manufacturing variability in the handle 10 components.

Referring again to FIG. 2, the ferromagnetic inserts 28 housed in the support arms 22 reduce the magnetic field beyond the boundary of the handle 10 to reduce the risk of coupling to and/or interfering with unintended objects (e.g., electronic devices), especially when the support arms 22 are positioned in the first state. Notably, the ferromagnetic inserts 28 contain the magnetic field so that magnets 16 with high strength magnetic fields can be carried without concern for exposing adjacent objects to the magnetic field. The inserts 28 are configured to redirect the magnetic field emanating from the top pole of the magnet 16 to the lower pole. In some embodiments, the ferromagnetic inserts 28, are omitted, particularly where magnetic field reduction is unnecessary.

Figure 8A:
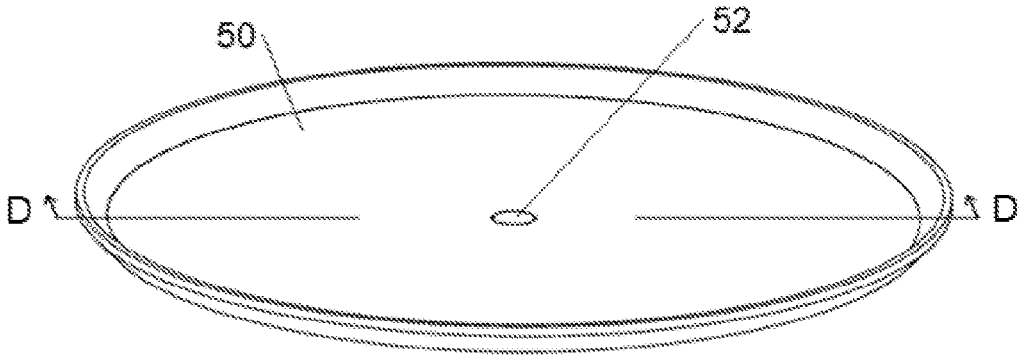
FIG. 8A is a perspective view of a second embodiment of a serving tray.
Figure 8B:
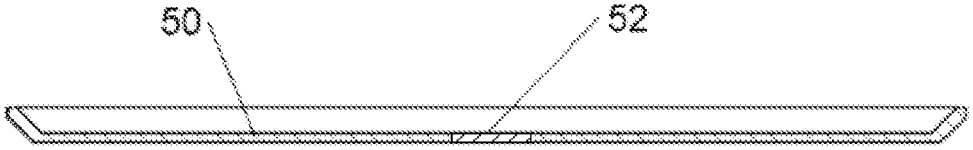
FIG. 8B is a side cross-sectional view of the serving tray embodiment of FIG. 8A taken along line D-D.

Referring to FIGS. 8A and 8B, a second embodiment of an independent serving tray includes a tray 50 and a ferromagnetic insert 52. The serving tray 50 has an integral ferromagnetic insert 52. In some embodiments, the insert 52 is molded into the tray 50 during the manufacturing process.

Figure 9:
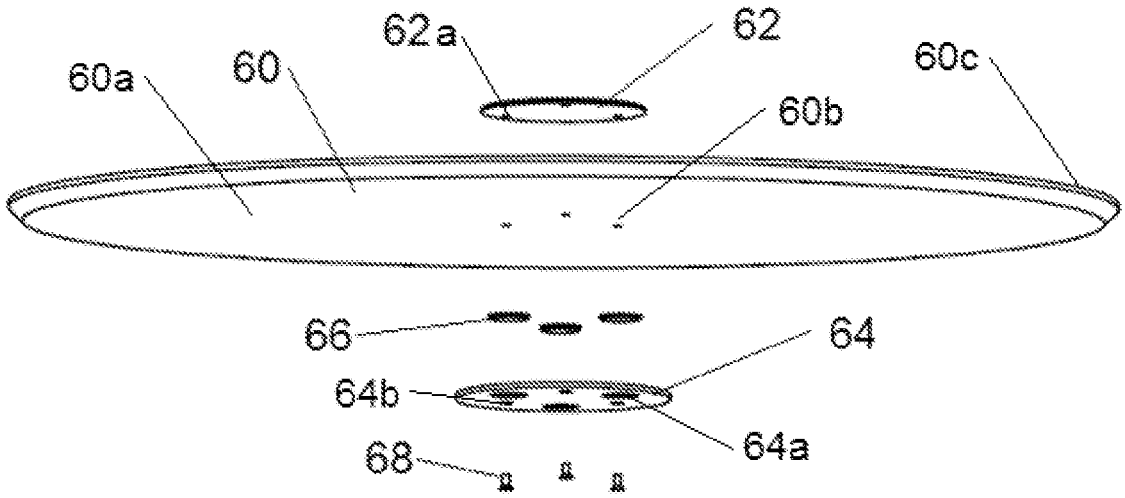
FIG. 9 is a bottom perspective view, with parts separated, of another embodiment of a serving tray.
Figure 10A:
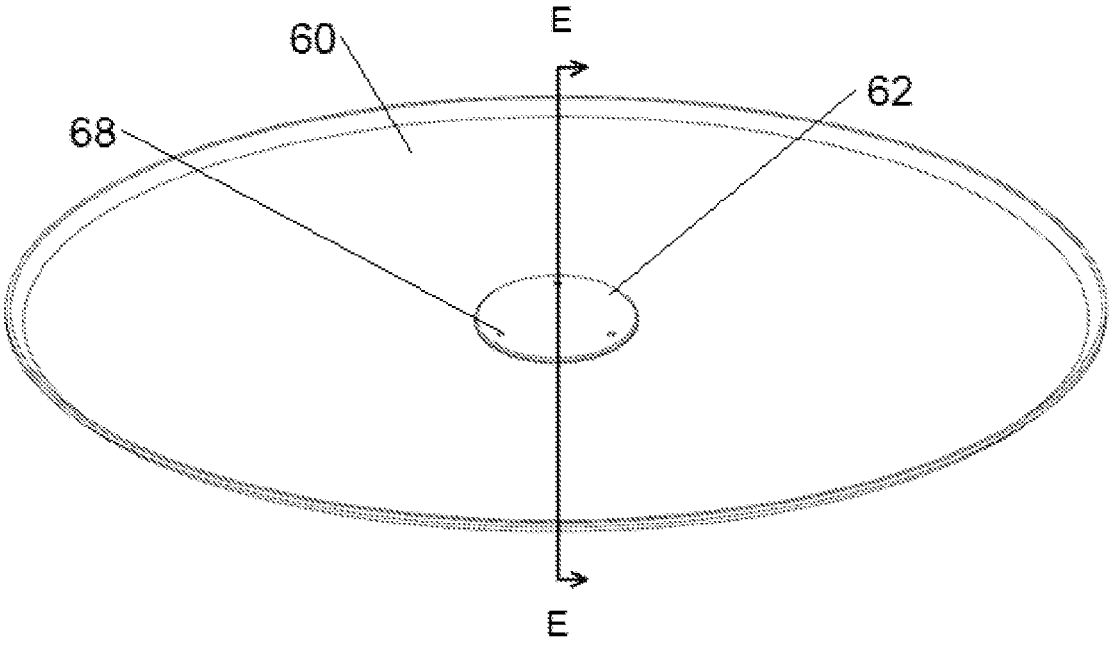
FIG. 10A is a perspective view of the serving tray shown in FIG. 9.
Figure 10B:
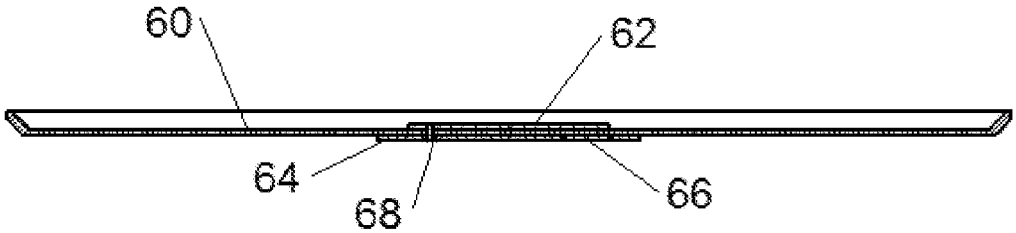
FIG. 10B is a side cross-sectional view of the serving tray of FIG. 10A taken along line E-E.

Referring to FIGS. 9, 10A, and 10B, still another embodiment of an independent serving tray 60 includes a body 60*a* and a distal lip 60*c* that extends from the body 60*a*. A plurality of fastener holes 60*b* is defined in the body 60*a*. A bearing plate 62 having threaded holes 62*a* to receive fasteners 68 is mounted to the body 60*a* of the tray 60. A plurality of ferromagnetic inserts 66 with stepped diameters are secured to a bottom surface of the body 60*a* by a non-ferromagnetic receiver plate 64. The plate 64 defines a plurality of fastener holes 64*b* and a plurality of counter bored holes 64*a* configured to receive the ferromagnetic inserts 66. Referring to FIG. 10B, the stepped diameter of the one or more inserts 66 and the corresponding counter bored holes 64*a* of the receiver plate 64 allow a bottom surface of the ferromagnetic inserts 66 to align with a bottom surface of the receiver plate 64. The screws 68 fasten the receiver plate 64 through the thickness of the tray 60 to the bearing plate 62. The array of magnetically attractable inserts 66 allow a magnetic handle to be secured to the tray 60 at multiple locations about the tray 60.

Figure 11A:
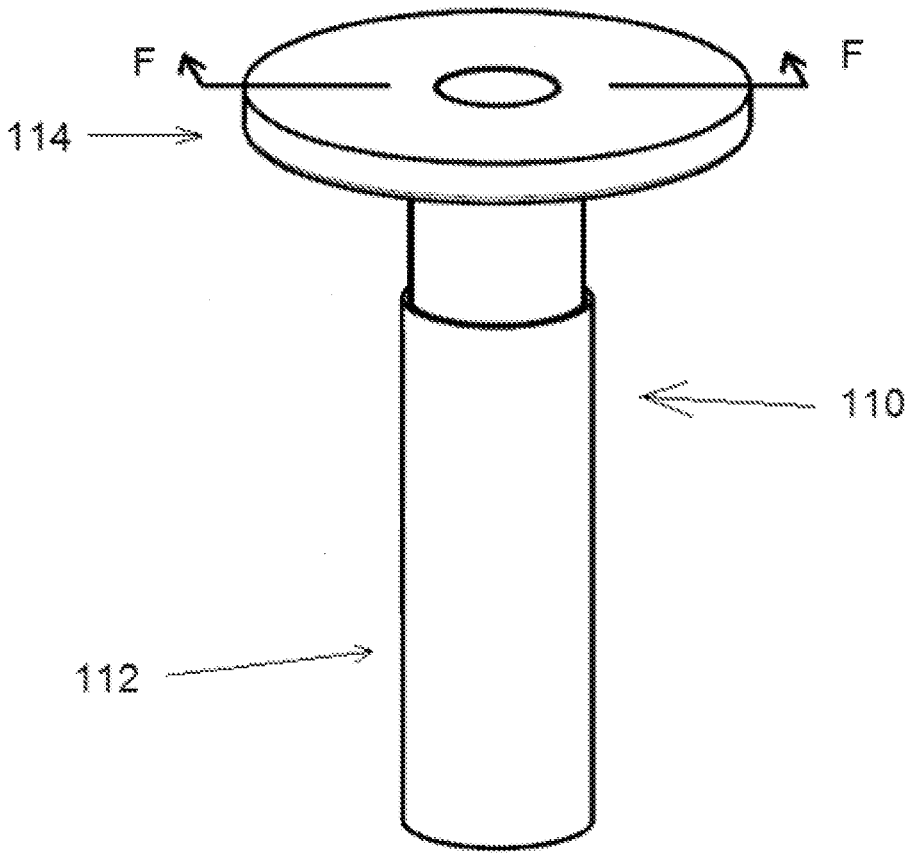
FIG. 11A is a perspective view of another embodiment of a serving tray handle shown in a first state.
Figure 11B:
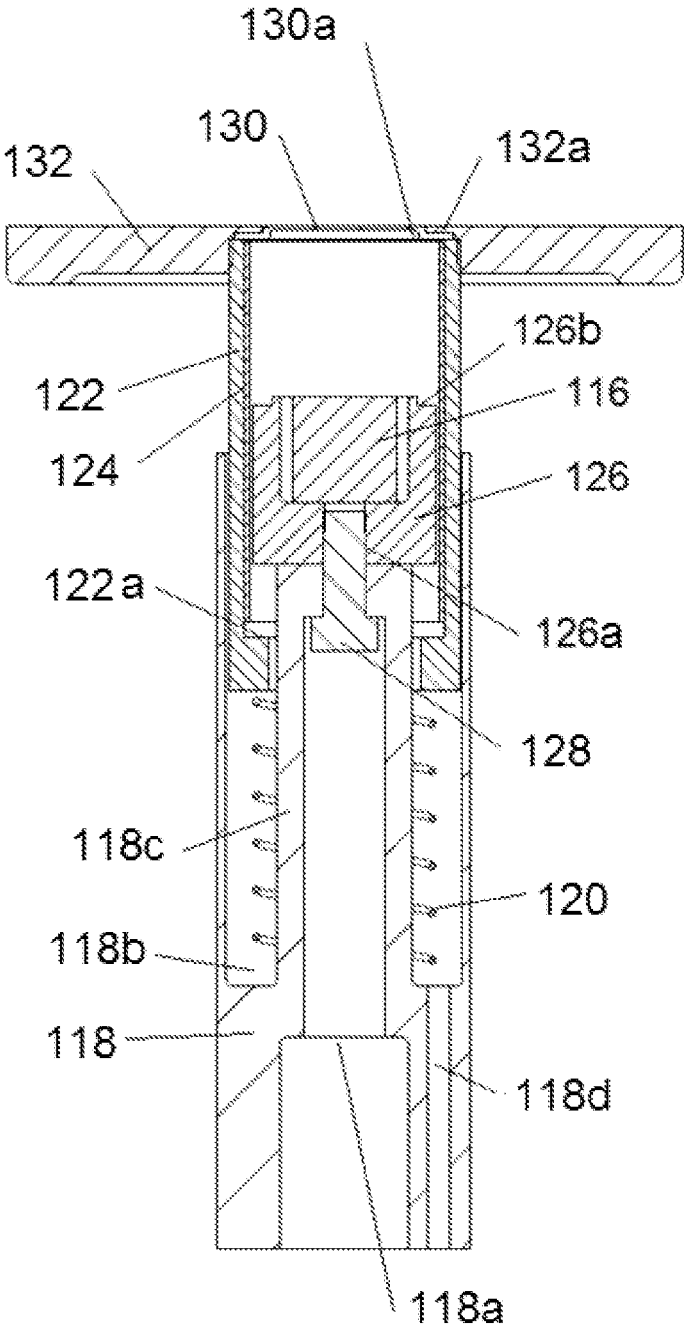
FIG. 11B is a side cross-sectional view of the embodiment of FIG. 11A taken along line F-F.

With reference to FIGS. 11A and 11B, another embodiment of a serving tray handle 110 includes a holding end portion 112, a coupling end portion 114, and one or more magnets 116. The holding end portion 112 includes a handle body 118 that defines an internal stepped bore 118*a* and an upper cavity 118*b*. The handle body 118 also includes a central shaft 118*c* formed between an upper portion of bore 118*a* and upper cavity 118*b*. The handle body 118 defines a peripheral bore 118*d* configured to allow debris to exit the upper cavity 118*b* of the handle body 118. The upper cavity 118*b* houses a compression spring 120 that is captured by a tube 122. The tube 122 has a flange 122*a* at the proximal end portion that is configured to receive the central shaft 118*c*. A proximal portion of an inner bore defined by tube 122 is configured to receive a ferromagnetic collar 124.

A ferromagnetic housing 126 defines a fastener opening 126*a* configured to receive a fastener 128 and includes an external step 126*b* at a distal end portion of the housing 126. The housing 126 also defines an inner cavity configured to receive the magnet 116. The magnet 116 is secured to the housing 126 using any suitable fastening arrangement such as adhesive, threading, friction fit, snap-fit, or the like. A fastener 128 is secured to the housing 126 through the opening 126*a* and the bore 118*a*. The tube 122 is movably secured to the handle body 118 when the housing 126 is secured to the handle body 118.

The coupling end portion 114 includes a movable support platform 132 secured to a distal end portion of the tube 122. The support platform 132 defines a stepped bore 132*a* for receiving a cover 130 and the tube 122. Notably, support platform 132 is movable between a first state and a second state. The cover 130 has a stepped diameter 130*a* to allow the cover 130 to mount to an upper surface of the support platform 132. The stepped bore 132*a* and the cover 130 are configured to receive the housing external step 126*a*. The tube member 122 is secured to a lower bore of the support platform 132 to secure the cover 130 to the handle 110. The tube 122 may be secured to the support platform 132 by any suitable fastening arrangement such as adhesive, welding, threading, friction fit, snap-fit, or the like.

Figure 12A:
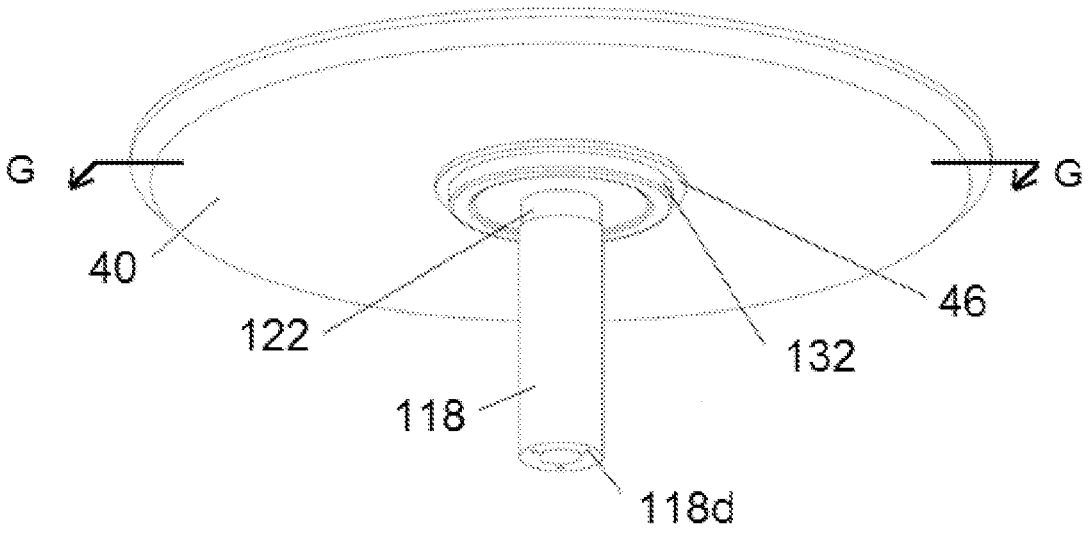
FIG. 12A is perspective view of the serving tray handle of FIG. 11A shown secured to the tray.
Figure 12B:
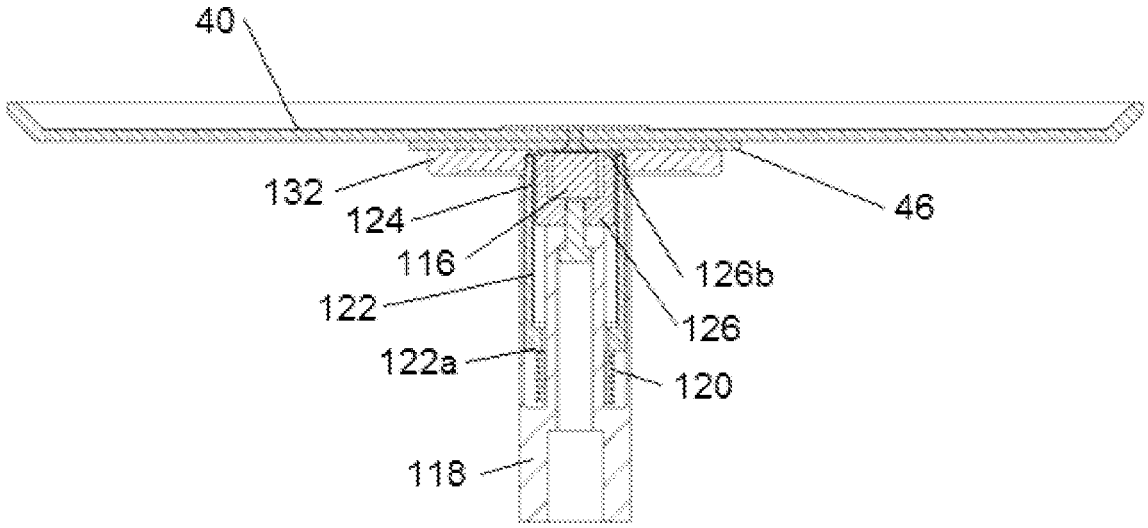
FIG. 12B is a side cross-sectional view of the handle and serving tray of FIG. 12A taken along line G-G.

To initiate a coupling of the handle 110 to a ferromagnetic surface, for example of a tray such as tray 40 (see FIGS. 12A and 12B), the user grasps the handle body 118 and presses the movable support platform 132 against the intended object. Notably, the support platform 132 and the tube 122 are spring biased by a spring 120 toward the first state. In the first state, the support platform 132 is separated from the magnet 116. Upon a movement to the second state via the pressing movement discussed above, the support platform 132 and the tube 122 compress the spring 120 until the magnetic field is in the proximity of the ferromagnetic material of a tray (e.g., the receiver plate 46). As shown in FIGS. 12A and 12B, the external step 126*b* of the magnet housing 126 contacts the protective cover 130 to transmit an approximating force through the support platform 132 to the tray 40. In this regard, when moved to the second state, the handle 110 is configured to be magnetically coupled to the tray 40.

As shown in FIG. 11B, the handle 110 includes an axis-symmetric shape to enable independent rotational motion of the handle 110 relative to the tube 122 and support platform 132. In particular, the tray 40 is selectively rotatable about a central axis of the handle body 118. In order to remove the handle 110 from the tray 40, the user slides the handle 110 in a transverse direction until the magnet 116 is beyond the ferromagnetic material of the tray to decouple the handle 110 from the tray 40. Alternately, the user could apply a force at the proximal end of the handle body 118 in order to use mechanical advantage to release the handle 110 from the tray 40. Once removed from the tray 40, the spring 120 pushes the tube 122 and support member 132 away from the magnet 116 until the flange 122*a* of the tube 122 contacts the bottom surface of the magnet housing 126. The spring 120 bias maintains separation between the magnet 116 and adjacent objects when the handle 110 is in the first state. The ferromagnetic collar 124 redirects the magnetic field within the handle so that magnetic coupling is controlled to an intended direction.

Figure 13A:
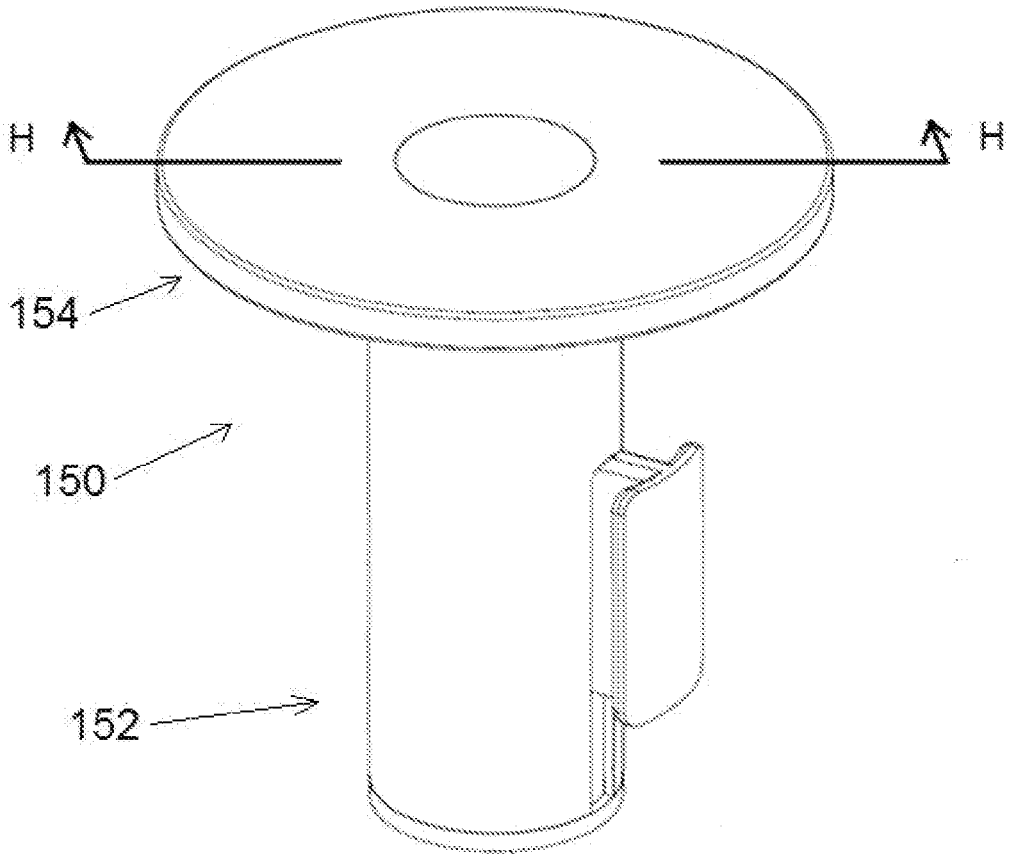
FIG. 13A is a perspective view of another embodiment of a serving tray handle shown in a first state.
Figure 13B:
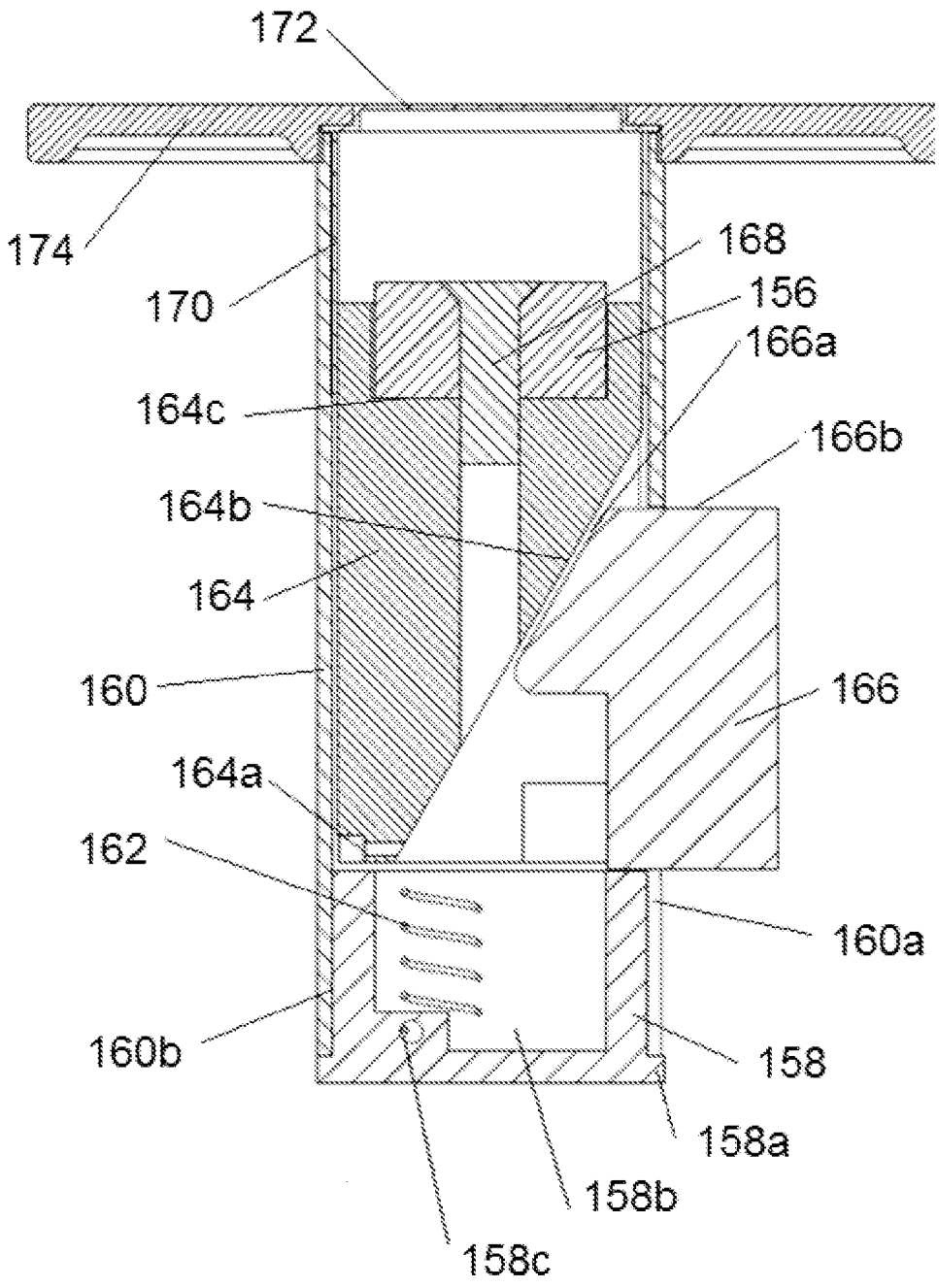
FIG. 13B is a side cross-sectional view of the handle of FIG. 13A taken along line H-H.
Figure 14:
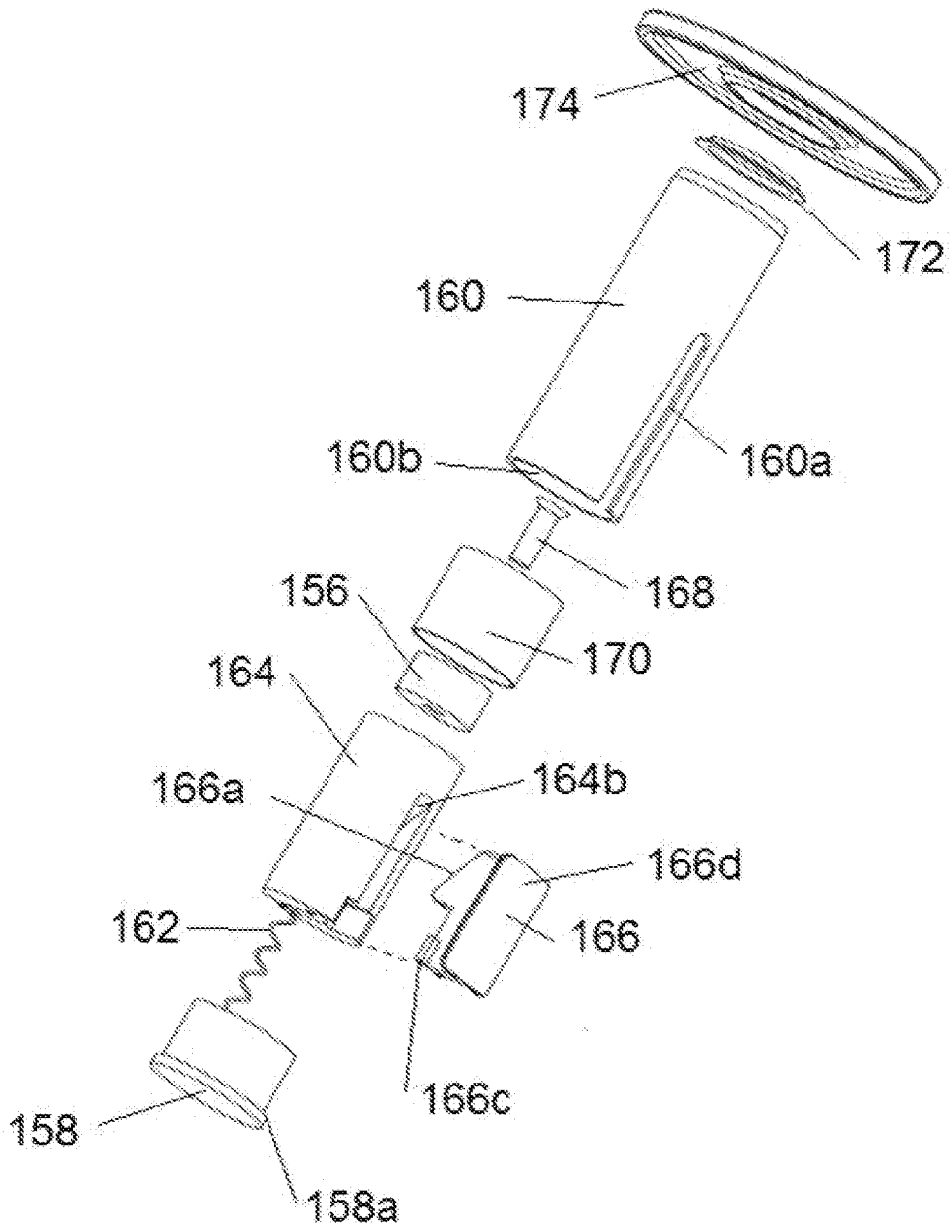
FIG. 14 is a perspective view, with parts separated, of the serving tray handle shown in FIG. 13A.

Referring to FIGS. 13A, 13B, and 14, another embodiment of a serving tray handle 150 is shown in a first state. The handle 150 includes a holding end portion 152, a coupling end portion 154, and at least one magnet 156. The holding end portion 152 includes an end cap 158 with a flange 158*a* on a proximal end portion and defines an inner cavity 158*b*. The flange 158*a* receives a handle body 160. The inner cavity 158*b* includes a penetration 158*c*. The handle body 160 defines a slot 160*a* in an outer surface thereof and an inner bore 160*b*. An extension spring 162 is captured at the proximal end by penetration 158*c* and at the distal end by a magnet housing 164 at a penetration 164*a*. The magnet housing 164 defines an internal inclined groove 164*b* which is slidably connected to a button 166 configured to fit within the slot 160*a* of the handle body 160. The button 166 includes a body having an angled plane 166*a*, a strut 166*b* extending from the angled plane 166*a*, a pair of protrusions 166*c* on opposite side surfaces of the body, and an external surface 166*d* configured for engagement by a user. The button 166 is supported within the handle body slot 160*a* by the end cap 158 by any suitable fastening arrangement such as adhesive, welding, threading, friction fit, snap-fit, or the like.

Referring to FIGS. 13B and 14, the magnet housing 164 is configured to fit within the bore defined by the handle body 160*b*. A counter bored hole defined through the magnet housing 164 includes a pocket 164*c* for receiving a magnet 156 and a fastener 168. The pocket 164*c* depth is such that the magnet 156 protrudes above the top surface of the magnet housing 164. A ferromagnetic sleeve 170 is supported in the upper portion of the handle bore 160*b* with any suitable fastening arrangement such as adhesive, threading, friction fit, snap-fit, or the like.

The coupling end portion 154 includes a cover 172 that protects the internal components of the handle 150 and is supported by a support platform 174. As shown in FIG. 13A and FIG. 14, the support platform 174 defines a stepped bore for receiving the cover 172 in a distal end portion of the support platform 174 and the handle body 160 in a proximal end portion of the support platform 174. The cover 172 has a stepped diameter to mount flush or substantially flush with the distal surface of the support platform 174. The steps in the support platform 174 and the cover 172 are configured to receive the step formed by the magnet housing 164 and the magnet 156 when assembled. The handle body 160 is secured to the proximal bore of the support platform 174 with any suitable fastening arrangement such as adhesive, welding, threading, friction fit, snap-fit, or the like to thereby secure the cover 172 to the handle body 160.

Figure 15A:
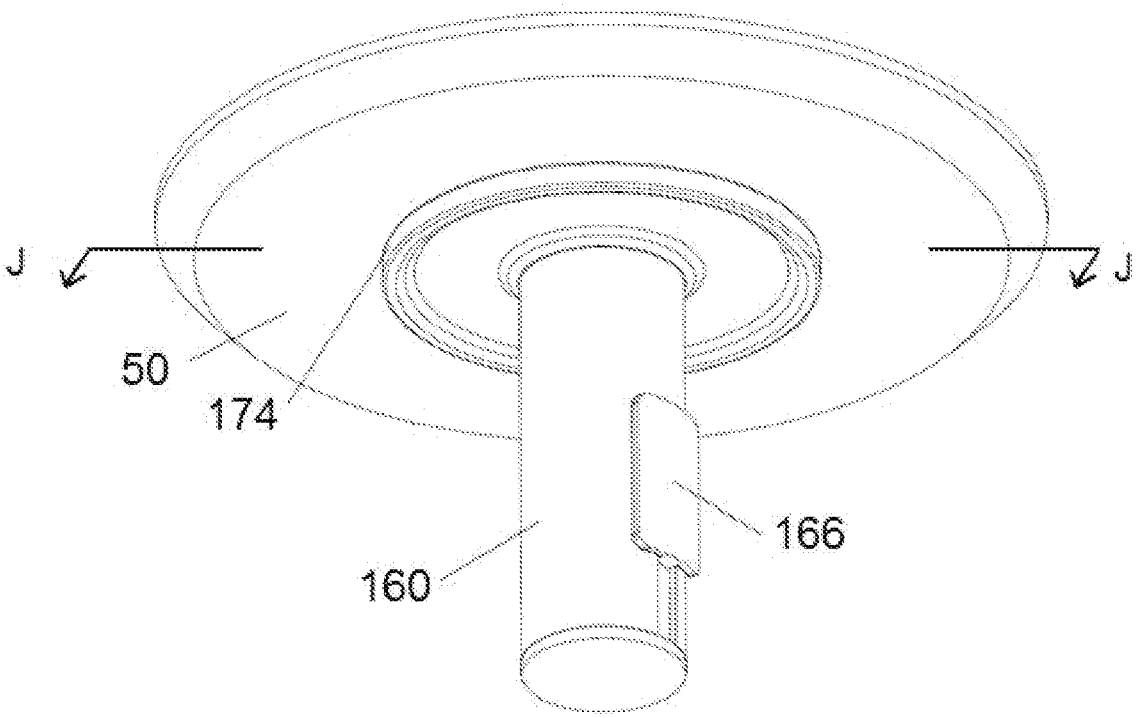
FIG. 15A is a bottom perspective view of the tray handle of FIG. 13A with the serving tray handle shown secured to the serving tray shown in FIGS. 8A and 8B.
Figure 15B:
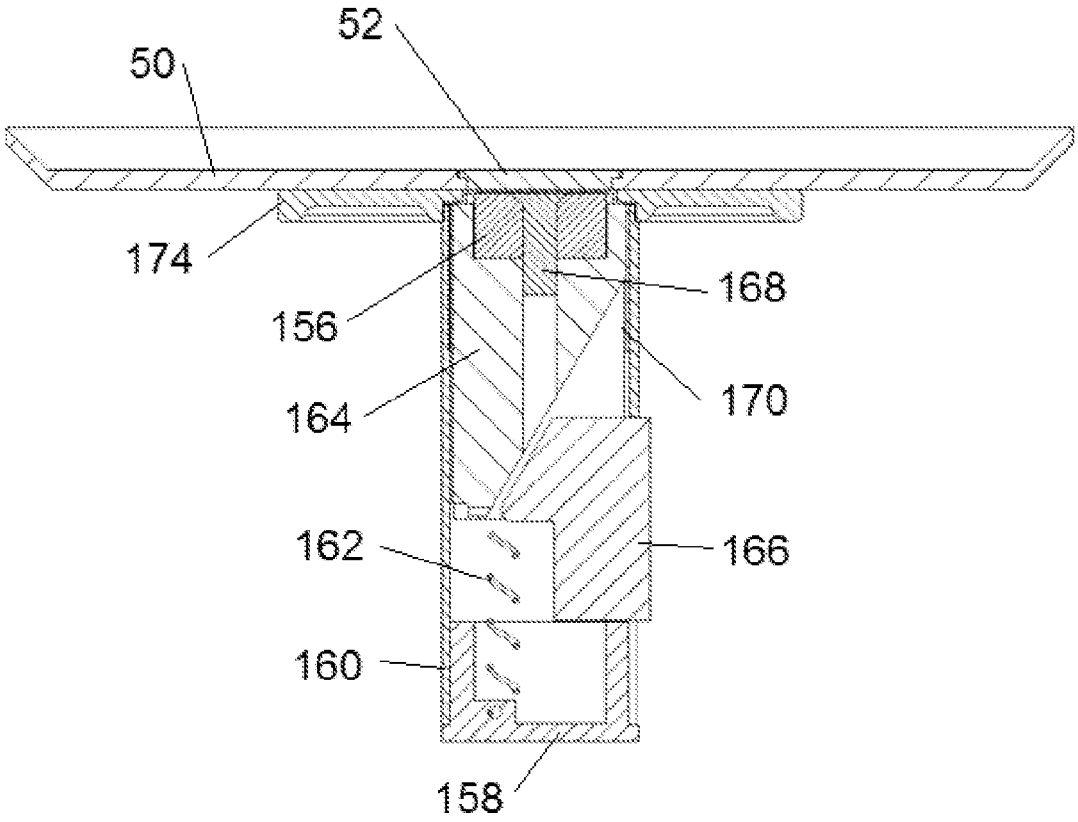
FIG. 15B is a side cross-sectional view of FIG. 15A taken along line J-J.

To position the handle 150 from a first state to a second state, the user transmits a horizontal force to the external surface of the button 166*d* which imparts vertical motion to the movable magnet housing 164 and the magnet 156. Once the magnet 156 is within a distance at which the magnetic pull force overcomes the weight of the magnet 156 and the retracting force of the extension spring 162, the magnet 156 is pulled into contact with the cover 172 and the support platform 174 to thereby couple the handle 150 to the ferromagnetic insert 52 of the serving tray 50. FIG. 15A and FIG. 15B show the handle 150 magnetically coupled to a serving tray 50. To decouple the handle 150 from the tray 50, the user slides the handle 150 away from the ferromagnetic material 52 in a transverse direction to decouple the magnet 156 from the tray 50. When the handle 150 is removed from the tray 50 and the button 166 is released, the extension spring 162 retracts the magnet housing 164 and the magnet 156 to the lower position within the handle body 160 and the ferromagnetic sleeve 170. By returning the magnet 156 to a proximal location, the magnetic force of the handle 150 is selectively adjustable between a first state and a second state, with the second state preventing unintentional coupling of the handle 150 to adjacent ferromagnetic objects.

Figure 16:
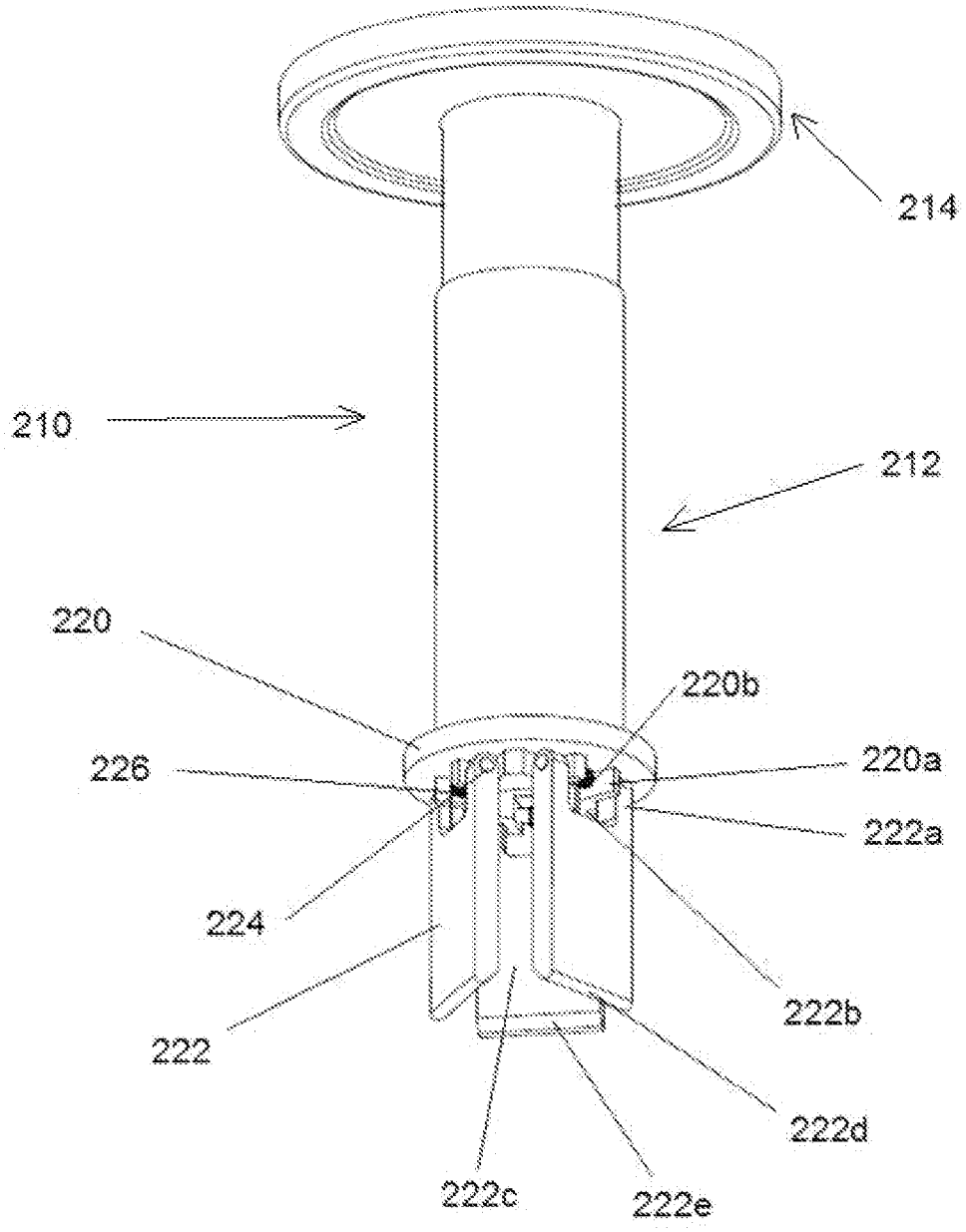
FIG. 16 is a perspective view of another embodiment of a serving tray handle shown in a first state.
Figure 17A:
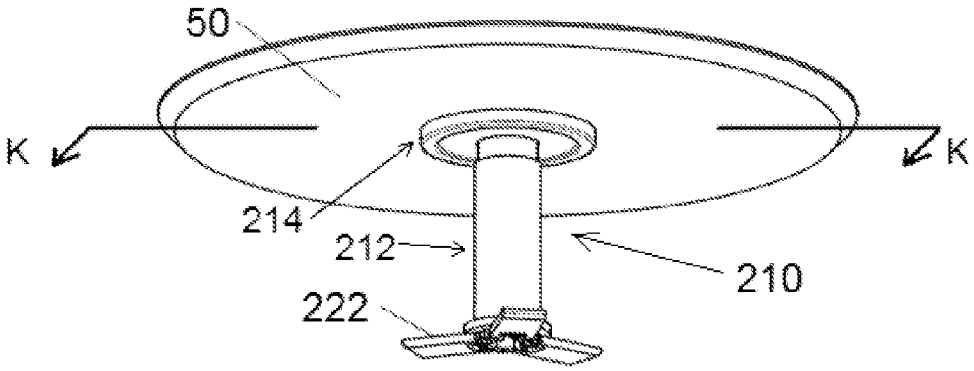
FIG. 17A is a bottom perspective view of a serving tray system with the serving tray handle of FIG. 16 shown secured to the serving tray shown in FIGS. 8A and 8B.
Figure 17B:
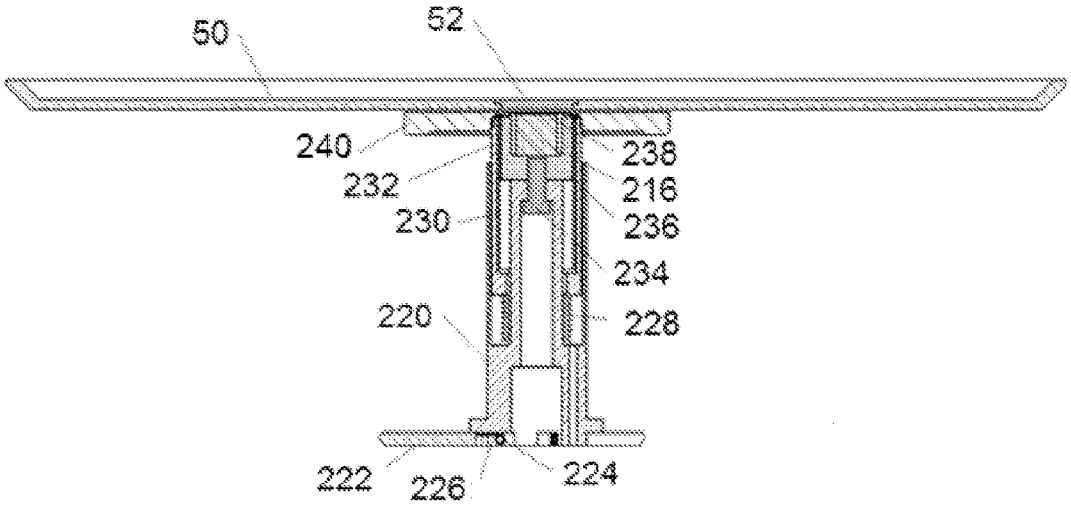
FIG. 17B is a side cross-sectional view of the serving tray system of FIG. 17A taken along line K-K.

Referring to FIGS. 16, 17A, and 17B, another embodiment of a handle 210 includes a holding portion 212, a coupling portion 214, and at least one magnet 216. The handle 210 is configured to enable a tray 50 to be set down on a surface while the handle 210 remains magnetically coupled to the serving tray 50 as discussed in greater detail below. Many of the components of this embodiment are similar to the embodiment of handle 110 shown in FIGS. 11A through 12B.

The holding portion 212 includes a handle body 220 with a flange at a proximal end. FIG. 16 shows the handle 210 in the first state. Referring also to FIG. 16, the handle body 220 includes a plurality of projections 220*a*. Each projection 220*a* defines a hole 220*b*. The projections 220*a* are positioned at spaced locations around a proximal flange of the handle body 220. A plurality of support legs 222 are pivotably mounted to the projections 220*a* by pins 224 having one or more torsion springs 226 mounted thereon. Each support leg 222 includes a plurality of teeth 222*a* that extend from the support arm 222. The plurality of teeth 222*a* defines a passage 222*b* within each support leg 222 therethrough configured to receive the flange projections 220*a*. Each support leg 222 has an inner surface 222*c*, an outer surface 222*d*, and an intermediate surface 222*e* positioned between the inner surface 222*c* and the outer surface 222*d* on the respective support leg 222.

Each end of the pin 224 is configured to extend through the adjacent projections 220*a* and teeth 222*a* of arms 222 such that the opposite ends of each pin 224 are secured to the support legs 222 through mechanical means such as, threading, friction-fit, or the like. Referring to FIG. 17B, the remaining components of handle 210, namely 228, 230, 234, 236, 238, and 240 are as detailed in the embodiment of handle 110.

FIG. 17A shows a bottom perspective view of the handle magnetically coupled to the serving tray 50 with the lower support legs 222 rotated to a horizontal orientation. The process of coupling the portable handle 210 to the serving tray 50 is consistent with the methods discussed above with regard to the handle embodiment 110 shown in FIGS. 11A through 12B. When the handle 210 is coupled to the serving tray 50, the user can place the handle 210 onto a resting surface (e.g., a table) such that the handle 210 is configured to independently support the serving tray 50 on the resting surface when the user releases the handle 210. More particularly, when positioned on a resting surface, the pivotable lower support legs 222 rotate to the extended orientation in response to the vertical forces acting on the lower support legs 222. As shown in FIG. 17B, the extended support legs 222 provide stability to the handle 210 allowing the user to set the tray 50 down without decoupling the handle 210.

Figure 18A:
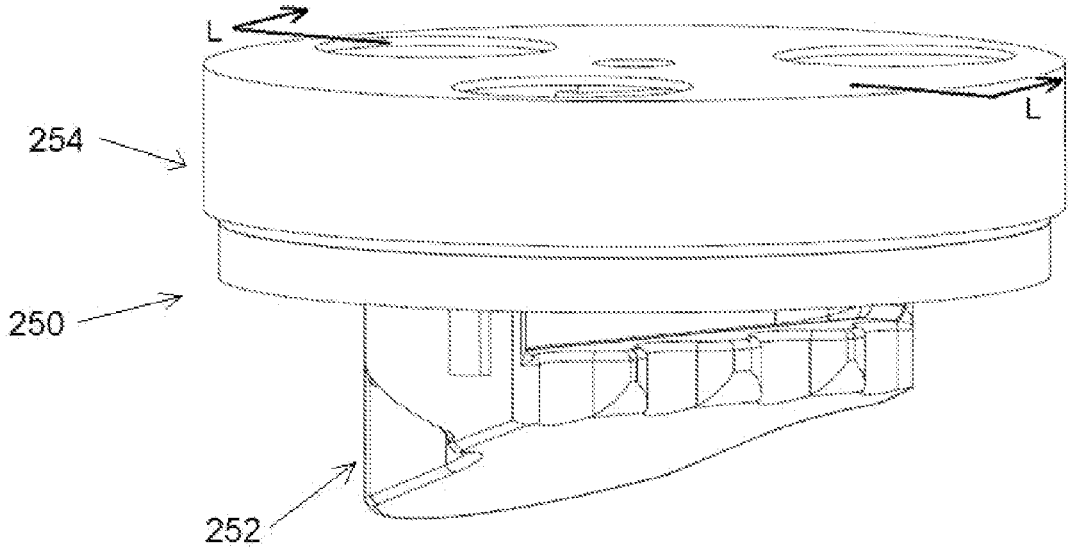
FIG. 18A is a perspective view of another embodiment of a serving tray handle in a first state.
Figure 18B:
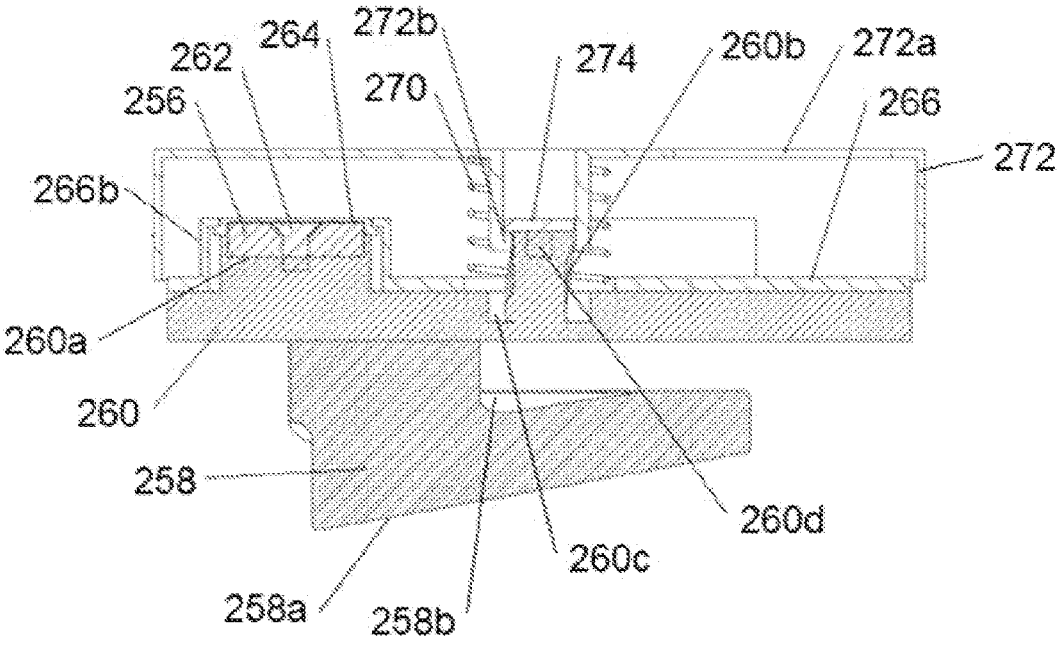
FIG. 18B is a side cross-sectional view of the embodiment of FIG. 18A taken along line L-L.
Figure 19:
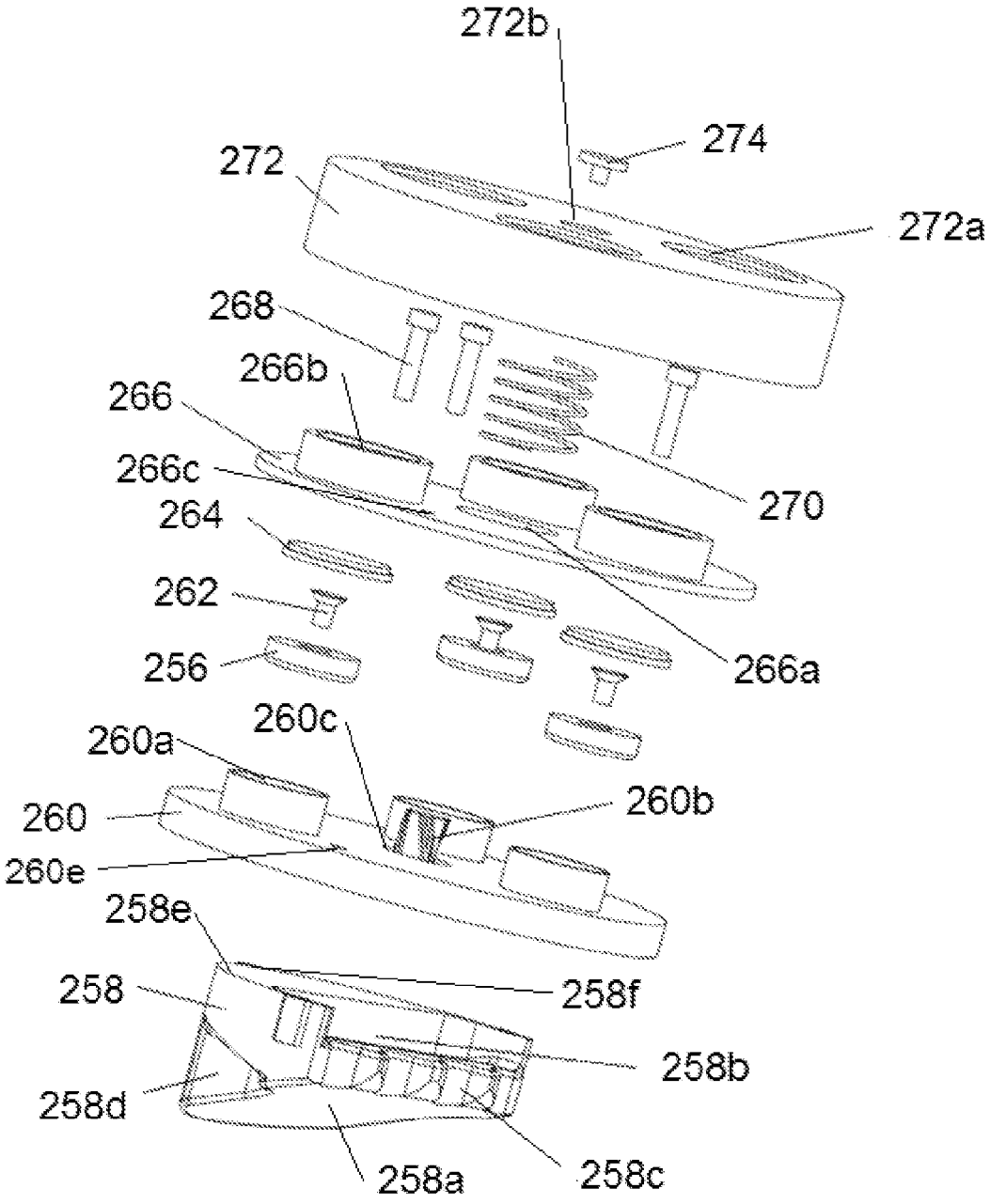
FIG. 19 is a perspective view, with parts separated, of the serving tray handle shown in FIG. 18A.

Referring to FIGS. 18A, 18B, and 19, in one embodiment, a handle 250 includes a holding end portion 252, a coupling end portion 254, and includes at least one magnet 256. The holding end portion 252 includes a handle body 258 which defines a bottom plane 258*a* and an internal cavity 258*b*. A plurality of gripping features 258*c* is included between the bottom plane 258*a* and the internal cavity 258*b*. External cavities 258*d* are included on opposing sides of the handle body 258 to accommodate the user's thumb. The top plane 258*e* of the handle body defines a plurality of fastener holes 258*f*.

The coupling end portion 254 includes a base plate 260 with an array of equally spaced protrusions defining pockets 260*a* for receiving magnets 256 and fasteners 262. The base plate 260 has a central shaft with an external helical spline 260*b* surrounded by a pocket 260*c*. The base plate central shaft defines a hole 260*d* for receiving a fastener as well as an array of fastener holes 260*e* for fastening to the handle body 258. A plurality of flanged covers 264 corresponding to the number of magnets 256 are secured above the magnets 256 by the restraint plate 266. Referring to FIG. 19, the restraint plate 266 defines a planar member with a central aperture 266*a* and an array of counter bore pockets 266*b* which support the covers 264. The restraint plate 266 is fastened through the base plate 260 to the handle body 258 through fastener holes 266*c*, 260*e*, and 258*f* by fasteners 268 to secure the restraint plate 266, the base plate 260, and the handle body 258.

Referring to FIGS. 18B and 19, a compression spring 270 is secured around the central shaft of the base plate 260 by a spacer 272. The spacer 272 includes a planar surface with a central bored shaft having teeth 272*b* for coupling with the base plate spline 260*b*. An array of holes 272*a* corresponding to the number of magnets 256 are included in the planar surface of the spacer 272. The spacer 272 has sidewalls extending proximally from the planar surface of the spacer 272. The screw 274 is received in base plate hole 260*d* and restrains spacer 272 against spring 270.

Figure 20A:
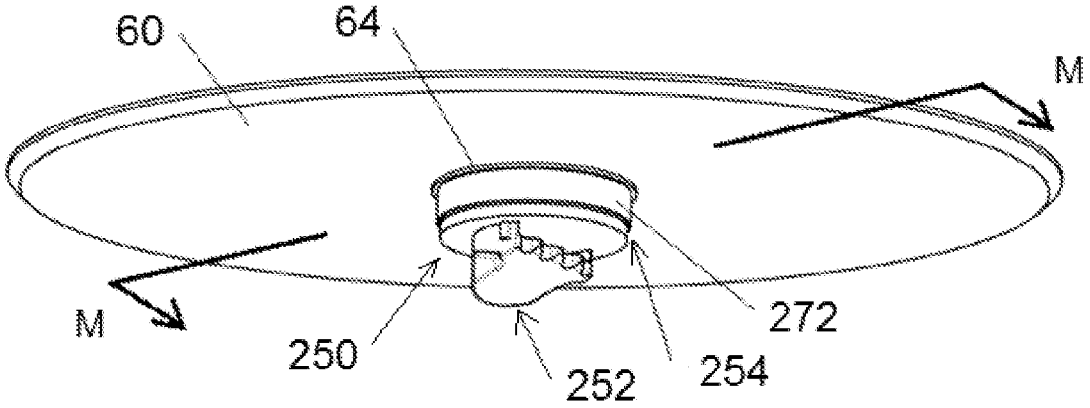
FIG. 20A is a bottom perspective view of a serving tray system with the serving tray handle of FIG. 18A shown secured to the serving tray shown in FIG. 10A.
Figure 20B:
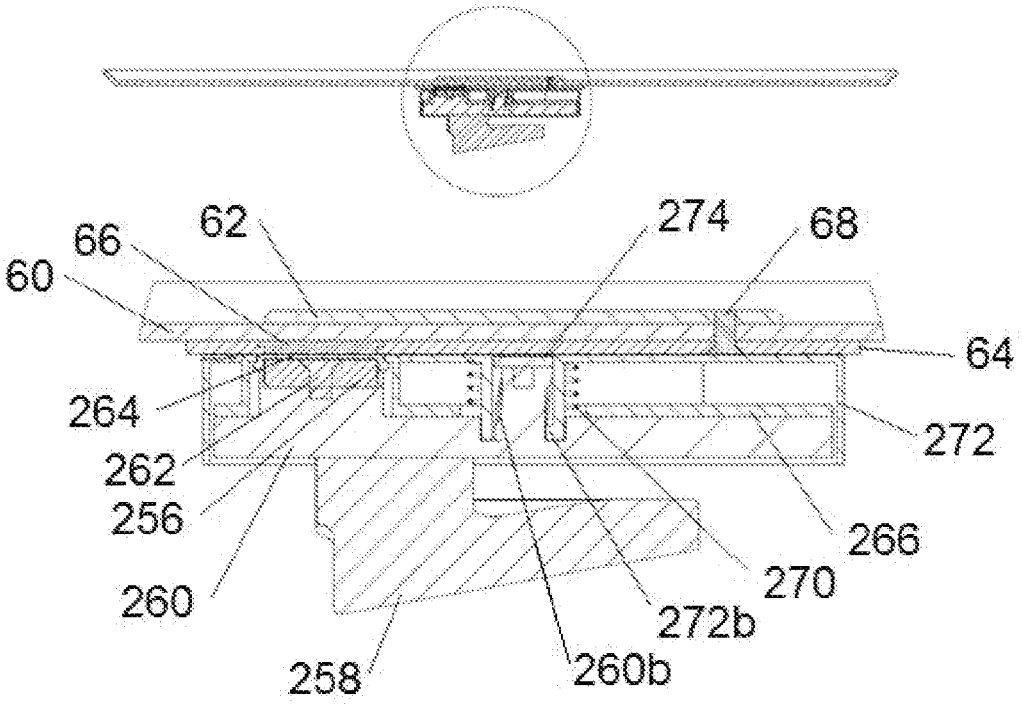
FIG. 20B a side cross-sectional view of the serving tray system of FIG. 20A taken along line M-M and an enlarged side cross-sectional view of the indicated area of detail.

To operate the embodiment shown in FIGS. 18A through 20B, the user grasps the handle body 258. Cavities 258*b* and 258*d* allow placement of the fingers and thumb respectively to provide a secure grip while the users palm supports the face 258*a*. With the handle 250 in the first state, the user presses the top surface of the spacer 272 against the receiver plate 64 of the serving tray 60 in the independent serving tray embodiment shown separately in FIGS. 9, 10A, 10B. As appreciated, any of the presently disclosed serving trays may be utilized. As the spacer 272 is depressed, the vertical motion of the spacer 272 is translated to a rotational motion. This helical motion rotates the spacer 272 so that in the second state, the magnets 256 are exposed through apertures 272*a* in the spacer 272 as shown in FIG. 20A and FIG. 20B. To release the handle 250 from the tray 60, the user slides the handle 250 away from the receiver plate 64 in a transverse direction. The user can also release the handle 250 by generating a torque by rotating the handle 250 about the longitudinal axis of the handle base plate 260 until the magnets 256 are no longer aligned to the inserts 66 on the tray 60. With the handle 250 removed from the tray 60, the spacer 272 is spring biased by the spring 270 to the distal position with apertures 272*a* rotationally offset from the magnets 256.

Figure 21A:
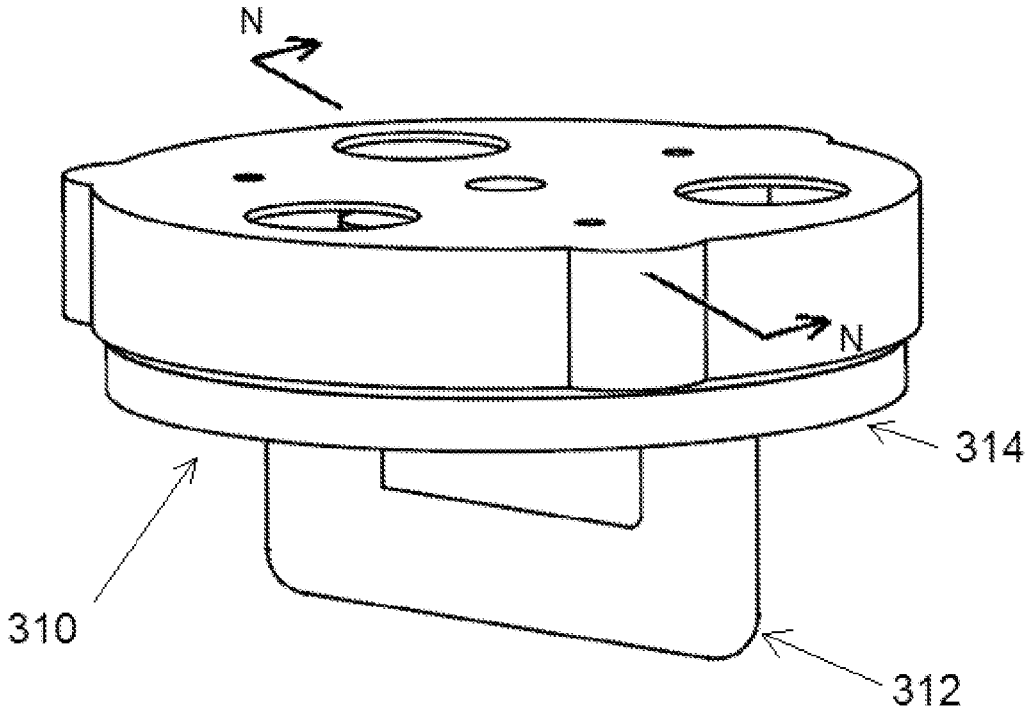
FIG. 21A is a perspective view of another embodiment of a serving tray handle in a first state.
Figure 21B:
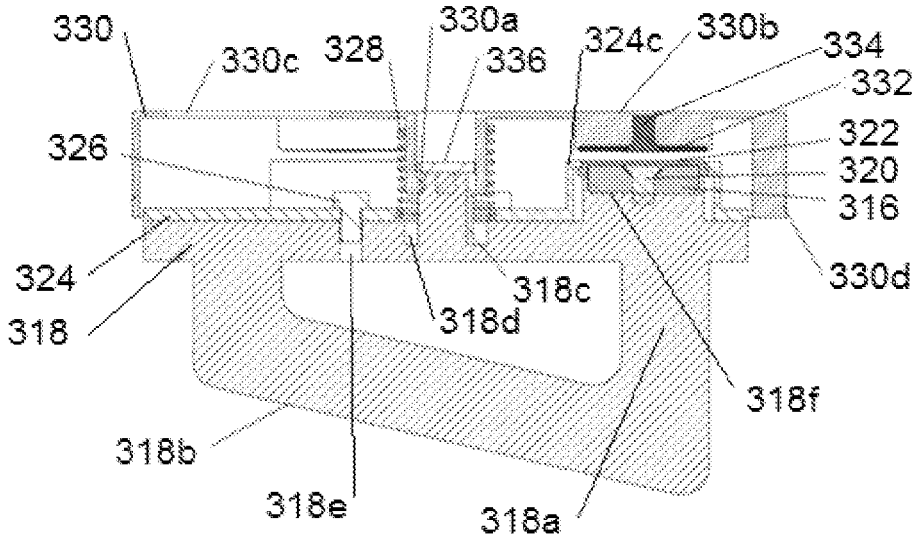
FIG. 21B is a side cross-sectional view of the embodiment of FIG. 21A taken along line N-N.
Figure 22:
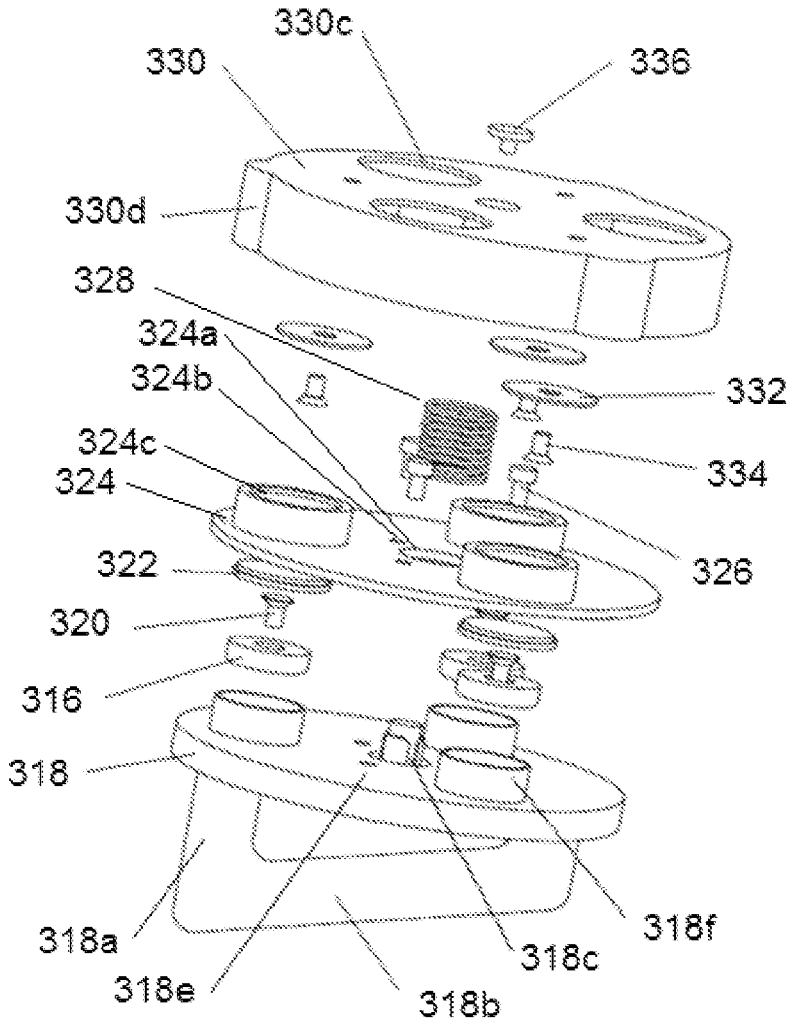
FIG. 22 is a perspective view, with parts separated, of the serving tray handle shown in FIG. 21A.

Still another embodiment of a handle 310 is shown in FIG. 21A through FIG. 23B. Referring initially to FIGS. 21A and 21B, the handle 310 is shown in a first state with the handle 310 including a holding end portion 312, a coupling end portion 314, and at least one magnet 316. The holding end portion 312 includes a handle body 318 that has a pair of proximal posts 318*a* connected by a gripping feature 318*b* and a distal planar support surface. The coupling end portion 314 includes a central shaft 318*c* which has a plurality of longitudinal grooves equally spaced around the circumference of the shaft 318*c*. The planar support member defines a pocket 318*d* around the base of the shaft 318*c*. The planar support member of handle body 318 also defines a plurality of fastener holes 318*e* and includes an array of bosses that define cavities 318*f* for receiving magnets 316 and screws 320. A plurality of flanged covers 322 corresponding to the number of the magnets 316 are secured above the magnets 316 by the restraint plate 324. Referring also to FIG. 22, the restraint plate 324 defines a planar member with a central aperture 324*a*, an array of fastener holes 324*b*, and an array of bored pockets 324*c*, which secure the covers 322. Restraint plate 324 is fastened to the handle body 318 through fastener holes 324*b* and 318*e* to secure the restraint plate 324, covers 322, and handle body 318.

Referring to FIGS. 21B and 22, a compression spring 328 is secured into the base plate pocket 318*d* by a spacer 330. The spacer 330 includes a planar surface with a center bored shaft including teeth 330*a* for coupling with base plate grooves 318*c*. An array of holes 330*c* corresponding to the number of magnets 316 are included in the planar surface of the spacer 330. A plurality of bosses 330*b* extends proximally from the planar surface of spacer 330. Ferromagnetic inserts 332 are secured to the spacer bosses 330*b* by screws 334. The spacer 330 has sidewalls extending proximally from the planar surface of the spacer 330. Referring to FIG. 22, a plurality of radial protrusions 330*d* extend distally from the spacer 330. Screw 336 secures spacer 330 to the body 318 against the bias of the compression spring 328.

Figure 23A:
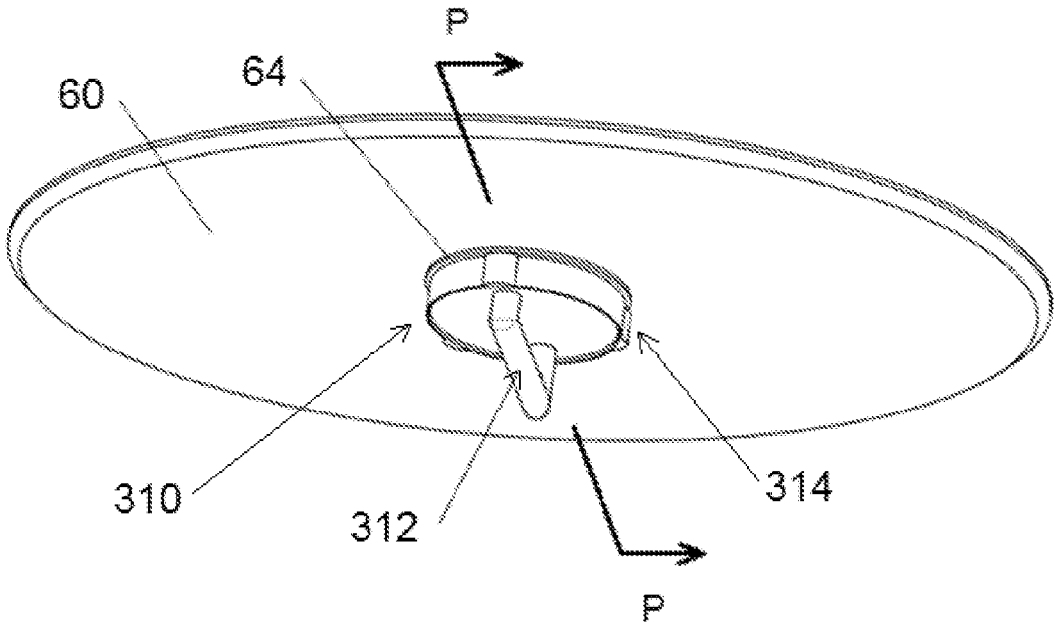
FIG. 23A is a bottom perspective view of a serving tray system with the serving tray handle of FIG. 21A shown secured to the serving tray shown in FIG. 10A.
Figure 23B:
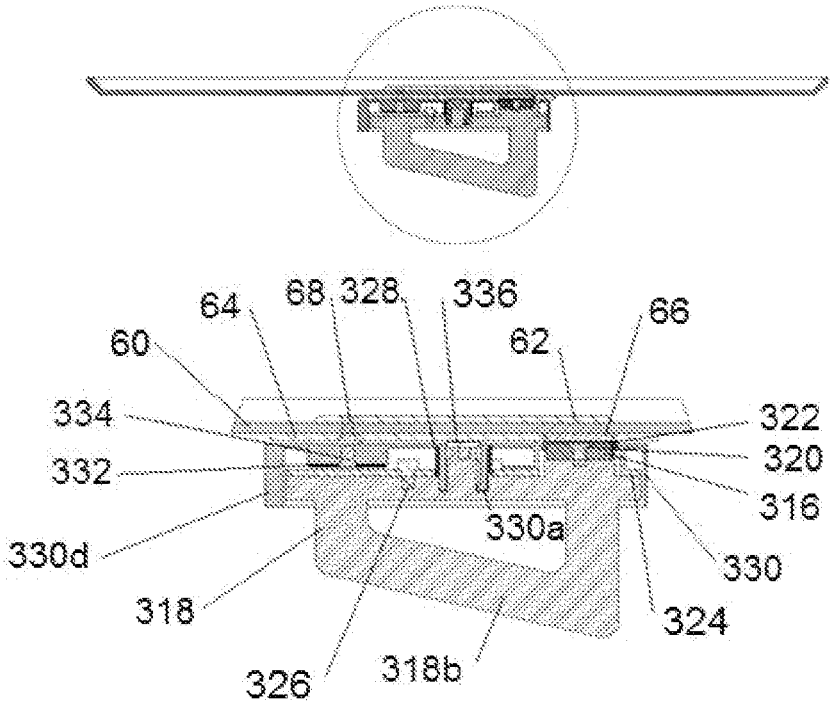
FIG. 23B is a side cross-sectional view of the serving tray system of FIG. 23A taken along line P-P and an enlarged side cross-sectional view of the indicated area of detail.

Handle 310 includes ON/OFF capability. In the first state shown in FIG. 21A and FIG. 21B, the spacer 330 is aligned so that the ferromagnetic inserts 332 are aligned axially with the magnets 316. When the ferromagnetic inserts 332 are positioned in alignment with the magnets 316, the magnetic field is directed through the inserts 332 limiting the magnetic field beyond the handle. To transition the handle 310 from a first state (OFF) to a second state (ON), the user grasps the handle body 318 and the spacer protrusions 330*d* to rotate the spacer 330 relative to the handle body 318. With the spacer 330 rotated to the second state, the spring 328 maintains a bias on the spacer 330 to maintain separation from the magnets 316. In the ON position, the teeth 330*a* and the grooves 318*c* are positioned in alignment to allow the spacer 330 to be moved vertically (e.g., axially) to expose the magnets 316. Referring also to FIG. 23A and FIG. 23B, the user can press the spacer 330 against the underside of the serving tray 60 to magnetically couple the magnets 316 to the ferromagnetic inserts 66. Upon removal of the handle 310 from the ferromagnetic inserts 66 of the independent serving tray 60, the spacer 330 is biased away from the magnets 316 by the spring 328. When the spacer 330 is rotated back to the first state (OFF), the protrusions 330*a* and the grooves 318*c* are positioned out of alignment and prevent vertical (e.g., axial) motion of the spacer 330.

Referring to FIGS. 24A, 24B, 24C and 25, a handle 350 has a holding end portion 352, a coupling end portion 354, and at least one magnet 356. As the pull force of the magnet 356 used in the serving tray handle 350 increases, the force to decouple the handle 350 from the tray (not shown) increases. To increase the magnetic coupling of a handle 350 to a tray (not shown), an alternate method to release the handle 350 from the tray (not shown) is advantageous. Various well known methods for controlling a magnetic field exist in prior art including U.S. Pat. Nos. 4,314,219, 4,329,673, and 7,012,495 among others, each of which are incorporated herein by reference.

The holding end portion 352 defines a handle body 358 with a gripping surface 358*a* at an angle that may be horizontal or substantially horizontal with a pair of vertical sidearms 358*b* extending away from the gripping surface 358*a*. The gripping surface has at least one cavity 358*c* for receiving a spring 360. At least one sidearm 358*b* of the pair contains a boss 358*d* extending perpendicularly away from the sidearm 358*b*. The upper surface of each of the side arms 358*b* defines at least one hole 358*e* to receive a fastener.

An actuating handle 362 primarily follows the internal shape of the handle body 358. A pair of horizontal cross-members 362*a* is connected on each end by a guide arm 362*c*. The proximal boss 362*b* restrains a spring 360 within the handle pocket 358*c*. At least one guide arm 362*c* defines a vertically aligned slot 362*d* for receiving the sidearm boss 358*d*. The distal end portion of the guide arms 362*c* defines at least one horizontally oriented slot 362*e*.

Figure 25:
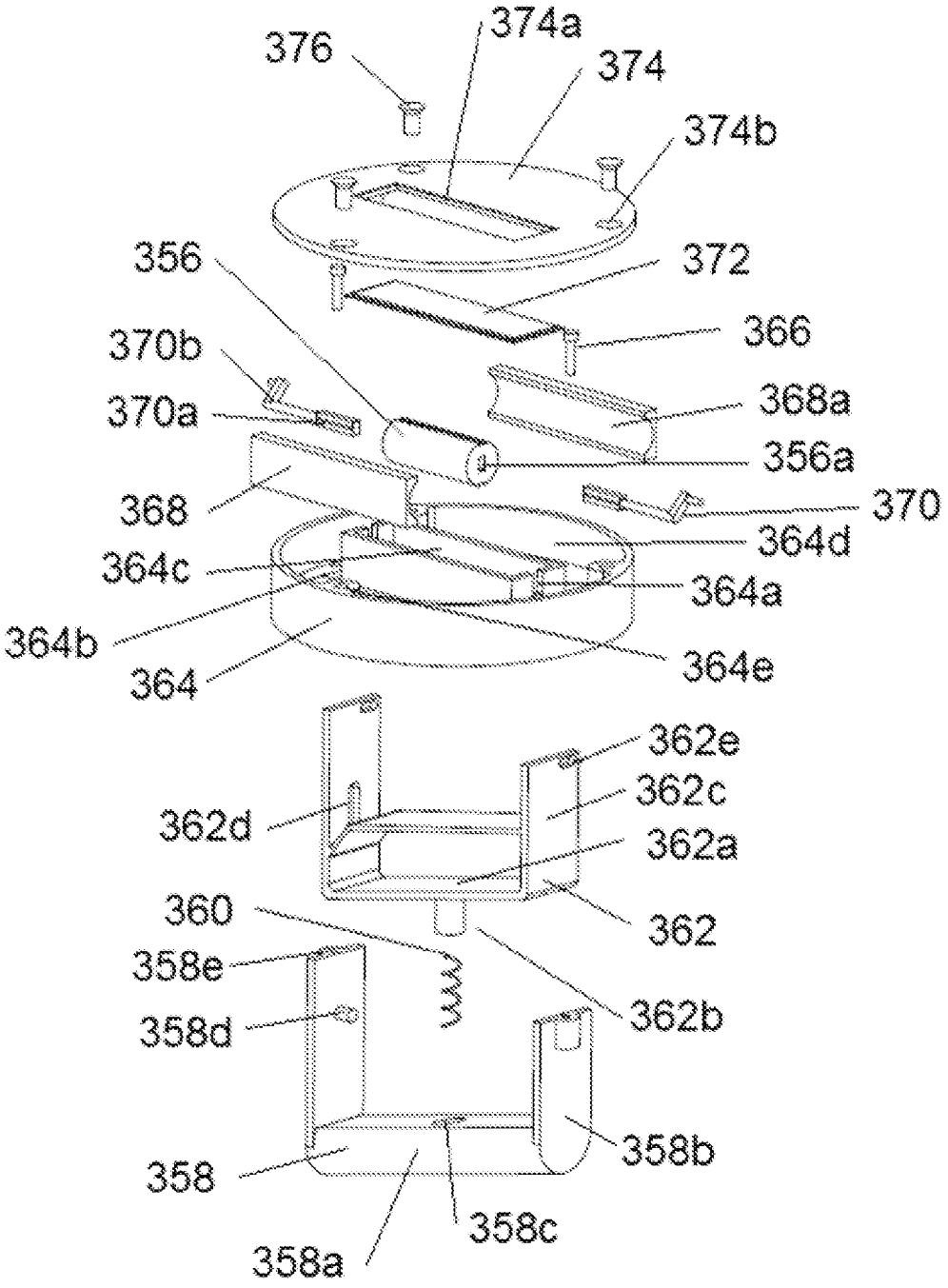
FIG. 25 is a perspective view, with parts separated, of the embodiment shown in FIG. 24A.

Referring to FIG. 25, the coupling end portion 354 includes a base plate 364 which defines a horizontal lower surface and an internal cavity 364*d*. Within cavity 364*d*, apertures 364*b* are configured to receive the guide arms 362*c* of the actuating handle 362. The cavity 364*c* is defined by a plurality of side walls with a pair of opposing sidewalls having grooves 364*a* approximately centered within the sidewalls. The grooves 364*a* are aligned with each other. The sidewalls of base plate 364 have protrusions 364*e* for receiving fasteners. The base plate 364 is secured to the body 358 by screws 366 attached to the fastener holes 358*e*.

Ferritic housings 368 are configured to fit within the cavity 364*c* while maintaining an open center bore 368*a* to receive the magnet 356. A diametral magnet 356 with a non-circular central aperture 356*a* is secured between housings 368. A pair of actuator arms 370 having a protrusion 370*a* matching the magnet aperture 356*a* at the proximal end portion, and a post 370*b* radially offset from the center axis of the actuator arm 370 at the distal end portion are inserted into the aperture 356*a* in the diametral magnet 356. The magnet 356 with actuator arms 370 is inserted into the cavity 364*c* with the distal end portion of the actuating arm 370*b* inserted through the guide arm slot 362*e*. A flanged cover 372 is secured above the magnet housings 368 by the platform 374. The platform 374 defines an aperture 374*a* configured to accommodate the cover 372. The screws 376 secure the platform 374 and the cover 372 to the base plate 364 through fastener holes 374*b* and are received by fastener holes 364*e*.

Figure 24A:
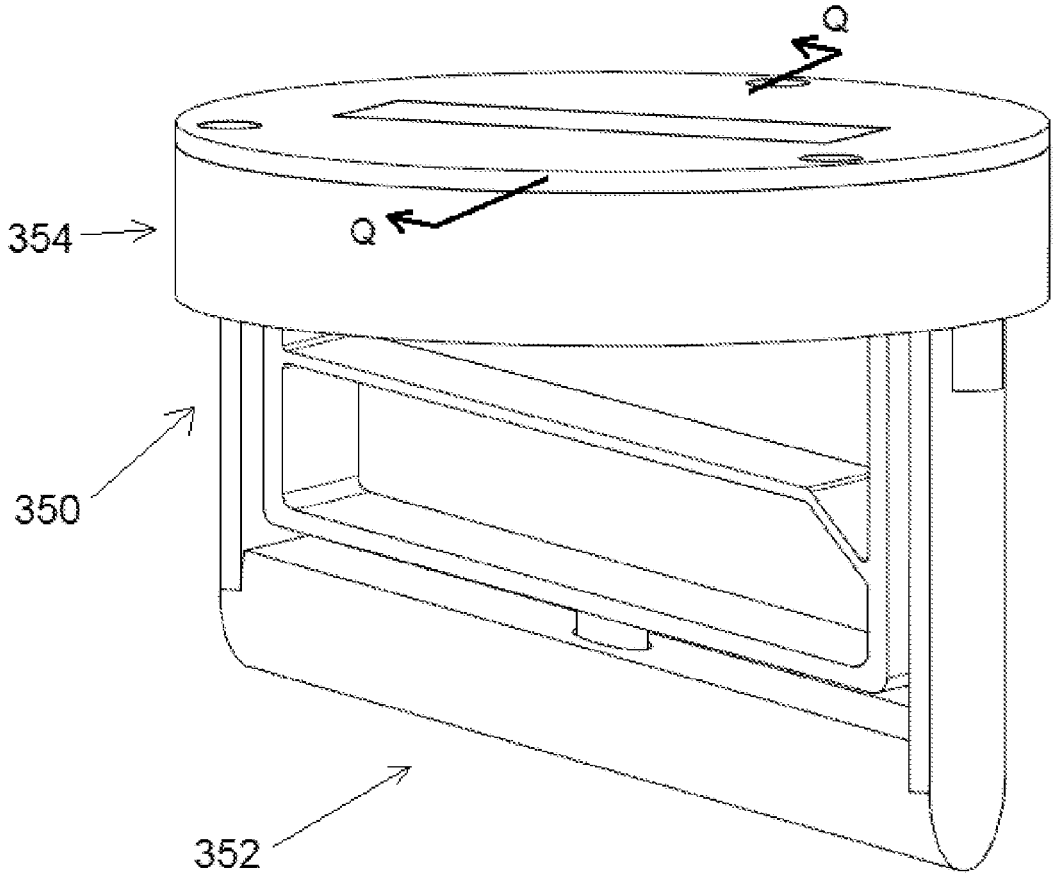
FIG. 24A is a perspective view of another embodiment of a serving tray handle in a first state.
Figure 24B:
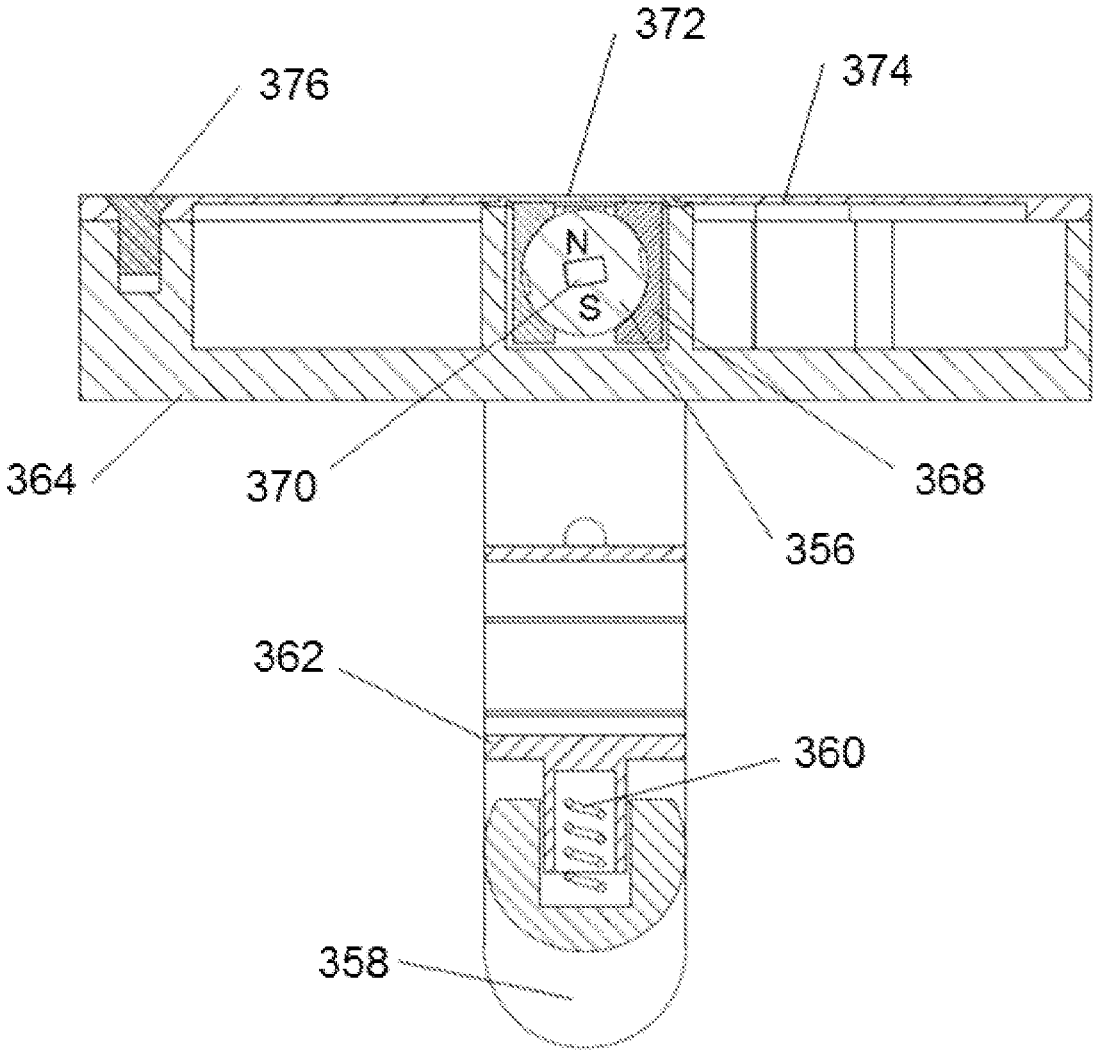
FIG. 24B is a side cross-sectional view of the embodiment of FIG. 24A taken along line Q-Q.
Figure 24C:
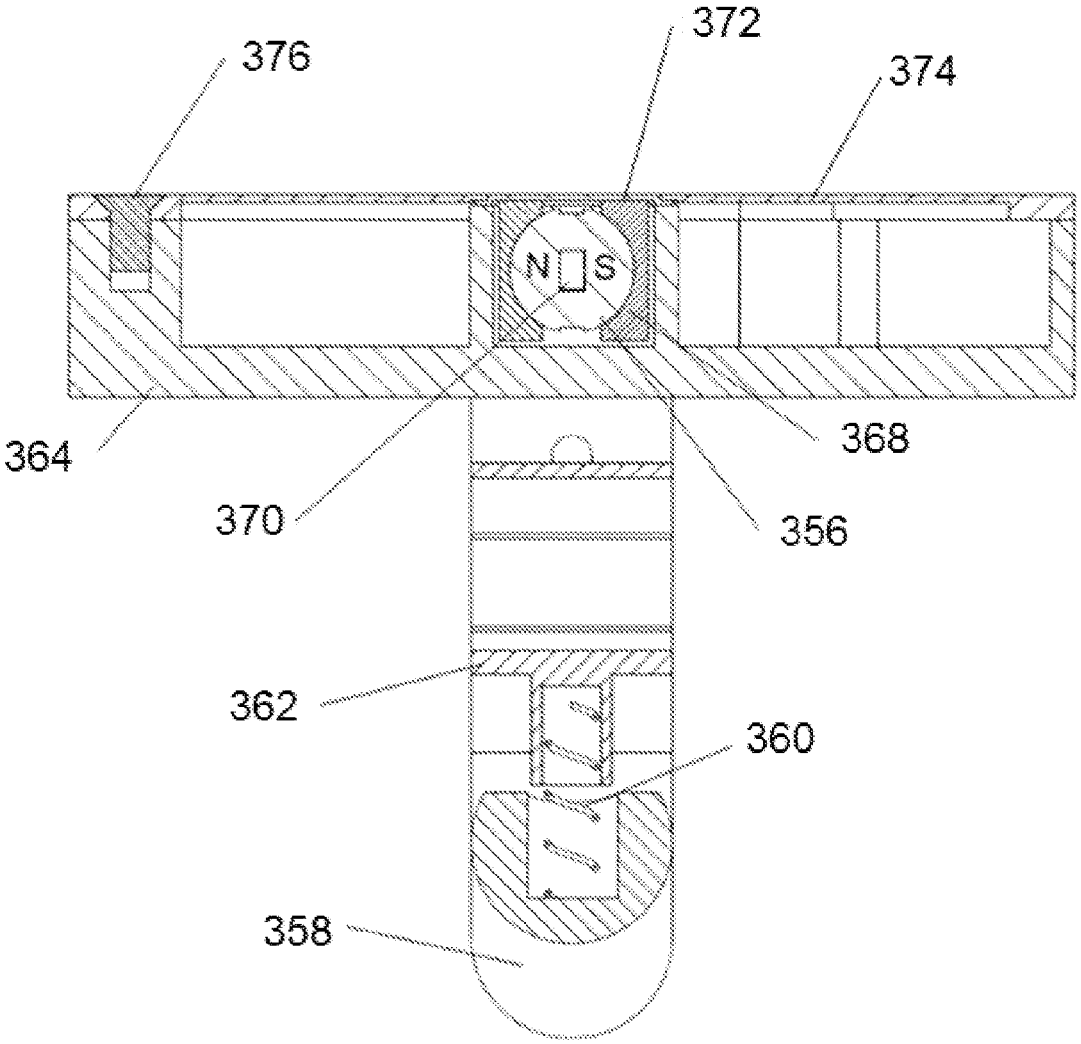
FIG. 24C is a side cross-sectional view of the embodiment of FIG. 24A in a second state along line Q-Q.

Referring to FIGS. 24A, 24B and 24C, the handle 350 is operated by gripping the actuating handle 362 at the opening 362*a*. Referring to FIG. 24A, a handle 350 with a switchable magnet 356 is shown in the first state. Referring to FIG. 24B, the magnetic poles of magnet 356 are spanning the ferritic housings 368 resulting in the first state of the handle (e.g., an OFF configuration). FIG. 24C shows the same cross-section view as 24B, with the magnetic poles of magnet 356 adjacent to the housings 368 resulting in the second state of the handle 350, (e.g., an ON configuration).

The diametral magnet 356 is rotatably controlled by the actuator arm 370 which varies the position of the magnet 356 from an orientation in which the separate poles of the magnetic field span the separate ferritic housings 368 to an orientation in which the separate poles of the magnetic field are isolated between the ferritic housings 368. To control the orientation of the diametral magnet 356 between the first state and second state, the user presses the actuating handle 362 away from the handle body 358 which translates a vertical motion through guide arms 362*c* to actuator arms 370 which creates a torque on the magnet 356 causing rotation within the plurality of housings 368. To return the magnet 356 to a shunted state (OFF), the user squeezes the actuating handle 362 against the handle body 358 which compresses the spring 360. The spring 360 is configured to aid the rotation of the magnet 356 between a first state and a second state.

Figure 26A:
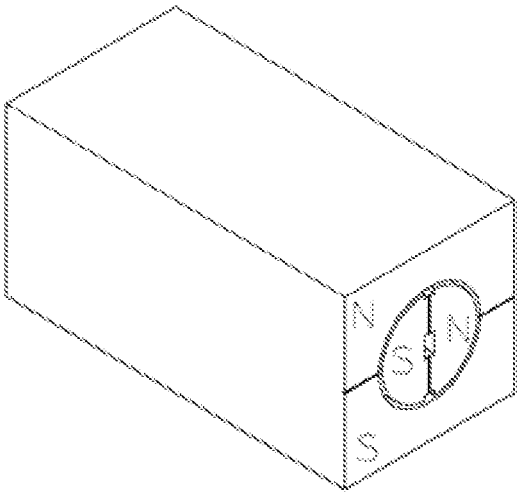
FIG. 26A PRIOR ART
FIG. 26A is a perspective view of prior art in a first state.
Figure 26B:
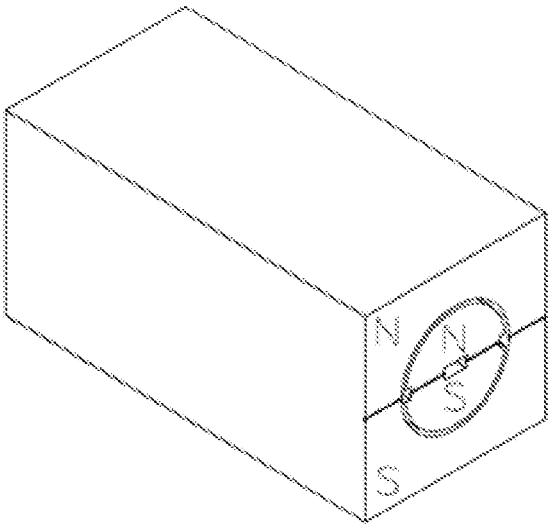
FIG. 26B is a perspective view of prior art in a second state.

An example of prior art is included in FIGS. 26A and 26B for reference. Other switchable magnet configurations are possible and shall not be limited to those shown in FIG. 24A through FIG. 26B. The ability to control the magnetic field provides the user the ability to activate the magnetic coupling of the handle 350 to the tray (not shown), and de-activate the magnetic coupling to release the handle 350 from the tray (not shown).

Figure 27:
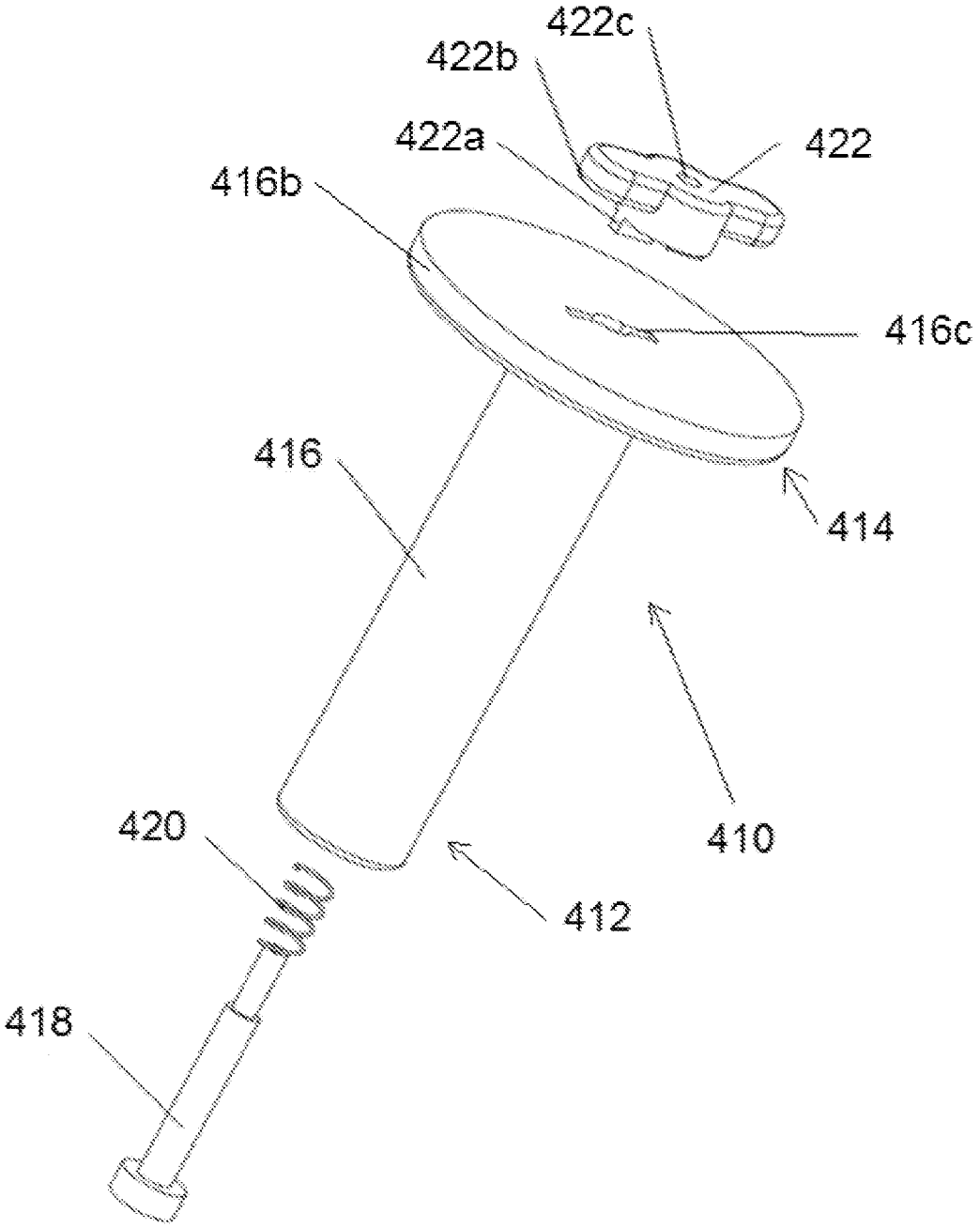
FIG. 27 is a perspective view, with parts separated, of another embodiment of a serving tray handle.
Figure 28A:
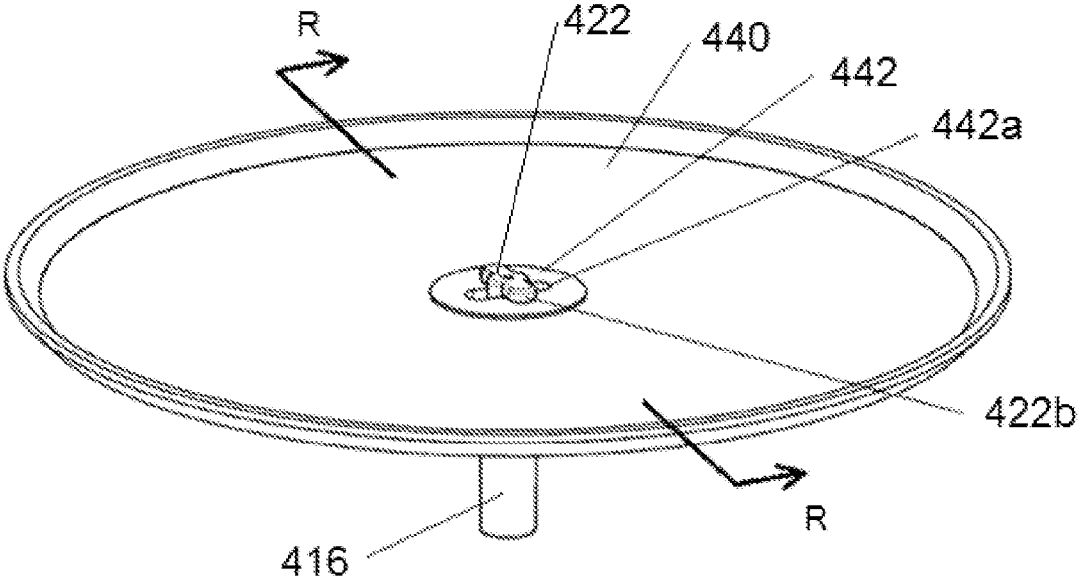
FIG. 28A is a top perspective view of the embodiment of FIG. 27 coupled with a serving tray.
Figure 28B:
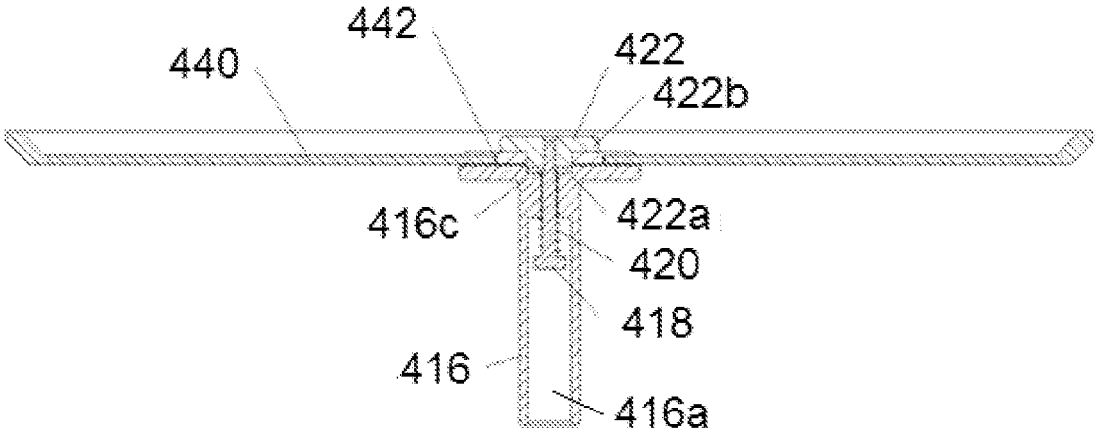
FIG. 28B is a side cross-sectional view of the serving tray system of FIG. 28A taken along line R-R.

Referring to FIGS. 27, 28A, and 28B, another embodiment of a serving tray handle includes a handle 410 with a holding end portion 412 and a coupling end portion 414. The handle 410 has a proximal holding portion defined by a body 416 with a bore 416*a*. The coupling end portion 414 includes a support platform 416*b*. The support platform 416*b* has at least two grooves 416*c* on opposing sides of the bore 416*a*.

A fastener 418 housed within the bore 416*a* secures a spring 420 and protrudes above said support platform 416*b* and is permanently attached to a flange member 422. The flange member 422 contains a key 422*a* which seats in the mating grooves 416*c* in the support platform 416*b* to restrict rotation of the flange member 422.

Referring to FIGS. 28A and 28B, the tray 440 defines a penetration configured to receive an insert 442. The insert 442 defines an aperture 442*a* configured to receive the flange member 422. The insert 442 is secured to the tray by adhesive, interference or any suitable fastening arrangement such as threading, friction fit, snap-fit, or the like.

To removably attach the handle 410 to the tray, the user vertically disposes the flange member 422 through the aperture in the tray insert 442*a* so that the support platform 416*b* contacts the lower horizontal surface of the tray 440. Once seated, the handle 410 is rotated so that the lower horizontal surfaces of the flange member 422*b* contact the upper horizontal surface of the tray insert 442. The spring 420 secured by the fastener 418 provides a coupling force between the flange member 422 and the tray 440 to accommodate variations in tray 440 thickness, offset loading on the tray 440, and other variables.

Figure 29:
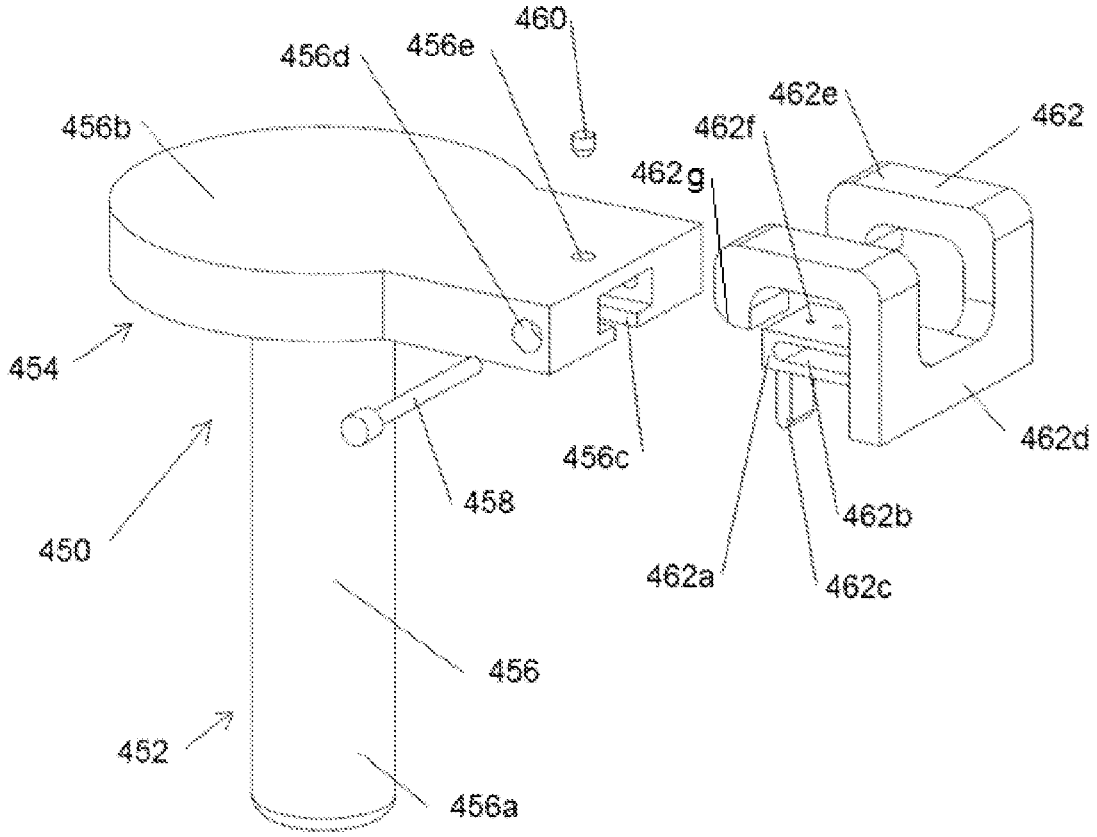
FIG. 29 is a perspective view, with parts separated, of another embodiment of a serving tray handle.
Figure 30:
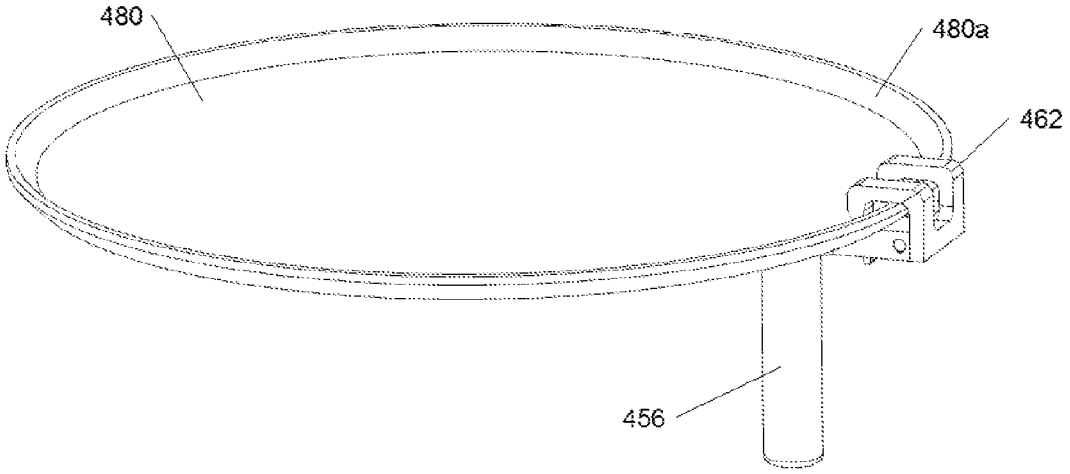
FIG. 30 is a top perspective view of the embodiment of FIG. 29 coupled with a serving tray.

Referring to FIGS. 29 and 30, a handle 450 includes a holding end portion 452 and a coupling end portion 454. The holding end portion 452 includes a handle body 456 which provides a proximal gripping area 456*a*. The coupling end portion 454 includes a support platform 456*b*. The distal end of handle body 456 provides a pair of grooves 456*c* of two different widths, the larger groove being positioned above the smaller groove. A fastener hole 456*d* extends through the upper groove of the pair of grooves 456*c* and is configured to receive a fastener 458. The distal end of the handle body 456 also defines a hole 456*e* configured to receive a spring loaded plunger 460 or similar adjustable coupling device.

Arm member 462 is defined by a central member 462*a* configured to movably attach to the handle body 456 through the grooves 456*c*. A slot 462*b* is included to receive the fastener 458 to secure arm member 462 to handle body 456. Proximal protrusion 462*c* provides the user with adjustable control of arm member 462. Back plate 462*d* separates into a plurality of arm extensions 462*e* which extend either vertically or substantially vertically (e.g., axially) and/or horizontally or substantially horizontally (e.g., transversely) above support surface 456*b*. A series of holes 462*f* are included to provide intermediate positions for adjustably coupling arm member 462 with plunger 460. Curved surface 462*g* facilitates rotation of the arm member 462 in a preferred direction for installation and removal of the handle 450

The handle 450 is attached to the tray 480 by disposing arm member 462 on the distal lip of the tray 480*a* and rotating the handle body 456 until the surface 456*b* supports the tray 480. The user provides vertical support to the tray 480 through the handle body 456 and the support platform 456*b* while the arm extensions 462*e* provide downward force on the tray 480 increasing stability of the tray 480. The spring plunger 460 and the holes 462*f* provide adjustability of the handle 450 to the user for improved balance and hand positioning. Removal of the handle 450 is accomplished by rotating the proximal end of handle body 456 away from tray lip 480.

Figure 31A:
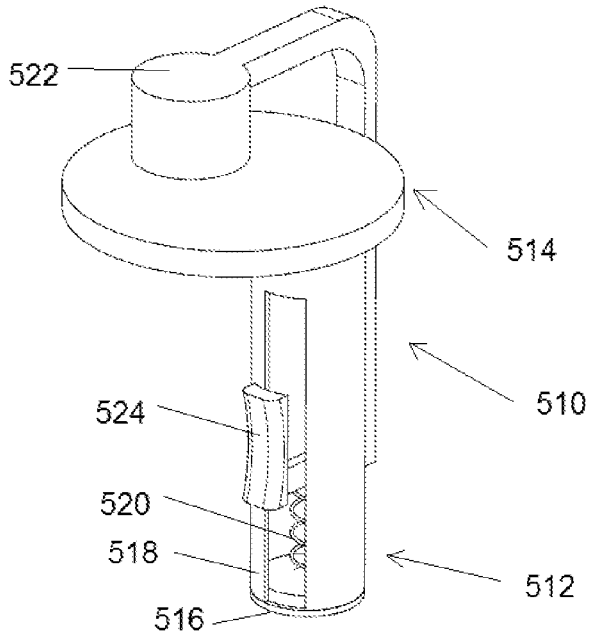
FIG. 31A is a perspective view of still another embodiment of the presently disclosed tray handle.
Figure 31B:
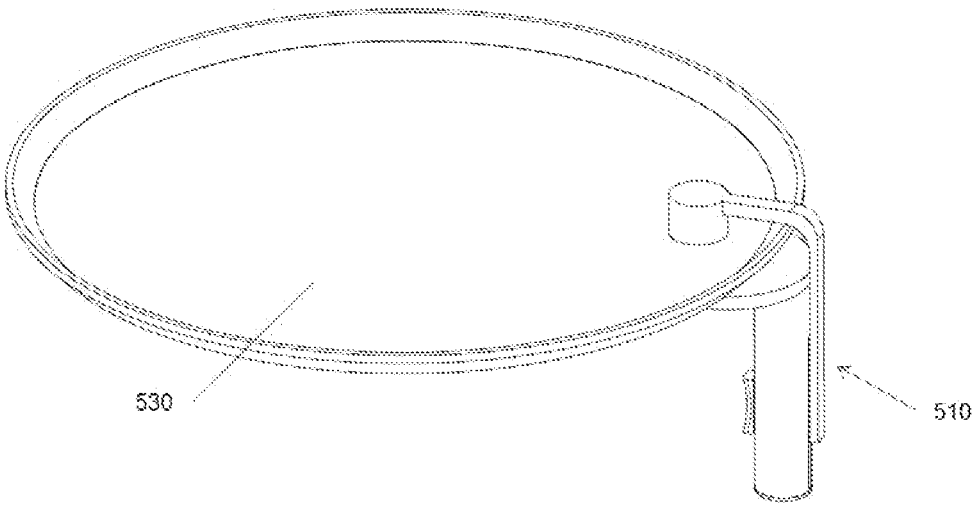
FIG. 31B is a perspective view of the embodiment of FIG. 31A disposed relative to a serving tray.

Referring to FIGS. 31A and 31B, a handle 510 includes a holding end portion 512 and a coupling end portion 514. The holding end portion 512 includes an end cap 516 with a flange configured to receive the handle body 518. Handle body 518 defines an inner bore at the proximal end and a support surface at the distal end as well as a slot through both sides. The handle body 518 inner bore contains an extension spring 520, which is secured to end cap 516 at one end, and to clamp arm 522 at the distal end. The coupling portion 514 of the handle 510 includes a clamp arm 522 which includes a horizontal member housed in a slot in handle body 518. Button 524 is secured to the proximal end of clamp arm 522 with adhesive, welding, threading or similar attachment methods to secure clamp arm 522 within handle body 518. The distal end of clamp arm 522 passes through handle body 518 and extends above and over the handle body 518.

Referring to FIG. 31B, during operation, the handle 510 support surface is placed under the tray 530 with clamp arm 522 at the distal end of the tray 530. Button 524 provides the user with vertical control of the movable clamp arm 522. Extension spring 520 biases the clamp arm 522 against the handle body 518 support surface. The user slides the button 524 vertically away from the end cap 516 to allow installation on the tray 530. Once the button 524 is released, the extension spring 520 lowers the clamp arm 522 providing a vertical downward force on the surface of the tray 530.

Figure 32A:
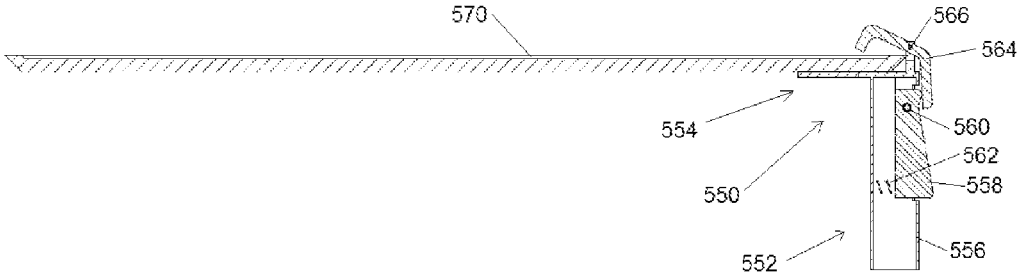
FIG. 32A is a side cross-sectional view of another embodiment of a tray handle in the retracted state disposed relative to a serving tray.
Figure 32B:
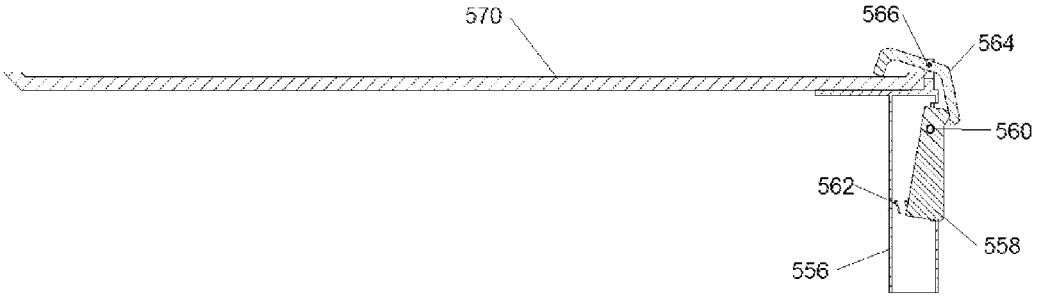
FIG. 32B is a side cross-sectional view of the embodiment of FIG. 32A in the extended state disposed relative to a serving tray.

Referring to FIGS. 32A and 32B, a handle 550 includes a holding end portion 552 and a coupling end portion 554. The holding end portion 552 includes a handle body 556 which houses a grip 558 which is pivotably connected by pin 560 and spring biased radially by compression spring 562. The distal end of grip 558 has a protrusion which contacts arm 564. Arm 564 is pivotably connected to handle body 556 by pin 566 allowing rotational motion over the edge of the tray 570.

Figure 32C:
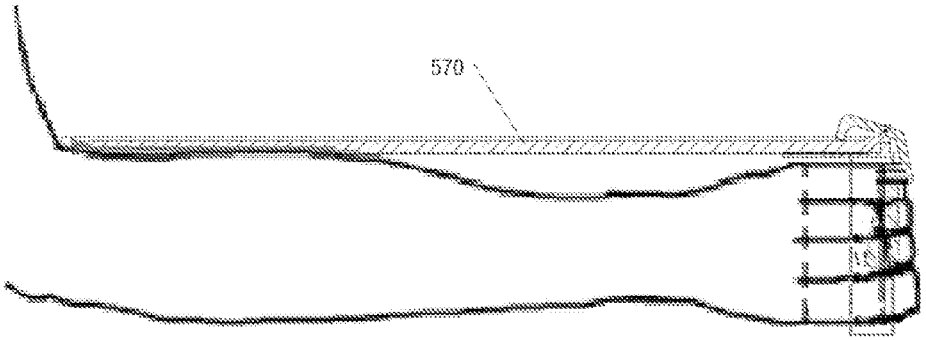
FIG. 32C is a side view showing a user holding the handle and serving tray of FIGS. 32A and 32B.

Referring to FIGS. 32B and 32C, the user operates handle 550 by placing the support portion of the handle body 556 underneath the distal end of the tray. The user squeezes the grip 558 which translates the input force through arm 564 to the top surface of the tray 570.

Figure 33A:
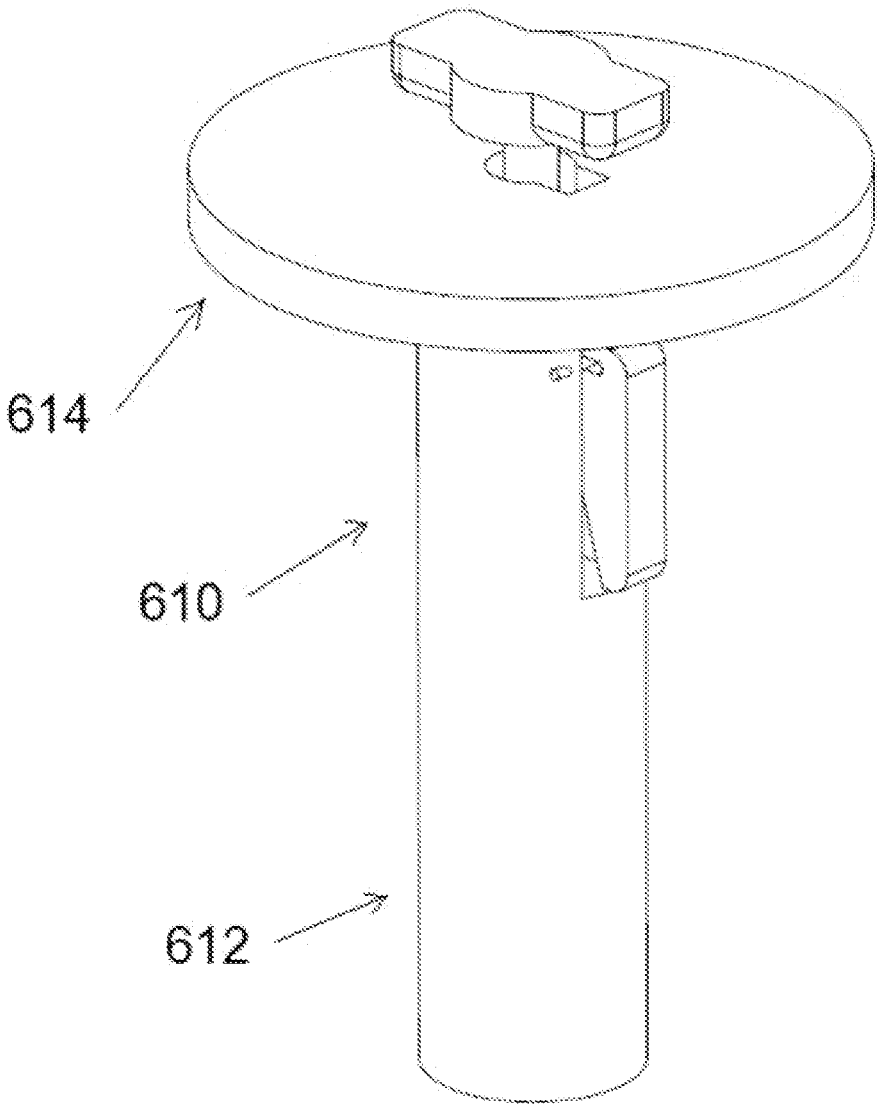
FIG. 33A is a perspective view of still another embodiment of the serving tray handle.
Figure 33B:
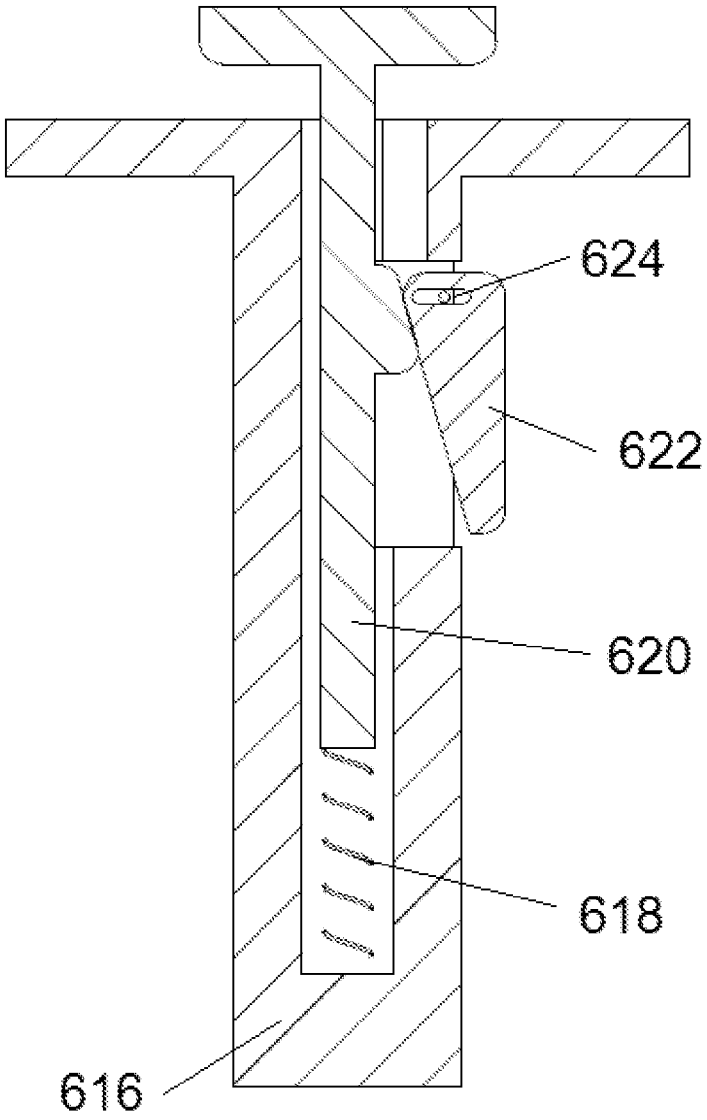
FIG. 33B is a side cross-sectional view of the embodiment of FIG. 33A.

Referring to FIGS. 33A and 33B, another embodiment of a handle 610 includes a holding portion 612 and a coupling portion 614. The handle body 616 contains a proximal gripping surface and a distal support platform. An internal bore houses a compression spring 618 and a shaft 620 with a pair of protrusions at the distal end located above the handle body 616 forming the coupling portion 614 of the handle 610. The shaft 620 provides an intermediate inclined plane which is slidably coupled with a button 622, said button 622 being pinned by pin 624 through a slot to handle body 616.

The handle 610 is designed to be used with the tray 440 and tray insert 442 of FIG. 28A. To operate handle 610, the user places the distal end of the shaft 620 through the tray insert 442 and rotates until the shaft 620 protrusions are out of alignment with the aperture in the tray insert 442*a*. The user then applies a force to the button 622 which transmits a horizontal force to the inclined plane on shaft 620 creating a downward force on shaft 620. The upper protrusions of the shaft 620 provide a downward force on the tray insert 442 thereby coupling the handle 610 to the tray 440.

Figure 34:
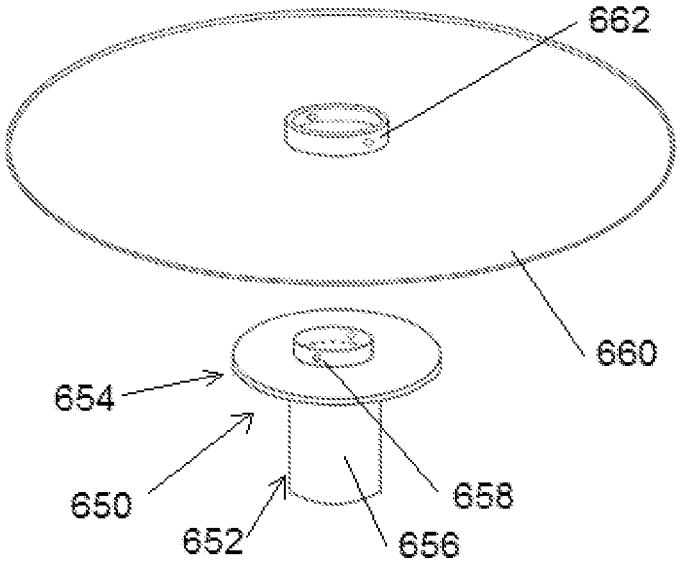
FIG. 34 is a perspective view of another embodiment of a serving tray handle.

Referring to FIG. 34, a handle 650 includes a holding portion 652 and a coupling portion 654. The holding portion 652 of the handle 650 includes a handle body 656 and a distal support platform. At least one protrusion from the support platform of the handle body 656 has a cylindrical shape and houses at least one spring plunger 658 or similar removably coupling device. A tray 660 is defined by a planar surface and a hole configured to receive the coupling portion of the handle body 656. A collar 662 on the top surface of the tray 660 has at least one depression configured to receive the spring plunger 658.

To couple the handle 650 to the tray 660, the handle 650 is inserted through the penetration in the tray 660 until the handle 650 support platform seats on the bottom surface of the tray 660. To securely couple the handle 650 to the tray 660, the handle 650 can be rotated until plungers 658 engage the depressions in the collar 662.

Figure 35A:
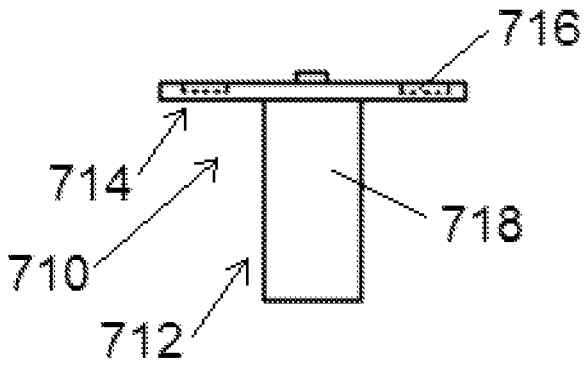
FIG. 35A is a side view of another embodiment of a serving tray handle.
Figure 35B:
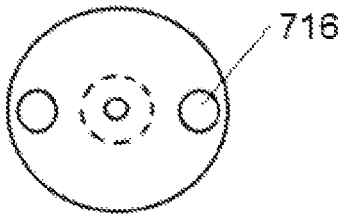
FIG. 35B is a top view of the embodiment of FIG. 35A.

Referring to FIGS. 35A and 35B, a handle 710 includes a holding portion 712 and a coupling portion 714 and one or more magnets 716. The handle body 718 defines a proximal gripping surface and a distal support platform. The coupling portion 714 includes the distal support platform which has a center protrusion. The upper support platform houses the one or more magnets 716.

To couple the handle 710 to a tray (not shown), the handle body 718 support platform is placed against the underside of a metallic tray or a non-magnetic serving tray modified to receive a magnetic handle as described in previous embodiments as in serving tray 50. The protrusion on the distal support platform provides alignment and seating of the handle 710 to the tray with a mating cavity in the tray or tray receiver plate (not shown).

Figure 36A:
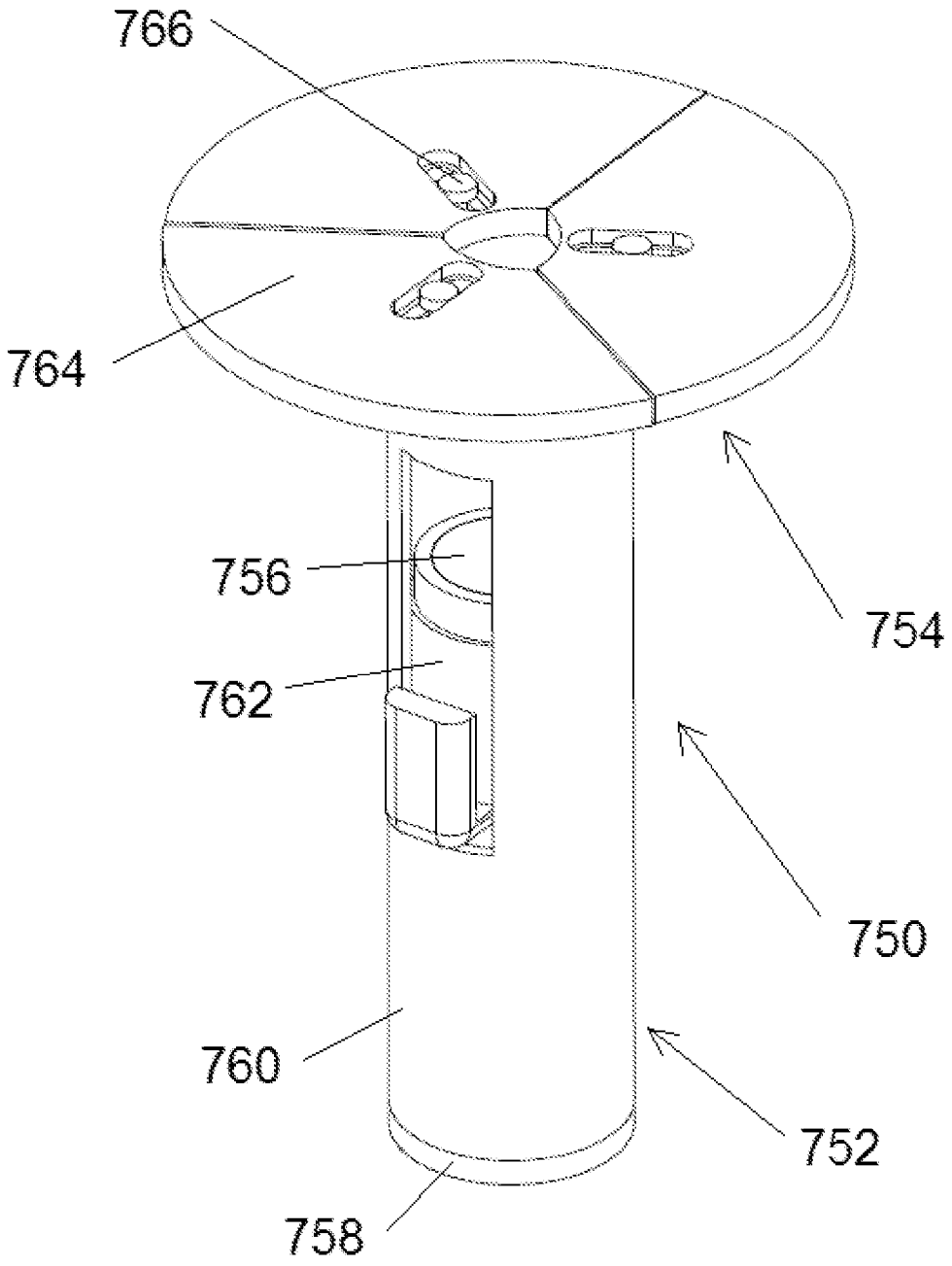
FIG. 36A is a perspective view of another embodiment of a serving tray handle in a first state.
Figure 36B:
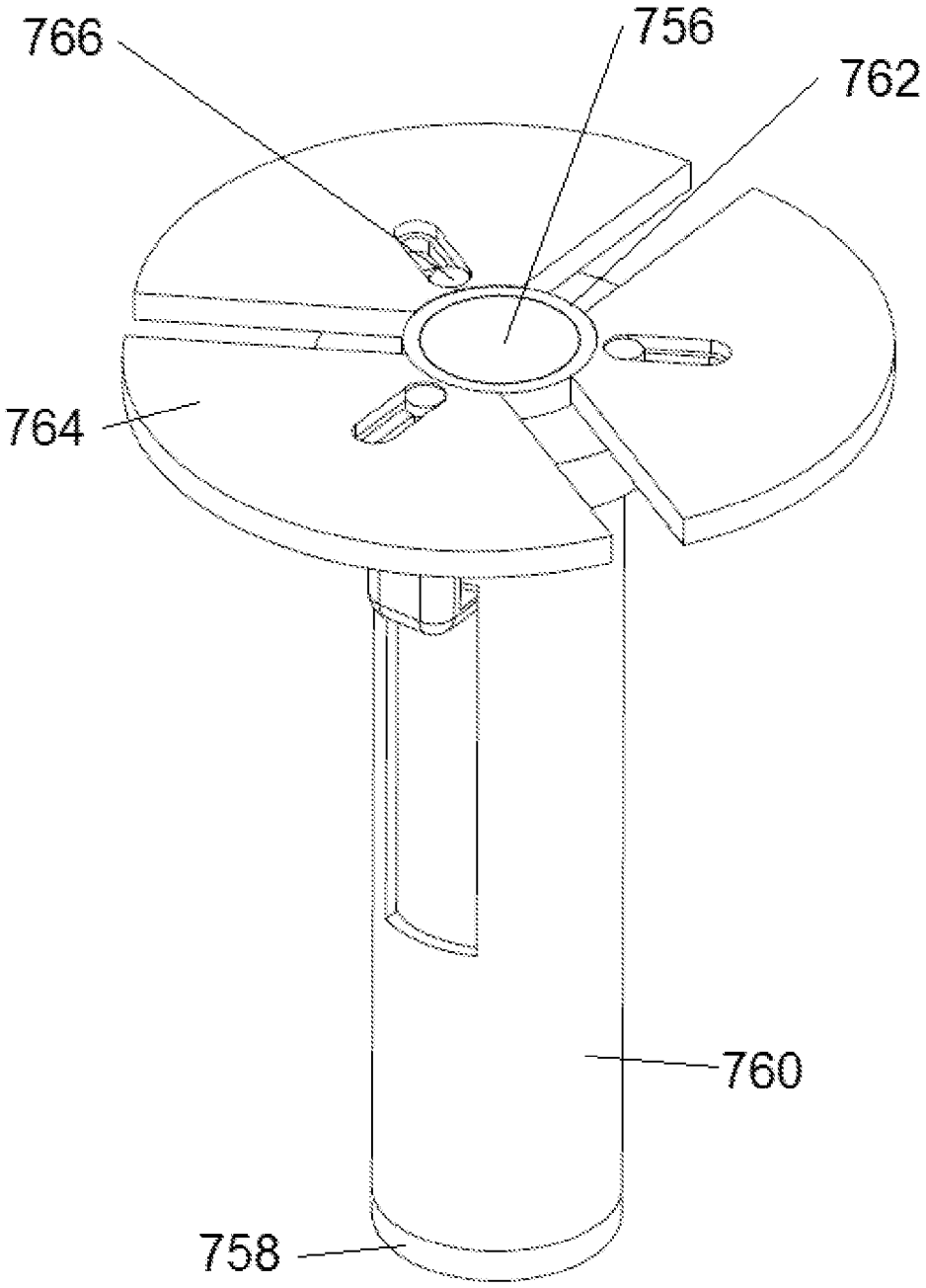
FIG. 36B is a perspective view of the embodiment of FIG. 36A in a second state.

Referring to FIGS. 36A and 36B, a handle 750 includes a holding end portion 752, a coupling end portion 754, and at least one magnet 756. The holding end portion 752 includes an end cap 758 which is inserted into the proximal end of the handle body 760 closing the lower opening of handle body 760. The handle body 760 defines a proximal gripping surface and a distal support platform. The handle body 760 has a slot in one side. A magnet housing 762 includes a stepped outer diameter and a radial protrusion configured to fit within the slot in the handle body wall 760. The distal end of the magnet housing 762 has a pocket configured to receive a magnet 756. The magnet 756 is mounted to the magnet housing 762 with adhesive, threads or the like. The distal end of the handle body 760 supports a plurality of support arms 764 which are mounted to the handle body 760 with shoulder screws 766 or pins or similar fastening methods. The support arms 764 have radial slots allowing motion of the support arms 764, relative to the handle body 760.

To couple the handle 750 to the ferromagnetic material of an independent serving tray (not shown), the user slides support arms 764 radially outward. Once the top of the bore in the handle body 760 has been uncovered, the magnet housing 762 can be raised to the distal portion of the handle body 760 thereby allowing the magnet 756 to be coupled with a ferromagnetic portion of a serving tray (not shown).

Figure 37A:
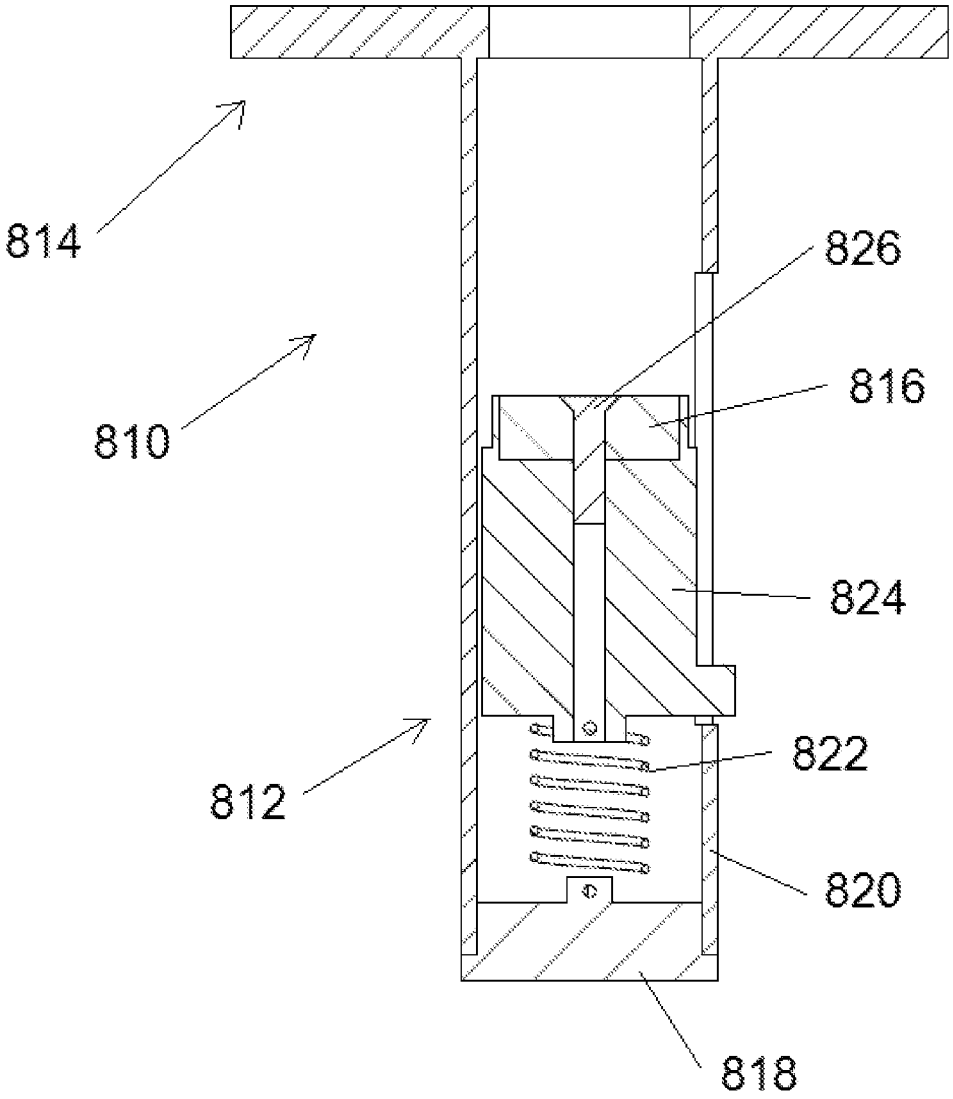
FIG. 37A is a side cross-sectional view of another embodiment of a serving tray handle in a first state.
Figure 37B:
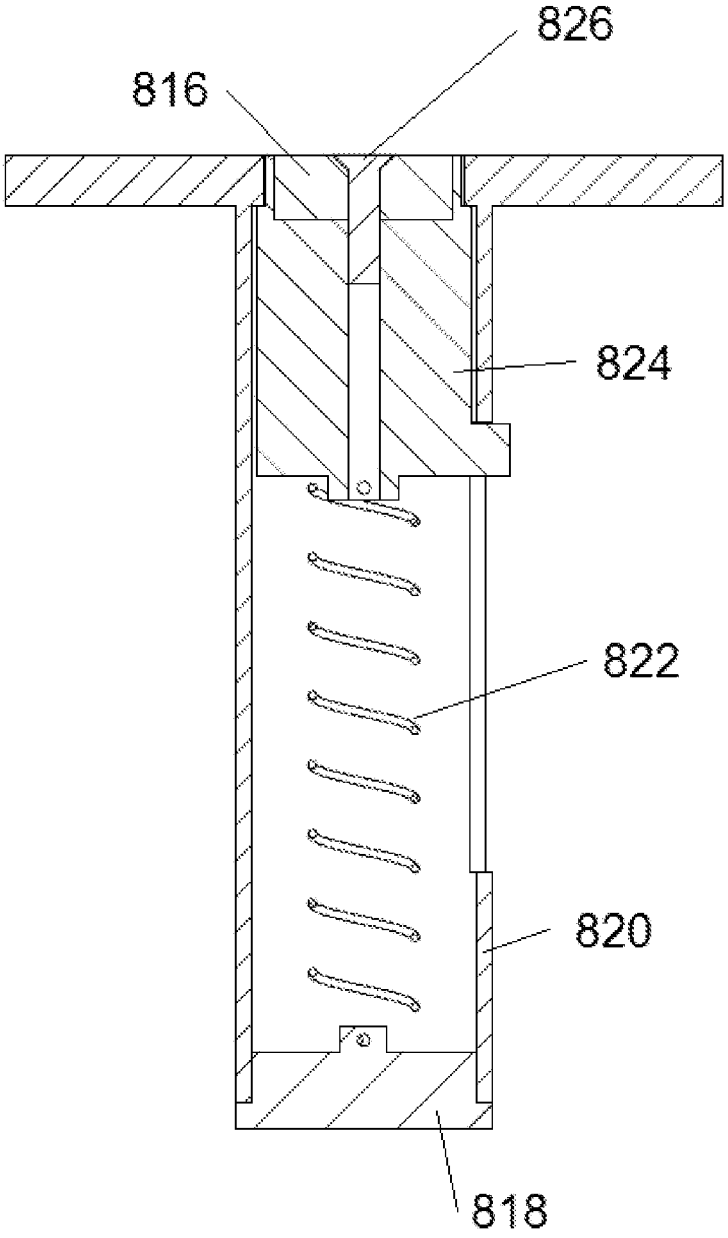
FIG. 37B is a side cross-sectional view of the embodiment of FIG. 37A in a second state.

Referring to FIGS. 37A and 37B, a handle 810 includes a holding end portion 812, a coupling end portion 814, and at least one magnet 816. The holding end portion 812 includes an end cap 818 inserted into the proximal end of the handle body 820 thereby closing the proximal aperture of the handle body 820. The handle body 820 defines a proximal gripping surface and includes a slot in at least one side. The coupling portion 814 includes a distal support platform defined by handle body 820. An extension spring 822 is connected between the end cap 818 and a magnet housing 824. The magnet housing 824 is configured to movably fit within the inner bore of handle body 820 and said magnet housing 824 has a distal pocket to receive the magnet 816 and a fastener 826. The magnet housing 824 also has a radial protrusion configured to fit within the slot in the side of the handle body 820 allowing the user to control travel of the magnet housing 824 and magnet 816.

To couple the handle 810 to a serving tray, the handle is placed underneath the serving tray in the proximity of the ferromagnetic receiver plate of the trays shown in previous embodiments, such as tray 50 shown in FIG. 8A. The user raises the magnet housing 824 against the force of spring 822 until the handle 810 is magnetically coupled to the independent serving tray 50. To decouple the handle 810 from the tray 50 (not shown), the user slides the handle 810 away in a shear direction from the ferromagnetic receiver 52 until the magnet 816 and receiver 52 are beyond the pull of the magnet 816. The spring 822 returns the magnet housing 824 and magnet 816 to the proximal portion of the handle body 820.

Figure 38A:
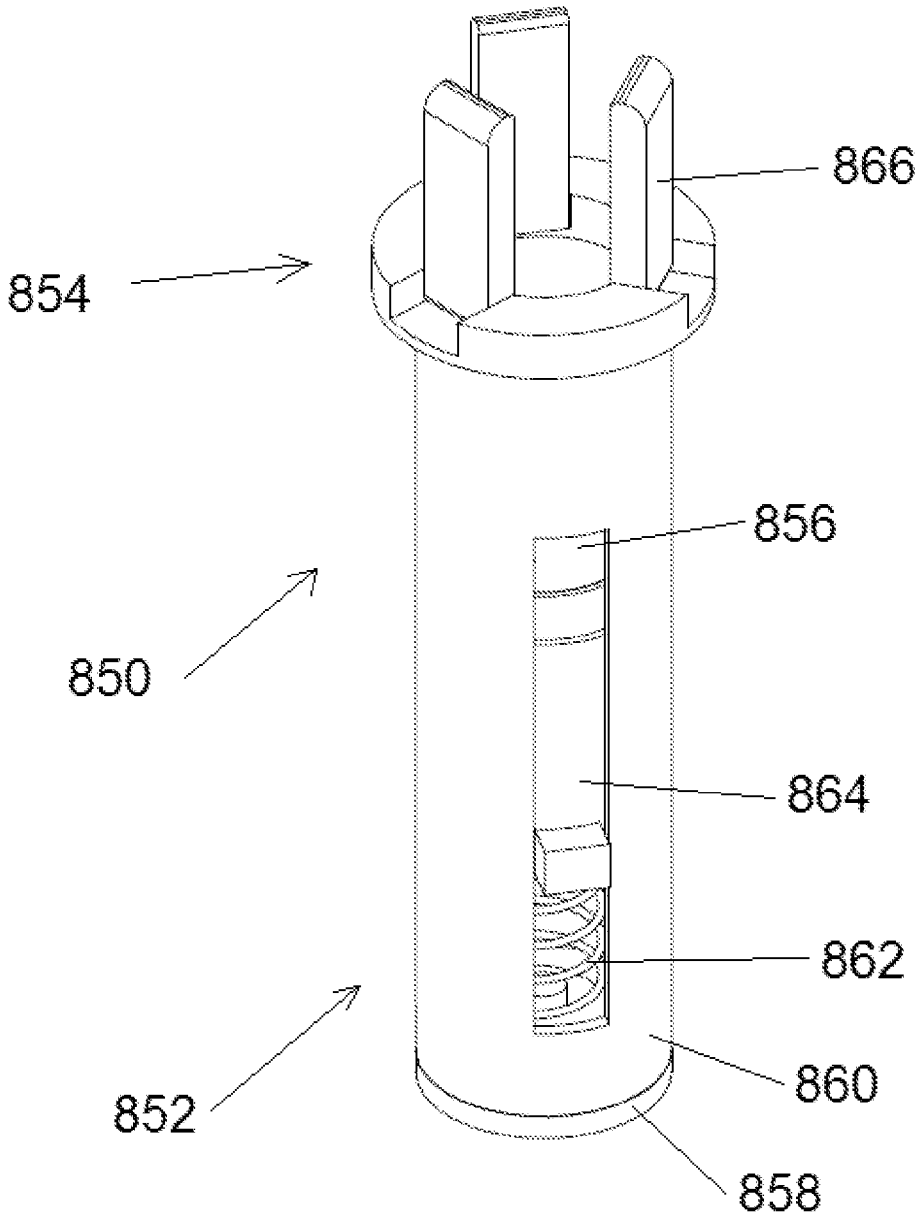
FIG. 38A is a perspective view of another embodiment of a serving tray handle in a first state.
Figure 38B:
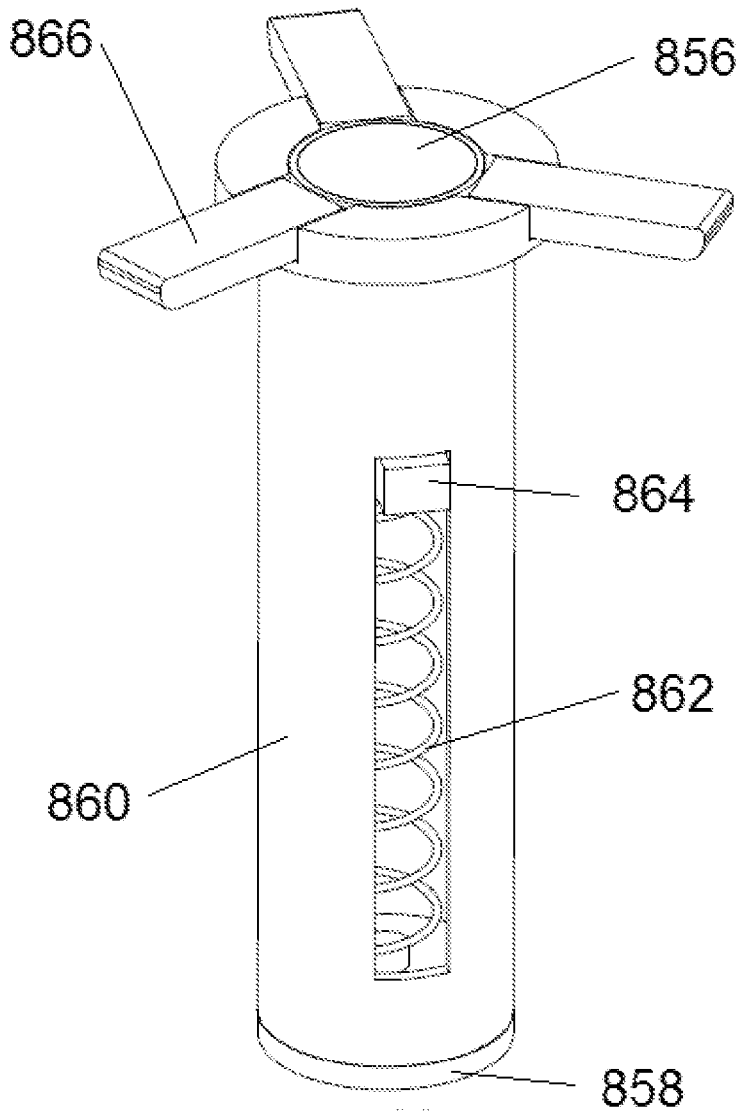
FIG. 38B is a perspective view of the embodiment of FIG. 38A in a second state.
Figure 39:
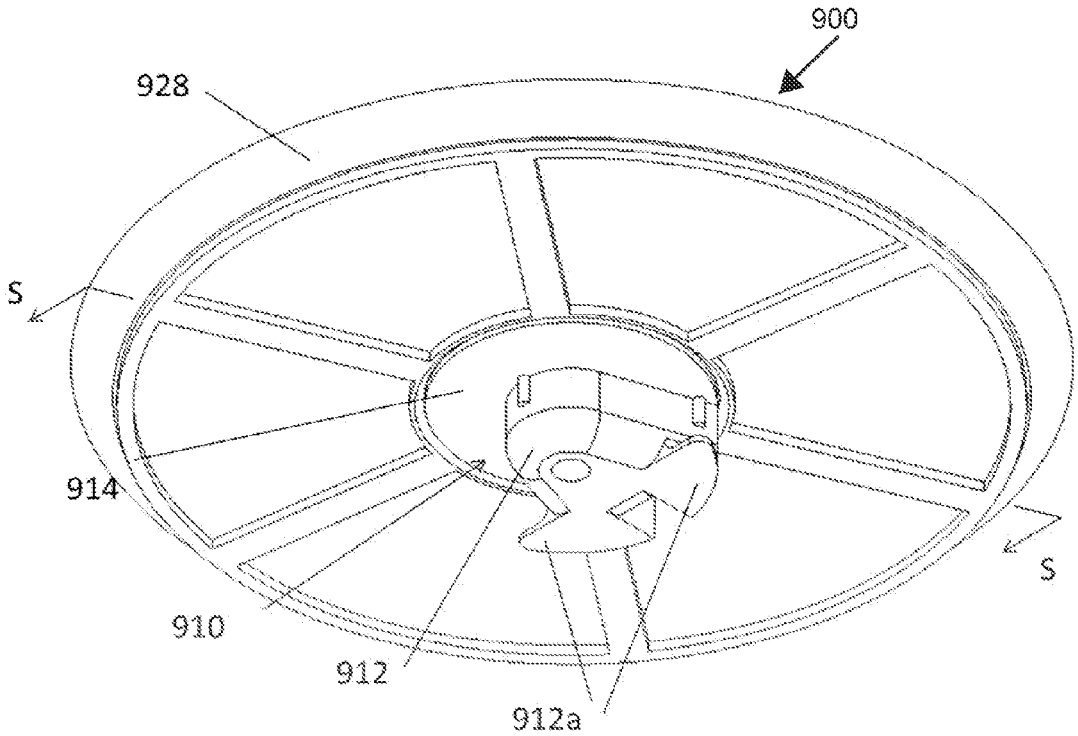
FIG. 39 is a bottom perspective view of one embodiment of a serving tray assembly.

Referring to FIGS. 38A and 38B, a handle 850 includes a holding end portion 852, a coupling end portion 854, and a magnet 856. The holding end portion 852 includes an end cap 858 with a flange inserted into the proximal end of a handle body 860 thereby closing the lower aperture of the handle body 860. The handle body 860 defines a proximal gripping surface and a distal support platform. At least one slot is included in at least one side of the handle body 860. An extension spring 862 is connected between the end cap 858 and a magnet housing 864. The magnet housing 864 includes a pocket to receive the magnet 856. The magnet housing 864 also includes a radial protrusion configured to fit within the slot in the side of the handle body 860 allowing the user to control travel of the magnet housing 864 and magnet 856. The coupling end portion 854 of the handle 850 receives pivotably attached support arms 866 attached with integral pins into apertures in the handle body 860. The proximal end of support arms 866 are configured such that when the support arms 866 are in the first state (vertical orientation), the proximal surfaces of support arms 866 extend above the distal bore of the handle body 860.

The handle 850 is operated by raising the magnet housing 864 to the distal end of the handle body 860. The magnet housing 864 contacts the proximal surfaces of support arms 866 thereby rotating the support arms 866 to the second state (horizontal orientation). With the support arms 866 in the horizontal state, the handle 850 can be coupled to an independent serving tray with ferromagnetic material (not shown). Decoupling of the handle 850 from the tray (not shown) can be accomplished by sliding the handle 850 away from the ferromagnetic insert of an independent serving tray (not shown).

Referring to FIGS. 39 and 40A-40C, one embodiment of a serving tray system 900 includes a handle 910 and a tray 928. The handle 910 has a holding end portion 912, a coupling end portion 914 secured to the holding end portion 912, and one or more magnets 916 supported by the holding end portion 912. One or multiple fasteners 920 such as screws may secure the holding end portion 912 to the coupling end portion 914. Alternatively, similar mechanical securing methods including, but not limited, to riveting, bonding, welding, and/or the like could be used. The holding end portion 912 of handle 910 includes protruding surfaces 912*a* to facilitate user gripping (e.g., for fingers). Protruding surfaces 912*a* of holding end portion 912 can have any suitable configuration and may include finger depressions (not shown) for improving ergonomics. The holding end portion 912 defines a cavity 912*b* therein.

The magnet 916 is contained in a support member 918 supported in the cavity 912*b* of the holding end portion 912. The support member 918 may be formed of steel or aluminum. The support member 918 may be configured to orient magnet 916 and direct a magnetic field of the magnet 916 in a single general direction, for example, toward the tray 928. The magnetic field of magnet 916 may also be oriented as a function of the material of the support member 918 (e.g., steel). The support member 918 may include a threaded feature 918*a* depending therefrom for threaded attachment to the holding end portion 912 of the handle 910. The threaded feature 918*a* of the support member 918 may enable the support member 918 to be threaded up and/or down relative to the holding end portion 912, for example, to control/adjust magnetic connection strength between the magnets 916 and the tray 928. In some embodiments, the holding end portion 912, the support member 918, and/or the coupling end portion 914 may be integrally and/or monolithically formed.

The handle 910 further includes a release member 922 pivotally attached to the holding end portion 912 by a pin 924. Release member 922 is pivotable between a first or unactuated state (see FIG. 40A) and a second or actuated state (see FIG. 40B) to enable selective securement of the handle 910 to the tray 928. Release member 922 includes a trigger segment 922*b* and a leverage segment 922*c*. Release member 922 further supports a spring 926 that biases the release member 922 toward the first or unactuated state. The spring 926 is configured to enable release member 922 to pivot toward the second or actuated state upon application of a pivoting force on the trigger segment 922*b* of the release member 922. In the first or unactuated state, the leverage segment 922*c* of the release member 922 is aligned or substantially aligned with the coupling end portion 914 of the handle 910. In the second or actuated state, the leverage segment 922*c* of the release member 922 is disposed at an angle relative to the coupling end portion 914 of the handle 910. The leverage segment 922*c* of the release member 922 is configured to selectively engage a bottom surface of the tray 928 in response to pivoting movement of trigger segment 922*b* of the release member 922 from the first state to the second state to selectively separate the tray 928 from the handle 910 while the handle 910 is magnetically coupled to the tray 928 as described in greater detail below. A first recess 922*a* is defined in the release member 922 and a second recess 912*c* is defined in the holding end portion 912 to restrain opposite ends 926*a*, 926*b* of the spring 926.

The tray 928, which can be made of a non-ferromagnetic material, supports a ferromagnetic insert 930. Similar to other embodiments described herein, tray 928 can be formed, at least partially, of any suitable magnetically attractive material. The insert 930 may be secured to tray 928 using any known securement technique such as riveting, bonding, welding, fastening, or the like. Tray 928 includes an alignment feature 928*a* positioned to guide the coupling end portion 914 of handle 910 so that the magnet 916 of the handle 910 is positioned to readily align with the insert 930 of the tray 928 to facilitate a quick coupling of the handle 910 to the tray 928.

In use, the holding end portion 912 of the handle 910 is grasped by the user and oriented, for example, with the aid of the alignment feature 928*a* of the tray 928, so that the coupling end portion 914 of the handle 910 can selectively and releasably engage the tray 928. When the tray 928 and the handle 910 are positioned in close approximation to one another, the magnetic field of the magnet 916 magnetically couples to the ferromagnetic insert 930 to releasably secure the handle 910 to the tray 928.

Figure 40A:
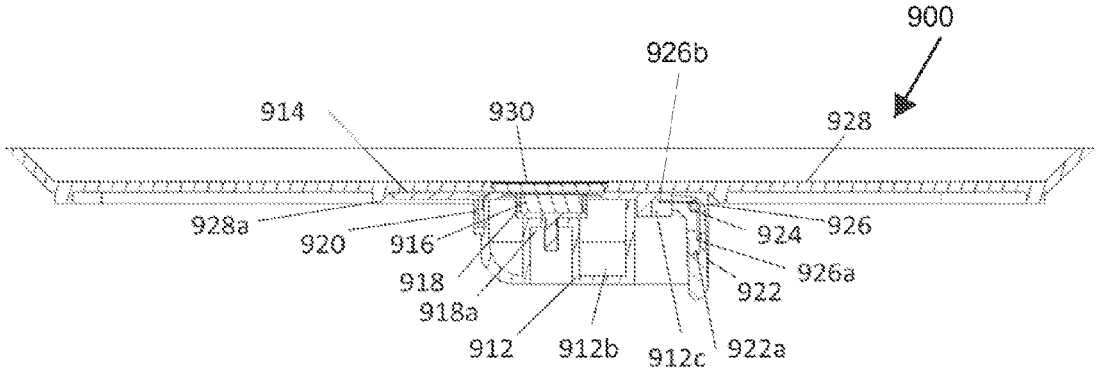
FIGS. 40A-40C are progressive, side, cross-sectional views taken along line S-S shown in FIG. 39 illustrating a handle of the serving tray assembly of FIG. 39 being decoupled from a serving tray of the serving tray assembly of FIG. 39.
Figure 40B:
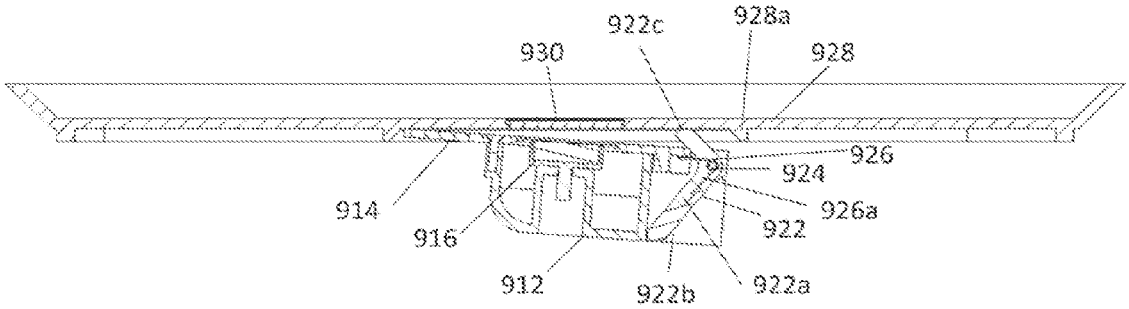
Figure 40C:
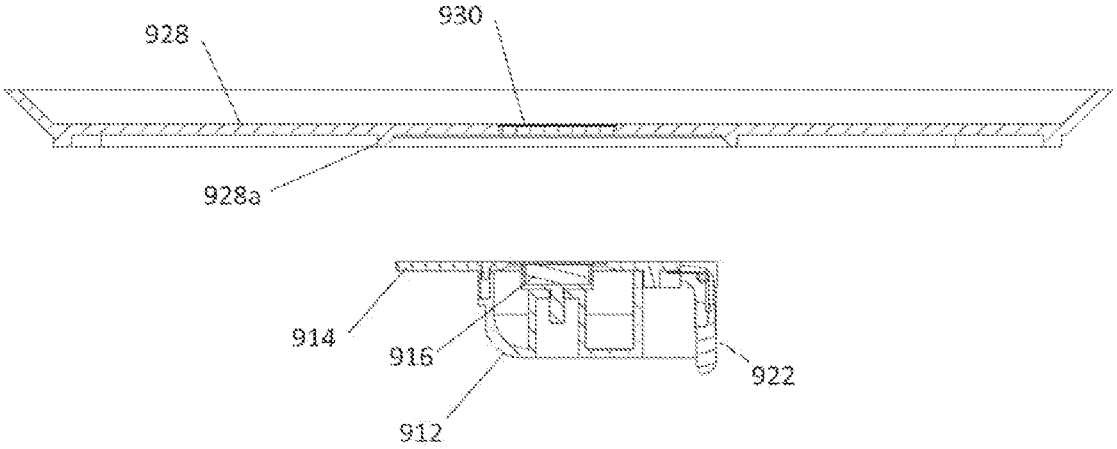

As seen in FIG. 40B, to remove the handle 910 from the tray 928, the user pivots the release member 922*b* about the pin 924, such that the leverage segment 922*c* of the release member 922 is angled relative to the coupling end portion 914 of the handle 910 to engage the bottom surface of the tray 928 for spacing the magnet 916 from the tray 928 to separate the handle 910 from the tray 928. As the tray 928 and the handle 910 separate, the strength of the magnetic connection between the magnet 916 of the handle 910 and the insert 930 of the tray 928 reduces. Reduction of the magnetic connection between the insert 930 and the magnet 916 thereby enables the user to separate the handle 910 from the tray 928 as seen in FIG. 40C. Once the handle 910 is completely separated from the tray 928, the release member 922 can be released by the user, enabling the release member to automatically bias back toward the unactuated position for selectively connecting the handle 910 to the tray 928 as desired. This process can be repeated as desired.

In certain embodiments, the handle 910 may include a rotatable knob (not shown) or any other suitable actuating device that is mechanically and/or electrically (e.g., via a battery powered rotatable motor not shown) coupled to the support member 918 for threading threaded feature 918*a* up and/or down relative to holding end portion 912 to selectively adjust the magnetic connection strength provided between the tray 928 and the handle 910 and/or to selectively release and/or engage the magnetic connection as desired.

Any of the embodiments described may include bright colors, anti-microbial materials, and/or resilient coatings for increased comfort and usability. Embodiments of the handle an/or tray may be configured to secure a bottle opener and/or a writing implement.

Persons skilled in the art will understand that the structures and methods specifically described herein and illustrated in the accompanying figures are non-limiting exemplary embodiments, and that the description, disclosure, and figures should be construed merely as exemplary of particular embodiments. It is to be understood, therefore, that the present disclosure is not limited to the precise embodiments described, and that various other changes and modifications may be effected by one skilled in the art without departing from the scope or spirit of the disclosure. Additionally, it is envisioned that the elements and features illustrated or described in connection with one exemplary embodiment may be combined with the elements and features of another without departing from the scope of the present disclosure, and that such modifications and variations are also intended to be included within the scope of the present disclosure. Accordingly, the subject matter of the present disclosure is not to be limited by what has been particularly shown and described.

What is claimed is:

1. A serving tray system, comprising:

a serving tray;

a handle;

a magnetic member supported by the handle and configured to selectively secure the handle to the serving tray; and a release member supported on the handle and configured to selectively engage the serving tray to space the magnetic member from the serving tray for separating the handle from the serving tray.

2. The serving tray system of claim 1, wherein the handle includes a support member configured to support the magnetic member.

3. The serving tray system of claim 2, wherein the support member is formed of steel.

4. The serving tray system of claim 1, wherein the release member is pivotally attached to the handle and movable between an actuated state and an unactuated state.

5. The serving tray system of claim 1, wherein the release member is biased toward the unactuated state by a spring.

6. The serving tray system of claim 1, wherein the release member includes a trigger segment and a leverage segment, the leverage segment configured to engage the serving tray upon actuation of the trigger segment.

7. The serving tray system of claim 1, wherein at least a portion of the serving tray includes ferromagnetic material.

8. The serving tray system of claim 1, wherein the serving tray includes an alignment feature configured to align the magnetic member of the handle with a predetermined location of the serving tray.

9. A handle for carrying a serving tray, comprising:

a body;

a magnetic member supported by the body and configured to selectively secure the body to the serving tray; and a release member supported by the body and configured to selectively engage the serving tray to space the magnetic member from the serving tray for separating the body from the serving tray.

10. The handle of claim 9, wherein the body includes a support member configured to support the magnetic member.

11. The handle of claim 10, wherein the support member is formed of steel.

12. The handle of claim 9, wherein the release member is pivotally attached to the body and movable between an actuated state and an unactuated state.

13. The handle of claim 9, wherein the release member is biased toward the unactuated state by a spring.

14. The handle of claim 9, wherein the release member includes a trigger segment and a leverage segment, the leverage segment configured to engage the serving tray upon actuation of the trigger segment.

15. A portable handle for securement to an independent serving tray, the portable handle comprising:

a body formed of non-magnetic material and configured to support the independent serving tray, the body including a holding end portion and a coupling end portion;

a magnet supported within the body and configured to provide a magnetic force in the coupling end portion of the body to attach the coupling end portion of the body to the independent serving tray; and a release member configured to separate the body from the independent serving tray.

16. The portable handle of claim 15, wherein the magnet is movable between a first state and a second state, the coupling end portion being securable to the independent serving tray in the first state and prevented from securing to the independent serving tray in the second state.

17. The portable handle of claim 16, wherein a movement of the coupling end portion to the first state enables magnetic coupling.

18. The portable handle of claim 15, wherein the magnet is movable relative to the holding end portion.

19. The portable handle of claim 15, wherein the release member is pivotally coupled to the body.

* * * * *